US008624943B2

(12) United States Patent
Noguchi et al.

(10) Patent No.: US 8,624,943 B2
(45) Date of Patent: Jan. 7, 2014

(54) IMAGE DISPLAY PANEL, IMAGE DISPLAY APPARATUS DRIVING METHOD, IMAGE DISPLAY APPARATUS ASSEMBLY, AND DRIVING METHOD OF THE SAME

(75) Inventors: Koji Noguchi, Kanagawa (JP); Yukiko Iijima, Tokyo (JP); Akira Sakaigawa, Kanagawa (JP); Masaaki Kabe, Kanagawa (JP)

(73) Assignee: Japan Display West, Inc., Chita (JP)

( * ) Notice: Subject to any disclaimer, the term of this patent is extended or adjusted under 35 U.S.C. 154(b) by 940 days.

(21) Appl. No.: 12/486,149

(22) Filed: Jun. 17, 2009

(65) Prior Publication Data

US 2009/0322802 A1 Dec. 31, 2009

(30) Foreign Application Priority Data

Jun. 30, 2008 (JP) ..... 2008-170796
Apr. 22, 2009 (JP) ..... 2009-103854

(51) Int. Cl.
*G09G 5/02* (2006.01)

(52) U.S. Cl.
USPC ..... 345/694; 345/83

(58) Field of Classification Search
USPC ..... 345/694, 83
See application file for complete search history.

(56) References Cited

U.S. PATENT DOCUMENTS

2004/0046725 A1* 3/2004 Lee ..... 345/88
2007/0159492 A1* 7/2007 Lo et al. ..... 345/589
2008/0150863 A1* 6/2008 Morisue et al. ..... 345/88

FOREIGN PATENT DOCUMENTS

JP 04-130395 3/2001
JP 2001-147666 5/2006
WO WO 2004/086128 10/2004
WO WO/2007/088656 * 8/2007 ..... G09F 9/30
WO WO-2007/88656 8/2007

* cited by examiner

*Primary Examiner* — Alexander S Beck
*Assistant Examiner* — Amen Bogale
(74) *Attorney, Agent, or Firm* — Robert J. Depke; The Chicago Technology Law Group, LLC

(57) ABSTRACT

Disclosed herein is a method for driving an image display apparatus including: an image display panel whereon pixels each having first to third sub-pixels are laid out in first and second directions to form a 2-dimensional matrix, at least each specific pixel and an adjacent pixel adjacent to the specific pixel in the first direction are used as first and second pixels respectively to create one of pixel groups, and a fourth sub-pixel is placed between the first and second pixels in each of the pixel groups; and a signal processing section configured to generate first to third sub-pixel output signals for the first pixel on the basis of respectively first to third sub-pixel input signals and to generate first to third sub-pixel output signals for the second pixel on the basis of respectively first to third sub-pixel input signals.

9 Claims, 20 Drawing Sheets

IMAGE DISPLAY PANEL, IMAGE DISPLAY APPARATUS DRIVING METHOD, IMAGE DISPLAY APPARATUS ASSEMBLY, AND DRIVING METHOD OF THE SAME

BACKGROUND OF THE INVENTION

1. Field of the Invention

The present invention relates to an image display panel, a method for driving an image display apparatus employing the image display panel, an image display apparatus assembly including the image display apparatus and a method for driving the image display apparatus assembly.

2. Description of the Related Art

In recent years, an image display apparatus such as a color liquid-crystal display apparatus raises a problem of increased power consumption as a consequence of a raised performance. In particular, a higher resolution, widened color reproduction range and higher luminance of a color liquid-crystal display apparatus undesirably raise a problem of increased power consumption of a backlight employed in the apparatus.

In order to solve this problem, there has been provided a technology for raising the luminance. In accordance with this technology, each display pixel is configured to include four sub-pixels, i.e., typically, a white-color display sub-pixel for displaying the white color in addition to the three elementary-color display sub-pixels, that is, a red-color display sub-pixel for displaying the elementary red color, a green-color display sub-pixel for displaying the elementary green color and a blue-color display sub-pixel for displaying the elementary blue color. That is to say, the white-color display sub-pixel increases the luminance.

The 4-sub-pixel configuration according to the provided technology is capable of providing a high luminance at the same power consumption as the existing technology. Thus, if the luminance of the provided technology is set at the same level as the existing technology, the power consumption of the backlight can be decreased and the quality of the displayed image can be improved.

As a typical example of the existing image display apparatus, a color image display apparatus is disclosed in Japanese Patent No. 3167026. The color image display apparatus employs:

means for generating three color signals of three different hues from a sub-pixel input signal in accordance with a 3-elementary-color addition method; and means for generating a supplementary signal obtained as a result of a color addition operation carried out on the color signals of the three different hues at the same addition ratio and for supplying a total of four different display signals, composed of the supplementary signal and three different color signals obtained as a result of subtracting the supplementary signal from the color signals of the three hues, to a display section.

It is to be noted that the color signals of the three different hues are used to drive respectively the red-color display sub-pixel for displaying the elementary red color, the green-color display sub-pixel for displaying the elementary green color and the blue-color display sub-pixel for displaying the elementary blue color whereas the supplementary signal is used to drive the white-color display sub-pixel for displaying the white color.

As another typical example of the existing image display apparatus, a liquid-crystal display apparatus capable of displaying color images is disclosed in Japanese Patent No. 3805150. The color liquid-crystal display apparatus employs a liquid-crystal display panel having main pixel units which each include a red-color output sub-pixel, a green-color output sub-pixel, a blue-color output sub-pixel and a luminance sub-pixel. The color liquid-crystal display apparatus further has processing means for finding a digital value W for driving the luminance sub-pixel, a digital value Ro for driving the red-color output sub-pixel, a digital value Go for driving the green-color output sub-pixel and a digital value Bo for driving the blue-color output sub-pixel by making use of a digital value Ri of a red-color input sub-pixel, a digital value Gi of a green-color input sub-pixel and a digital value Bi of a blue-color input sub-pixel. The digital value Ri of the red-color input sub-pixel, the digital value Gi of the green-color input sub-pixel and the digital value Bi of the blue-color input sub-pixel are digital values obtained from an input image signal. In the color liquid-crystal display apparatus, the processing means finds the digital value W, the digital value Ro, the digital value Go and the digital value Bo which satisfy the following conditions:

Firstly, the digital value W, the digital value Ro, the digital value Go and the digital value Bo shall satisfy the following equation:

$$Ri:Gi:Bi=(Ro+W):(Go+W):(Bo+W)$$

Secondly, due to the addition of the luminance sub-pixel, the digital value W, the digital value Ro, the digital value Go and the digital value Bo shall result in a luminance stronger than the luminance of light emitted by a configuration composed of only the red-color output sub-pixel, the green-color output sub-pixel and the blue-color output sub-pixel.

In addition, PCT/KR 2004/000659 also discloses a liquid-crystal display apparatus which employs first pixels each including a red-color display sub-pixel, a green-color display sub-pixel and a blue-color display sub-pixel as well as second pixels each including a red-color display sub-pixel, a green-color display sub-pixel and a white-color display sub-pixel. The first pixels and the second pixels are laid out alternately in a first direction as well as in a second direction. As an alternative, in the first direction, the first pixels and the second pixels are laid out alternately but, in the second direction, on the other hand, the first pixels are laid out adjacently and, thus, the second pixels are also laid out adjacently as well.

SUMMARY OF THE INVENTION

By the way, in accordance with the technologies disclosed in Japanese Patent No. 3167026 and Japanese Patent No. 3805150, it is necessary to divide one pixel into four sub-pixels which are a red-color output sub-pixel (that is, a red-color display sub-pixel), a green-color output sub-pixel (that is, a green-color display sub-pixel), a blue-color output sub-pixel (that is, a blue-color display sub-pixel) and a luminance sub-pixel (that is, a white-color display sub-pixel). Thus, the area of an aperture in each of the red-color output sub-pixel (that is, the red-color display sub-pixel), the green-color output sub-pixel (that is, the green-color display sub-pixel) and the blue-color output sub-pixel (that is, the blue-color display sub-pixel) decreases. The area of the aperture represents the maximum optical transmittance. That is to say, even though the luminance sub-pixel (that is, the white-color display sub-pixel) is added, the luminance of light emitted by all the pixels does not increase to the expected level in some cases.

In addition, in the case of the technology disclosed in PCT/KR2004/000659, in the second pixel, the blue-color display sub-pixel is replaced by the white-color display sub-pixel. Then, a sub-pixel output signal supplied to the white-color display sub-pixel is a sub-pixel output signal supplied to the blue-color display sub-pixel assumed to exist prior to the replacement of the blue-color display sub-pixel with the white-color display sub-pixel. Thus, the sub-pixel output signals supplied to the blue-color display sub-pixel included in the first pixel and the white-color display sub-pixel included in the second pixel are not optimized. In addition, since the colors and the luminance change, this technology raises a problem that the quality of the displayed image deteriorates considerably.

Addressing the problems described above, inventors of the present invention have innovated an image display panel capable of as effectively preventing the area of an aperture in each sub-pixel from decreasing as possible, optimizing a sub-pixel output signal generated for every sub-pixel and increasing the luminance with a high degree of reliability. In addition, the inventors of the present invention have also innovated a method for driving an image display apparatus employing the image display panel, an image display apparatus assembly including the image display apparatus and a method for driving the image display apparatus assembly.

A method for driving an image display apparatus provided in accordance with a first mode of the present invention in order to solve the problems described above is a method for driving an image display apparatus having:

(A): an image display panel on which:

pixels each composed of a first sub-pixel for displaying a first color, a second sub-pixel for displaying a second color and a third sub-pixel for displaying a third color are laid out in a first direction and a second direction to form a 2-dimensional matrix;

at least each specific pixel and an adjacent pixel adjacent to the specific pixel in the first direction are used as a first pixel and a second pixel respectively to create one of pixel groups; and a fourth sub-pixel for displaying a fourth color is placed between the first and second pixels in each of the pixel groups; and (B): a signal processing section configured to generate a first sub-pixel output signal, a second sub-pixel output signal and a third sub-pixel output signal for respectively the first, second and third sub-pixels pertaining to the first pixel included in each specific one of the pixel groups on the basis of respectively a first sub-pixel input signal, a second sub-pixel input signal and a third sub-pixel input signal which are received for respectively the first, second and third sub-pixels pertaining to the first pixel and to generate a first sub-pixel output signal, a second sub-pixel output signal and a third sub-pixel output signal for respectively the first, second and third sub-pixels pertaining to the second pixel included in the specific pixel group on the basis of respectively a first sub-pixel input signal, a second sub-pixel input signal and a third sub-pixel input signal which are received for respectively the first, second and third sub-pixels pertaining to the second pixel.

In addition, a method for driving an image display apparatus assembly for solving the problems of the invention is a method for driving an image display apparatus assembly which employs:

an image display apparatus driven by the method for driving an image display apparatus provided in accordance with the first mode of the present invention in order to solve the problems; and a planar light-source apparatus for radiating illumination light to the rear face of the image display apparatus.

On top of that, in accordance with a method for driving the image display apparatus according to the first mode of the present invention and in accordance with a method for driving the image display apparatus assembly including the image display apparatus, the signal processing section finds a fourth sub-pixel output signal on the basis of a first sub-pixel input signal, a second sub-pixel input signal and a third sub-pixel input signal, which are received for respectively the first, second and third sub-pixels pertaining to the first pixel included in every pixel group, and on the basis of a first sub-pixel input signal, a second sub-pixel input signal and a third sub-pixel input signal, which are received for respectively the first, second and third sub-pixels pertaining to the second pixel included in the pixel group, outputting the fourth sub-pixel output signal to an image display panel driving circuit.

In addition, on an image display panel provided by an embodiment of the present invention in order to solve the problems described above:

pixels each composed of a first sub-pixel for displaying a first color, a second sub-pixel for displaying a second color and a third sub-pixel for displaying a third color are laid out in a first direction and a second direction to form a 2-dimensional matrix;

each specific pixel and an adjacent pixel adjacent to the specific pixel in the first direction are used as a first pixel and a second pixel respectively to create one of pixel groups; and a fourth sub-pixel for displaying a fourth color is placed between the first and second pixels in each of the pixel groups.

On top of that, an image display apparatus assembly provided by an embodiment of the present invention in order to solve the problems employs:

an image display apparatus including an image display panel and a signal processing section according to the embodiment of the present invention described above; and a planar light-source apparatus configured to radiate illumination light to the rear face of the image display apparatus.

In addition, for every pixel group, the signal processing section generates:

a first sub-pixel output signal, a second sub-pixel output signal and a third sub-pixel output signal for the first pixel of the pixel group on the basis respectively of a first sub-pixel input signal, a second sub-pixel input signal and a third sub-pixel input signal, which are supplied for the first pixel;

a first sub-pixel output signal, a second sub-pixel output signal and a third sub-pixel output signal for the second pixel of the pixel group on the basis of respectively a first sub-pixel input signal, a second sub-pixel input signal and a third sub-pixel input signal, which are supplied for the second pixel and;

a fourth sub-pixel output signal on the basis of the first sub-pixel input signal, the second sub-pixel input signal and the third sub-pixel input signal, which are supplied for the first pixel, and on the basis of the first sub-pixel input signal, the second sub-pixel input signal and the third sub-pixel input signal, which are supplied for the second pixel.

A method for driving an image display apparatus provided in accordance with a second mode of the present invention in order to solve the problems described above is a method for driving an image display apparatus having:

(A): an image display panel including a plurality of pixel groups each composed of a first pixel including a first sub-pixel for displaying a first color, a second sub-pixel for displaying a second color and a third sub-pixel for displaying a third color and composed of a second pixel including a first sub-pixel for displaying the first color, a second sub-pixel for displaying the second color and a fourth sub-pixel for displaying a fourth color; and (B): a signal processing section configured to generate a first sub-pixel output signal, a second sub-pixel output signal and a third sub-pixel output signal for respectively the first, second and third sub-pixels pertaining to the first pixel included in each specific one of the pixel groups on the basis of respectively a first sub-pixel input signal, a second sub-pixel input signal and a third sub-pixel input signal which are received for respectively the first, second and third sub-pixels pertaining to the first pixel and to generate a first sub-pixel output signal and a second sub-pixel output signal for respectively the first, and second sub-pixels pertaining to the second pixel included in the specific pixel group on the basis of respectively a first sub-pixel input signal and a second sub-pixel input signal which are received for respectively the first and second sub-pixels pertaining to the second pixel.

In addition, the signal processing section also finds a fourth sub-pixel output signal on the basis of a first sub-pixel input signal, a second sub-pixel input signal and a third sub-pixel input signal, which are supplied for the first pixel of every pixel group, and on the basis of a first sub-pixel input signal, a second sub-pixel input signal and a third sub-pixel input signal, which are supplied for the second pixel of the pixel group, outputting the fourth sub-pixel output signal to an image display panel driving circuit.

In accordance with the method for driving the image display apparatus according to the first or second mode of the present invention and in accordance with the method for driving the image display apparatus assembly including the image display apparatus, the signal processing section finds a fourth sub-pixel output signal on the basis of a first sub-pixel input signal, a second sub-pixel input signal and a third sub-pixel input signal, which are supplied for the first pixel of every pixel group, and on the basis of a first sub-pixel input signal, a second sub-pixel input signal and a third sub-pixel input signal, which are supplied for the second pixel of the pixel group, outputting the fourth sub-pixel output signal to an image display panel driving circuit.

That is to say, since the signal processing section finds a fourth sub-pixel output signal on the basis of sub-pixel input signals supplied to the first and second pixels adjacent to each other, the fourth sub-pixel output signal generated for the fourth sub-pixel is optimized.

In addition, in accordance with the method for driving the image display apparatus according to the first or second mode of the present invention, in accordance with the method for driving the image display apparatus assembly including the image display apparatus and in accordance with the image display panel employed in the image display apparatus, for every pixel group composed of at least first and second pixels, a fourth sub-pixel is provided. Thus, it is possible to as effectively prevent the area of an aperture in each sub-pixel from decreasing as possible. It is therefore possible to increase the luminance with a high degree of reliability. As a result, the quality of the displayed image can be improved and, in addition, the power consumption of the backlight can be reduced.

BRIEF DESCRIPTION OF THE DRAWINGS

These and other innovations as well features of the present invention will become clear from the following description of the preferred embodiments given with reference to the accompanying diagrams, in which:

FIG. 7A is a conceptual diagram showing a general cylindrical HSV color space whereas

FIG. 7C is a conceptual diagram showing an enlarged cylindrical HSV color space in a fourth embodiment of the present invention whereas

DETAILED DESCRIPTION OF THE PREFERRED EMBODIMENTS

Figure 1:
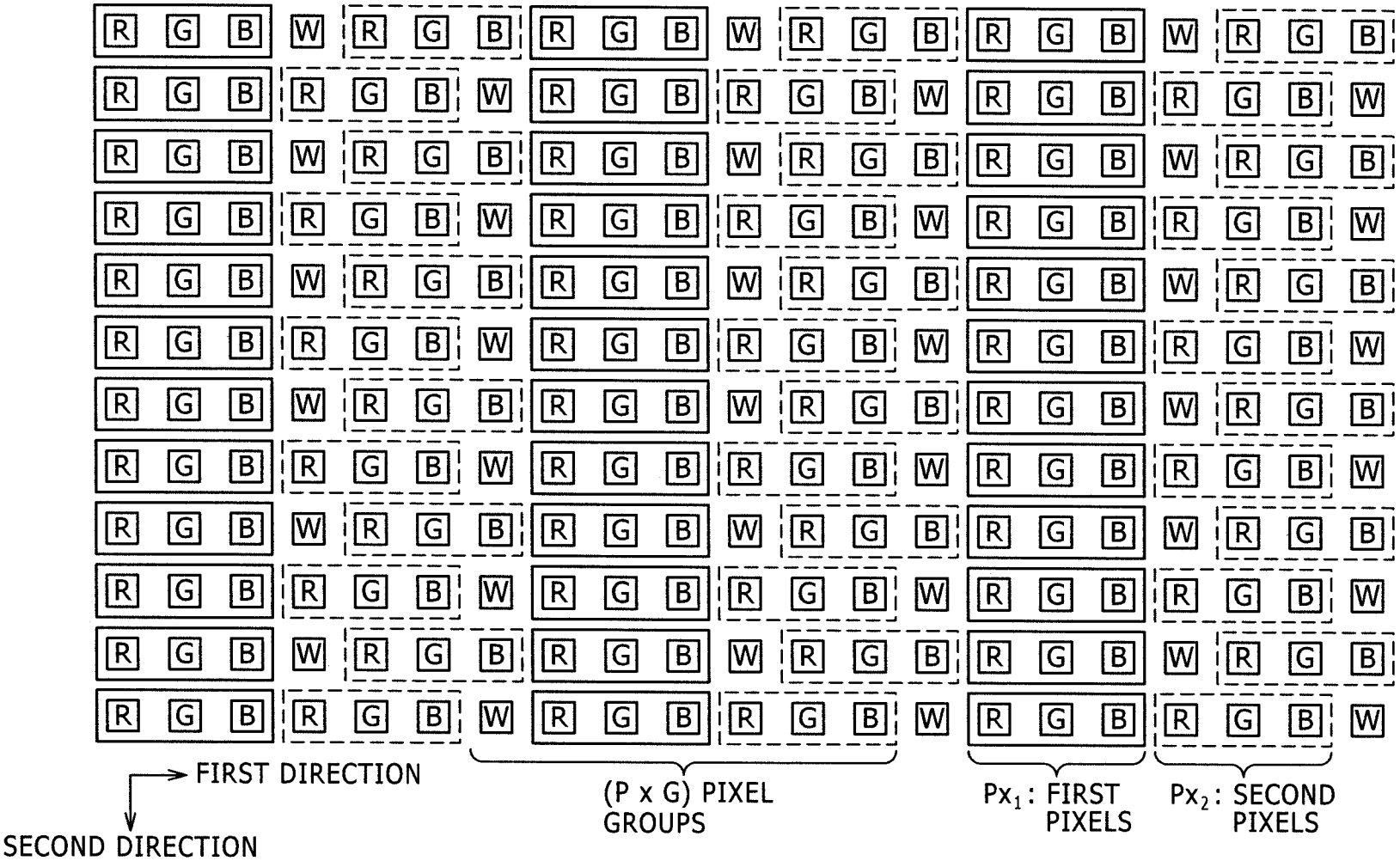
FIG. 1 is a model diagram showing the locations of pixels and pixel groups in an image display panel according to a first embodiment of the present invention.

Preferred embodiments of the present invention are explained below by referring to diagrams. However, implementations of the present invention are by no means limited to the preferred embodiments. The preferred embodiments make use of a variety of typical numerical values and a variety of typical materials. It is to be noted that the present invention is explained below in chapters which are arranged as follows:

1: General explanation of an image display panel provided by embodiments of the present invention, a method for driving an image display apparatus according to a first or second mode of the present invention, an image display apparatus assembly and a method for driving the image display apparatus assembly 2: First Embodiment (The image display panel provided by embodiments of the present invention, the method for driving the image display apparatus according to the first mode of the present invention, the image display apparatus assembly, the method for driving the image display apparatus assembly, a (1-A)th mode, a (1-A-1)th mode and a first configuration)

3: Second Embodiment (A modified version of the first embodiment)

4: Third Embodiment (Another modified version of the first embodiment)

5: Fourth Embodiment (A further modified version of the first embodiment, a (1-A-2)th mode and a second configuration)

6: Fifth Embodiment (A modified version of the fourth embodiment)

7: Sixth Embodiment (Another modified version of the fourth embodiment)

8: Seventh Embodiment (A still further modified version of the first embodiment and a (1-B)th mode)

9: Eighth Embodiment (The method for driving the image display apparatus according to the second mode of the present invention)

10: Ninth Embodiment (A modified version of the eighth embodiment)

11: Tenth Embodiment (Another modified version of the eighth embodiment and others)

General explanation of an image display panel provided by the present invention, a method for driving an image display apparatus according to a first or second mode of the present invention, an image display apparatus assembly and a method for driving the image display apparatus assembly.

In accordance with the method for driving the image display apparatus according to the first mode of the present invention or in accordance with the method for driving the image display apparatus assembly including the image display apparatus, with regard to a first pixel pertaining to a (p, q)th pixel group, the signal processing section receives the following sub-pixel input signals:

a first sub-pixel input signal provided with a first sub-pixel input-signal value $x_{1-(p1,q)}$;

a second sub-pixel input signal provided with a second sub-pixel input-signal value $x_{2-(p1,q)}$; and a third sub-pixel input signal provided with a third sub-pixel input-signal value $X_{3-(p1,q)}$.

With regard to a second pixel pertaining to the (p, q)th pixel group, on the other hand, the signal processing section receives the following sub-pixel input signals:

a first sub-pixel input signal provided with a first sub-pixel input-signal value $x_{1-(p2,q)}$;

a second sub-pixel input signal provided with a second sub-pixel input-signal value $X_{2-(p2,q)}$; and a third sub-pixel input signal provided with a third sub-pixel input-signal value $X_{3-(p2,q)}$.

With regard to the first pixel pertaining to the (p, q)th pixel group, the signal processing section generates the following sub-pixel output signals:

a first sub-pixel output signal provided with a first sub-pixel output-signal value $X_{1-(p1,q)}$ and used for determining the display gradation of a first sub-pixel of the first pixel;

a second sub-pixel output signal provided with a second sub-pixel output-signal value $X_{2-(p1,q)}$ and used for determining the display gradation of a second sub-pixel of the first pixel; and a third sub-pixel output signal provided with a third sub-pixel output-signal value $X_{3-(p1,q)}$ and used for determining the display gradation of a third sub-pixel of the first pixel.

With regard to the second pixel pertaining to the (p, q)th pixel group, the signal processing section generates the following sub-pixel output signals:

a first sub-pixel output signal provided with a first sub-pixel output-signal value $X_{1-(p2,q)}$ and used for determining the display gradation of a first sub-pixel of the second pixel;

a second sub-pixel output signal provided with a second sub-pixel output-signal value $X_{2-(p2,q)}$ and used for determining the display gradation of a second sub-pixel of the second pixel; and a third sub-pixel output signal provided with a third sub-pixel output-signal value $X_{3-(p2,q)}$ and used for determining the display gradation of a third sub-pixel of the second pixel.

With regard to a fourth sub-pixel pertaining to the (p, q)th pixel group, the signal processing section generates a fourth sub-pixel output signal provided with a fourth sub-pixel output-signal value $X_{4-(p,q)}$ and used for determining the display gradation of the fourth sub-pixel.

In the above description, notation p is a positive integer satisfying a relation $1 \le p \le P$, notation q is a positive integer satisfying a relation $1 \le q \le Q$, notation $p_1$ is a positive integer satisfying a relation $1 \le p_1 \le P$, notation $q_1$ is a positive integer satisfying a relation $1 \le q_1 \le Q$, notation $P_2$ is a positive integer satisfying a relation $1 \le p_2 \le P$, notation $q_2$ is a positive integer satisfying a relation $1 \le q_2 \le Q$, notation P is a positive integer representing the number of pixel groups laid out in the first direction and notation Q is a positive integer representing the number of pixel groups laid out in the second direction.

In accordance with the method for driving the image display apparatus according to the second mode of the present invention or in accordance with the method for driving the image display apparatus assembly including the image display apparatus, the signal processing section receives the same sub-pixel input signals and generates the same sub-pixel output signals as the signal processing section does in accordance with the method for driving the image display apparatus according to the first mode of the present invention or in accordance with the method for driving the image display apparatus assembly including the image display apparatus. It is to be noted however that, in accordance with the method for driving the image display apparatus according to the second mode of the present invention or in accordance with the method for driving the image display apparatus assembly including the image display apparatus, the signal processing apparatus does not generate the third sub-pixel output signal for the third sub-pixel included in the second pixel pertaining to the (p, q)th pixel group.

In addition, it is desirable to provide the configuration described above as a configuration according to the first mode of the present invention with a version in which the signal processing section finds a fourth sub-pixel output signal on the basis of a first signal value found from a first sub-pixel input signal, a second sub-pixel input signal and a third sub-pixel input signal which are received for respectively the first, second and third sub-pixels pertaining to the first pixel included in every specific one of the pixel groups and on the basis of a second signal value found from a first sub-pixel input signal, a second sub-pixel input signal and a third sub-pixel input signal which are received for respectively the first, second and third sub-pixels pertaining to the second pixel included in the specific pixel group, outputting the fourth sub-pixel output signal to an image display panel driving circuit. In the following description, the version is also referred to as the (1-A)th mode of the present invention for the sake of convenience.

On top of that, by the same token, it is also desirable to provide a configuration according to the second mode of the present invention with a version similar to the version of the configuration according to the first mode. In the following description, the version of the configuration according to the second mode is also referred to as the (2-A)th mode of the present invention for the sake of convenience.

In addition, it is desirable to provide the configuration described above as a configuration according to the first mode of the present invention with another version in which the signal processing section:

finds a first sub-pixel mixed input signal on the basis of first sub-pixel input signals received for respectively the first sub-pixels pertaining to respectively the first and second pixels included in each specific one of the pixel groups;

finds a second sub-pixel mixed input signal on the basis of second sub-pixel input signals received for respectively the second sub-pixels pertaining to respectively the first and second pixels included in the specific pixel group;

finds a third sub-pixel mixed input signal on the basis of third sub-pixel input signals received for respectively the third sub-pixels pertaining to respectively the first and second pixels included in the specific pixel group;

finds a fourth sub-pixel output signal on the basis of the first sub-pixel mixed input signal, the second sub-pixel mixed input signal and the third sub-pixel mixed input signal;

finds first sub-pixel output signals for respectively the first sub-pixels pertaining to respectively the first and second pixels included in the specific pixel group on the basis of the first sub-pixel mixed input signal and on the basis of the first sub-pixel input signals received for respectively the first sub-pixels pertaining to respectively the first and second pixels included in the specific pixel group;

finds second sub-pixel output signals for respectively the second sub-pixels pertaining to respectively the first and second pixels included in the specific pixel group on the basis of the second sub-pixel mixed input signal and on the basis of the second sub-pixel input signals received for respectively the second sub-pixels pertaining to respectively the first and second pixels included in the specific pixel group;

finds third sub-pixel output signals for respectively the third sub-pixels pertaining to respectively the first and second pixels included in the specific pixel group on the basis of the third sub-pixel mixed input signal and on the basis of the third sub-pixel input signals received for respectively the third sub-pixels pertaining to respectively the first and second pixels included in the specific pixel group; and outputs the fourth sub-pixel output signal, the first sub-pixel output signals for respectively the first sub-pixels pertaining to respectively the first and second pixels included in the specific pixel group, the second sub-pixel output signals for respectively the second sub-pixels pertaining to respectively the first and second pixels included in the specific pixel group and the third sub-pixel output signals for respectively the third sub-pixels pertaining to respectively the first and second pixels included in the specific pixel group.

In the following description, this other version is also referred to as the (1-B)th mode of the present invention for the sake of convenience.

It is to be noted that the method for driving the image display apparatus according to the second mode of the present invention can also be provided with another version similar to the other version described above. In the case of the other version described above, the signal processing section finds third sub-pixel output signals for respectively the third sub-pixels pertaining to respectively the first and second pixels included in the specific pixel group on the basis of the third sub-pixel mixed input signal and on the basis of the third sub-pixel input signals received for respectively the third sub-pixels pertaining to respectively the first and second pixels included in the specific pixel group. In the case of the other version of the method for driving the image display apparatus according to the second mode of the present invention, on the other hand, the signal processing section finds only a third sub-pixel output signal for the third sub-pixel pertaining to the first pixel included in the specific pixel group on the basis of the third sub-pixel mixed input signal. In the following description, the other version of the method for driving the image display apparatus according to the second mode of the present invention is also referred to as the (2-B)th mode of the present invention for the sake of convenience.

In addition, it is possible to provide the method for driving the image display apparatus according to the second mode of the present invention with a further version in which the signal processing section finds a third sub-pixel output signal on the basis of third sub-pixel input signals received for respectively the third sub-pixels pertaining to respectively the first and second pixels included in the specific pixel group, outputting the third sub-pixel output signal to an image display panel driving circuit. Thus, the second mode of the present invention includes this further version, the (2-A)th mode and the (2-B)th mode. In accordance with the method for driving the image display apparatus according to the second mode of the present invention:

(P×Q) pixel groups are laid out to form a 2-dimensional matrix in which P pixel groups are laid out in a first direction to form an array and Q such arrays are laid out in a second direction;

each of the pixel groups includes a first pixel and a second pixel adjacent to the first pixel in the second direction; and it is possible to provide a configuration in which the first pixel of any specific pixel group is adjacent to the first pixel of another pixel group adjacent to the specific pixel group in the first direction.

This configuration is also referred to as the (2a)th mode of the present invention for the sake of convenience.

As an alternative, in accordance with the method for driving the image display apparatus according to the second mode of the present invention:

(P×Q) pixel groups are laid out to form a 2-dimensional matrix in which P pixel groups are laid out in a first direction to form an array and Q such arrays are laid out in a second direction;

each of the pixel groups includes a first pixel and a second pixel adjacent to the first pixel in the second direction; and it is possible to provide a configuration in which the first pixel of any specific pixel group is adjacent to the second pixel of another pixel group adjacent to the specific pixel group in the first direction.

This configuration is also referred to as the (2b)th mode of the present invention for the sake of convenience.

It is to be noted that operations to drive an image display apparatus adopting the method for driving the image display apparatus according to the second mode, which includes the further version explained earlier, the (2-A)th mode and the (2-B)th mode, and to drive an image display apparatus assembly employing the image display apparatus and a planar light-source apparatus for radiating illumination light to the rear face of the image display apparatus can be carried out on the basis of the method for driving the image display apparatus according to the second mode which includes the further version explained earlier, the (2-A)th mode and the (2-B)th mode. In addition, it is possible to obtain an image display apparatus based on the configuration according to the (2a)th mode and an image display apparatus assembly employing the image display apparatus based on the configuration according to the (2a)th mode and a planar light-source apparatus for radiating illumination light to the rear face of the image display apparatus.

In addition, in accordance with the (1-A)th and (2-A)th modes, it is possible to provide a configuration for determining a first signal value $SG_{(p,\ q)-1}$ on the basis of a first minimum value $Min_{(p,\ q)-1}$ and determining a second signal value $SG_{(p,\ q)-2}$ on the basis of a second minimum value $Min_{(p,\ q)-2}$. It is to be noted that, in the following description, this configuration provided in accordance with the (1-A)th mode is also referred to as a (1-A-1)th mode whereas the configuration provided in accordance with the (2-A)th mode is also referred to as a (2-A-1)th mode.

In the above description, the first minimum value $Min_{(p,\ q)-1}$ is the smallest among the sub-pixel input-signal values $x_{1-(p1,\ q)}$, $x_{2-(p1,\ q)}$ and $x_{3-(p1,\ q)}$ whereas the second minimum value $Min_{(p,\ q)-2}$ is the smallest value among the sub-pixel input-signal values $x_{1-(p2,q)}$, $x_{2-(p2,q)}$ and $X_{3-(p2,q)}$. To put it more concretely, the first signal value $SG_{(p,\ q)-1}$ and the second signal value $SG_{(p,\ q)-2}$ can be expressed by equations given below. In the equations given below, each of notations $c_{11}$ and $c_{12}$ denotes a constant.

By the way, there is still a question as to what value is to be used as the fourth sub-pixel output-signal value $X_{4-(p,\ q)}$ or what equation is to be used to express the fourth sub-pixel output-signal value $X_{4-(p,\ q)}$. With regard to the fourth sub-pixel output-signal value $X_{4-(p,\ q)}$, the image display apparatus and/or the image display apparatus assembly employing the image display apparatus are prototyped and, typically, an image observer evaluates the image displayed by the image display apparatus and/or the image display apparatus assembly. Finally, the image observer properly determines a value to be used as the fourth sub-pixel output-signal value $X_{4-(p,\ q)}$ or an equation to be used to express the fourth sub-pixel output-signal value $X_{4-(p,\ q)}$.

Equations for expressing the first signal value $SG_{(p,\ q)-1}$ and the second signal value $SG_{(p,\ q)-2}$ are given as follows.

$$SG_{(p,q)-1}=c_{11}[Min_{(p,q)-1}]$$

$$SG_{(p,q)-2}=c_{11}[Min_{(p,q)-2}]$$

or $$SG_{(p,q)-1}=c_{12}[Min_{(p,q)-1}]^2$$

$$SG_{(p,q)-2}=c_{12}[Min_{(p,q)-2}]^2$$

As an alternative, the first signal value $SG_{(p,\ q)-1}$ and the second signal value $SG_{(p,\ q)-2}$ are expressed by equations given below. In the equations given below, each of notations $c_{13}$, $c_{14}$, $c_{15}$ and $c_{16}$ denotes a constant.

$$SG_{(p,q)-1}=c_{13}[Max_{(p,q)-1}]^{1/2}$$

$$SG_{(p,q)-2}=c_{13}[Max_{(p,q)-2}]^{1/2}$$

or $$SG_{(p,q)-1}=c_{14}\{[Min_{(p,q)-1}/Max_{(p,q)-1}] \text{ or } (2^n-1)\}$$

$$SG_{(p,q)-2}=c_{14}\{[Min_{(p,q)-2}/Max_{(p,q)-2}] \text{ or } (2^n-1)\}$$

As another alternative, the first signal value $SG_{(p,\ q)-1}$ and the second signal value $SG_{(p,\ q)-2}$ are expressed by equations given below.

$$SG_{(p,q)-1}=c_{15}(\{(2^n-1)\cdot Min_{(p,q)-1}/[Max_{(p,q)-1}-Min_{(p,q)-1}]\} \text{ or } (2^n-1))$$

$$SG_{(p,q)-2}=c_{15}(\{(2^n-1)\cdot Min_{(p,q)-2}/[Max_{(p,q)-2}-Min_{(p,q)-2}]\} \text{ or } (2^n-1))$$

As a further alternative, the first signal value $SG_{(p,\ q)-1}$ and the second signal value $SG_{(p,\ q)-2}$ are expressed by equations given below.

$$SG_{(p,q)-1}=\text{The smaller one of } c_{16}\cdot[Max_{(p,q)-1}]^{1/2} \text{ and } c_{16}\cdot Min_{(p,q)-1}$$

$$SG_{(p,q)-2}=\text{The smaller one of } c_{16}\cdot[Max_{(p,q)-2}]^{1/2} \text{ and } c_{16}\cdot Min_{(p,q)-2}$$

As a still further alternative, in the case of the (1-A)th and (2-A)th modes, it is possible to provide a configuration in which the first signal value $SG_{(p,\ q)-1}$ is determined on the basis of a saturation $S_{(p,\ q)-1}$ in an HSV color space, a brightness/lightness value $V_{(p,\ q)-1}$ in the HSV color space and a constant $\chi$ which is dependent on the image display apparatus. By the same token, in this configuration, the second signal value $SG_{(p,\ q)-2}$ is determined on the basis of a saturation $S_{(p,\ q)-2}$ in the HSV color space, a brightness/lightness value $V_{(p,\ q)-2}$ in the HSV color space and the constant $\chi$. It is to be noted that, in the following description, for the sake of convenience, this configuration for the (1-A)th mode is also referred to as a (1-A-2)th mode whereas this configuration for the (2-A)th mode is also referred to as a (2-A-2)th mode. In this case, the saturation $S_{(p,\ q)-1}$, the saturation $S_{(p,\ q)-2}$, the brightness/lightness value $V_{(p,\ q)-1}$ and the brightness/lightness value $V_{(p,\ q)-2}$ are expressed by the following equations:

$$S_{(p,q)-1}=(Max_{(p,q)-1}-Min_{(p,q)-1})/Max_{(p,q)-1}$$

$$V_{(p,q)-1}=Max_{(p,q)-1}$$

$$S_{(p,q)-2}=(Max_{(p,q)-2}-Min_{(p,q)-2})/Max_{(p,q)-2}$$

$$V_{(p,q)-2}=Max_{(p,q)-2}$$

In the above equations:

notation $Max_{(p, q)-1}$ denotes the largest value among the three sub-pixel input-signal values $x_{1-(p1, q)}$, $X_{2-(p1, q)}$ and $X_{3-(p1, q)}$;

notation $Min_{(p, q)-1}$ denotes the smallest value among the three sub-pixel input-signal values $x_{1-(p1, q)}$, $x_{2-(p1, q)}$ and $x_{3-(p1, q)}$;

notation $Max_{(p, q)-2}$ denotes the largest value among the three sub-pixel input-signal values $x_{1-(p2, q)}$, $x_{2-(p2, q)}$ and $x_{3-(p2, q)}$; and notation $Min_{(p, q)-2}$ denotes the smallest value among the three sub-pixel input-signal values $x_{1-(p2, q)}$, $x_{2-(p2, q)}$ and $x_{3-(p2, q)}$.

The saturation S can have a value in the range 0 to 1 whereas the brightness/lightness value V is a value in the range 0 to $(2^n-1)$ where notation n is a positive integer representing the number of gradation bits. It is to be noted that, in the technical term 'HSV space' used above, notation H denotes a color phase (or a hue) which indicates the type of the color, notation S denotes a saturation (or a chromaticity) which indicates the vividness of the color whereas notation V denotes a brightness/lightness value which indicates the brightness of the color.

In the case of the (1-A-1)th mode, it is possible to provide a configuration in which the values of sub-pixel output signals are found as follows:

A first sub-pixel output-signal value $X_{1-(p1, q)}$ is found on the basis of at least the first sub-pixel input-signal value $x_{1-(p1, q)}$, the first maximum value $Max_{(p, q)-1}$, the first minimum value $Min_{(p, q)-1}$ and the first signal value $SG_{(p, q)-1}$.

A second sub-pixel output-signal value $X_{2-(p1, q)}$ is found on the basis of at least the second sub-pixel input-signal value $X_{2-(p1, q)}$, the first maximum value $Max_{(p, q)-1}$, the first minimum value $Min_{(p, q)-1}$ and the first signal value $SG_{(p, q)-1}$.

A third sub-pixel output-signal value $X_{3-(p1, q)}$ is found on the basis of at least the third sub-pixel input-signal value $x_{3-(p1, q)}$, the first maximum value $Max_{(p, q)-1}$, the first minimum value $Min_{(p, q)-1}$ and the first signal value $SG_{(p, q)-1}$.

A first sub-pixel output-signal value $X_{1-(p2, q)}$ is found on the basis of at least the first sub-pixel input-signal value $x_{1-(p2, q)}$, the second maximum value $Max_{(p, q)-2}$, the second minimum value $Min_{(p, q)-2}$ and the second signal value $SG_{(p, q)-2}$.

A second sub-pixel output-signal value $X_{2-(p2, q)}$ is found on the basis of at least the second sub-pixel input-signal value $x_{2-(p2, q)}$, the second maximum value $Max_{(p, q)-2}$, the second minimum value $Min_{(p, q)-2}$ and the second signal value $SG_{(p, q)-2}$.

A third sub-pixel output-signal value $X_{3-(p2, q)}$ is found on the basis of at least the third sub-pixel input-signal value $x_{3-(p2, q)}$, the second maximum value $Max_{(p, q)-2}$, the second minimum value $Min_{(p, q)-2}$ and the second signal value $SG_{(p, q)-2}$.

By the same token, in the case of the (2-A-1)th mode, it is possible to provide a configuration in which the values of sub-pixel output signals are found as follows:

A first sub-pixel output-signal value $X_{1-(p1, q)}$ is found on the basis of at least the first sub-pixel input-signal value $x_{1-(p1, q)}$, the first maximum value $Max_{(p, q)-1}$, the first minimum value $Min_{(p, q)-1}$ and the first signal value $SG_{(p, q)-1}$.

A second sub-pixel output-signal value $X_{2-(p1, q)}$ is found on the basis of at least the second sub-pixel input-signal value $x_{2-(p1, q)}$, the first maximum value $Max_{(p, q)-1}$, the first minimum value $Min_{(p, q)-1}$ and the first signal value $SG_{(p, q)-1}$.

A first sub-pixel output-signal value $X_{1-(p2, q)}$ is found on the basis of at least the first sub-pixel input-signal value $x_{1-(p2, q)}$, the second maximum value $Max_{(p, q)-2}$, the second minimum value $Min_{(p, q)-2}$ and the second signal value $SG_{(p, q)-2}$.

A second sub-pixel output-signal value $X_{2-(p2, q)}$ is found on the basis of at least the second sub-pixel input-signal value $x_{2-(p2, q)}$, the second maximum value $Max_{(p, q)-2}$, the second minimum value $Min_{(p, q)-2}$ and the second signal value $SG_{(p, q)-2}$.

It is to be noted that, in the following description, each of the above configurations is also referred to as a first configuration for the sake of convenience. In the above description of the first configurations, notation $Max_{(p, q)-1}$ denotes the largest value among the sub-pixel input-signal values $x_{1-(p1, q)}$, $x_{2-(p1, q)}$ and $x_{3-(p1, q)}$ whereas notation $Max_{(p, q)-2}$ denotes the largest value among the sub-pixel input-signal values $x_{1-(p2, q)}$, $x_{2-(p2, q)}$ and $x_{3-(p2, q)}$.

As described above, the first sub-pixel output-signal value $X_{1-(p1, q)}$ is found on the basis of at least the first sub-pixel input-signal value $x_{1-(p1, q)}$, the first maximum value $Max_{(p, q)-1}$, the first minimum value $Min_{(p, q)-1}$ and the first signal value $SG_{(p, q)-1}$. However, the first sub-pixel output-signal value $X_{1-(p1, q)}$ can also be found on the basis of $[x_{1-(p1, q)}, Max_{(p q)-1}, Min_{(p, q)-1}, SG_{(p, q)-1}]$ or on the basis of $[x_{1-(p1, q)}, x_{1-(p2, q)}, Max_{(p, q)-1}, Min_{(p, q)-1}, SG_{(p, q)-1}]$.

By the same token, the second sub-pixel output-signal value $X_{2-(p1, q)}$ is found on the basis of at least the second sub-pixel input-signal value $x_{2-(p1, q)}$ the first maximum value $Max_{(p, q)-1}$, the first minimum value $Min_{(p, q)-1}$ and the first signal value $SG_{(p, q)-1}$. However, the second sub-pixel output-signal value $X_{2-(p1, q)}$ can also be found on the basis of $[x_{2-(p1, q)}, Max_{(p, q)-1}, Min_{(p, q)-1}, SG_{(p, q)-1}]$ or on the basis of $[x_{2-(p1, q)}, x_{2-(p2,q)}, Max_{(p, q)-1}, Min_{(p, q)-1}, SG_{(p, q)-1}]$.

In the same way, the third sub-pixel output-signal value $X_{3-(p1, q)}$ is found on the basis of at least the third sub-pixel input-signal value $x_{3-(p1, q)}$, the first maximum value $Max_{(p, q)-1}$, the first minimum value $Min_{(p, q)-1}$ and the first signal value $SG_{(p, q)-1}$. However, the third sub-pixel output-signal value $X_{3-(p1, q)}$ can also be found on the basis of $[x_{3-(p1, q)}, Max_{(p, q)-1}, Min_{(p, q)-1}, SG_{(p, q)-1}]$ or on the basis of $[x_{3-(p1, q)}, x_{3-(p2, q)}, Max_{(p q)-1}, Min_{(p, q)-1}, SG_{(p, q)-1}]$. The first sub-pixel output-signal value $X_{1-(p2, q)}$, the second sub-pixel output-signal value $X_{2-(p2, q)}$ and the third sub-pixel output-signal value $X_{3-(p2, q)}$ can be found in the same way as the first sub-pixel output-signal value $X_{1-(p1, q)}$, the second sub-pixel output-signal value $X_{2-(p1, q)}$ and the third sub-pixel output-signal value $X_{3-(p1, q)}$ respectively.

In addition, in the case of the first configurations described above, the fourth sub-pixel output-signal value $X_{4-(p, q)}$ is set at an average value which is found from a sum of the first signal value $SG_{(p, q)-1}$ and the second signal value $SG_{(p, q)-2}$ in accordance with the following equation:

$$X_{4-(p,q)}=(SG_{(p,q)-1}+SG_{(p,q)-2})/2 \quad \text{(1-A)}$$

As an alternative, in the case of the first configurations described above, the fourth sub-pixel output-signal value $X_{4-(p, q)}$ can be found in accordance with the following equation:

$$X_{4-(p,q)}=C_1 \cdot SG_{(p,q)-1}+C_2 \cdot SG_{(p,q)-2} \quad \text{(1-B)}$$

In Eq. (1-B) given above, each of notations $C_1$ and $C_2$ denotes a constant and the fourth sub-pixel output-signal value $X_{4-(p, q)}$ satisfies a relation $X_{4-(p, q)} \leq (2^n-1)$. For $(C_1 \cdot SG_{(p, q)-1}+C_2 \cdot SG_{(p, q)-2}) > (2^n-1)$, the fourth sub-pixel output-signal value $X_{4-(p, q)}$ is set at $(2^n-1)$.

As another alternative, in the case of the first configurations described above, the fourth sub-pixel output-signal value $X_{4-(p,q)}$ is found in accordance with the following equation:

$$X_{4-(p,q)}=[(SG_{(p,q)-1}^2+SG_{(p,q)-2}^2)/2]^{1/2} \quad (1\text{-C})$$

It is to be noted that one of Eqs. (1-A), (1-B) and (1-C) can be selected in accordance with the value of the first signal value $SG_{(p,q)-1}$, in accordance with the value of the second signal value $SG_{(p,q)-2}$ or in accordance with the values of both the first signal value $SG_{(p,q)-1}$ and the second signal value $SG_{(p,q)-2}$. That is to say, in every pixel group, one of Eqs. (1-A), (1-B) and (1-C) can be determined to serve as a common equation shared by all pixel groups for finding the fourth sub-pixel output-signal value $X_{4-(p,q)}$ or one of Eqs. (1-A), (1-B) and (1-C) can be selected for every pixel group.

In the case of the (1-A-2)th mode described above, on the other hand, a maximum brightness/lightness value $V_{max}(S)$ expressed as a function of variable saturation S to serve as the maximum of a brightness/lightness value V in an HSV color space enlarged by adding the fourth color is stored in the signal processing section.

In addition, the signal processing section carries out the following processes of:

(a): finding the saturation S and the brightness/lightness value V(S) for each of a plurality of pixels on the basis of the signal values of sub-pixel input signals received for the pixels;

(b): finding an extension coefficient $\alpha_0$ on the basis of at least one of ratios $V_{max}(S)/V(S)$ found for the pixels;

(c1): finding the first signal value $SG_{(p,q)-1}$ on the basis of at least the sub-pixel input-signal values $x_{1-(p1,q)}$, $x_{2-(p1,q)}$ and $x_{3-(p1,q)}$;

(c2): finding the second signal value $SG_{(p,q)-2}$ on the basis of at least the sub-pixel input-signal values $x_{1-(p2,q)}$, $x_{2-(p2,q)}$ and $x_{3-(p2,q)}$;

(d1): finding the first sub-pixel output-signal value $X_{1-(p1,q)}$ on the basis of at least the first sub-pixel input-signal value $x_{1-(p1,q)}$, the extension coefficient $\alpha_0$ and the first signal value $SG_{(p,q)-1}$;

(d2): finding the second sub-pixel output-signal value $x_{2-(p1,q)}$ on the basis of at least the second sub-pixel input-signal value $x_{2-(p1,q)}$, the extension coefficient $\alpha_0$ and the first signal value $SG_{(p,q)-1}$;

(d3): finding the third sub-pixel output-signal value $X_{3-(p1,q)}$ on the basis of at least the third sub-pixel input-signal value $x_{3-(p1,q)}$, the extension coefficient $\alpha_0$ and the first signal value $SG_{(p,q)-1}$;

(d4): finding the first sub-pixel output-signal value $X_{1-(p2,q)}$ on the basis of at least the first sub-pixel input-signal value $x_{1-(p2,q)}$, the extension coefficient $\alpha_0$ and the second signal value $SG_{(p,q)-2}$;

(d5): finding the second sub-pixel output-signal value $X_{2-(p2,q)}$ on the basis of at least the second sub-pixel input-signal value $x_{2-(p2,q)}$, the extension coefficient $\alpha_0$ and the second signal value $SG_{(p,q)-2}$; and (d6): finding the third sub-pixel output-signal value $X_{3-(p2,q)}$ on the basis of at least the third sub-pixel input-signal value $x_{3-(p2,q)}$, the extension coefficient $\alpha_0$ and the second signal value $SG_{(p,q)-2}$.

In the case of the (2-A-2)th mode described above, on the other hand, a maximum brightness/lightness value $V_{max}(S)$ expressed as a function of variable saturation S to serve as the maximum of a brightness/lightness value V in an HSV color space enlarged by adding the fourth color is stored in the signal processing section.

In addition, the signal processing section carries out the following processes of:

(a): finding the saturation S and the brightness/lightness value V(S) for each of a plurality of pixels on the basis of the signal values of sub-pixel input signals received for the pixels;

(b): finding an extension coefficient $\alpha_0$ on the basis of at least one of ratios $V_{max}(S)/V(S)$ found for the pixels;

(c1): finding the first signal value $SG_{(p,q)-1}$ on the basis of at least the sub-pixel input-signal values $x_{1-(p1,q)}$, $x_{2-(p1,q)}$ and $x_{3-(p1,q)}$;

(c2): finding the second signal value $SG_{(p,q)-2}$ on the basis of at least the sub-pixel input-signal values $x_{1-(p2,q)}$, $x_{2-(p2,q)}$ and $x_{3-(p2,q)}$;

(d1): finding the first sub-pixel output-signal value $X_{1-(p1,q)}$ on the basis of at least the first sub-pixel input-signal value $x_{1-(p1,q)}$, the extension coefficient $\alpha_0$ and the first signal value $SG_{(p,q)-1}$;

(d2): finding the second sub-pixel output-signal value $X_{2-(p1,q)}$ on the basis of at least the second sub-pixel input-signal value $x_{2-(p1,q)}$, the extension coefficient $\alpha_0$ and the first signal value $SG_{(p,q)-1}$;

(d4): finding the first sub-pixel output-signal value $X_{1-(p2,q)}$ on the basis of at least the first sub-pixel input-signal value $x_{1-(p2,q)}$, the extension coefficient $\alpha_0$ and the second signal value $SG_{(p,q)-2}$; and (d5): finding the second sub-pixel output-signal value $X_{2-(p2,q)}$ on the basis of at least the second sub-pixel input-signal value $x_{2-(p2,q)}$, the extension coefficient $\alpha_0$ and the second signal value $SG_{(p,q)-2}$.

It is to be noted that, in the following description, each of the configuration described for the (1-A-2)th mode and the configuration described for the (2-A-2)th mode is also referred to as a second configuration for the sake of convenience.

As described above, the first signal value $SG_{(p,q)-1}$ is found on the basis of at least the sub-pixel input-signal values $x_{1-(p1,q)}$, $x_{2-(p1,q)}$ and $x_{3-(p1,q)}$ whereas the second signal value $SG_{(p,q)-2}$ is found on the basis of at least the sub-pixel input-signal values $x_{1-(p2,q)}$, $x_{2-(p2,q)}$ and $x_{3-(p2,q)}$. To put it more concretely, it is possible to provide a configuration in which the first signal value $SG_{(p,q)-1}$ is determined on the basis of the first minimum value $Min_{(p,q)-1}$ and the extension coefficient $\alpha_0$ whereas the second signal value $SG_{(p,q)-2}$ is determined on the basis of the second minimum value $Min_{(p,q)-2}$ and the extension coefficient $\alpha_0$. To put it even more concretely, the first signal value $SG_{(p,q)-1}$ and the second signal value $SG_{(p,q)-2}$ can be expressed by equations given below. In the equations given below, each of notations $c_{21}$ and $c_{22}$ denotes a constant.

By the way, there is still a question as to what value is to be used as the fourth sub-pixel output-signal value $X_{4-(p,q)}$ or what equation is to be used to express the fourth sub-pixel output-signal value $X_{4-(p,q)}$. With regard to the fourth sub-pixel output-signal value $X_{4-(p,q)}$, the image display apparatus and/or the image display apparatus assembly employing the image display apparatus are prototyped and, typically, an image observer evaluates the image displayed by the image display apparatus and/or the image display apparatus assembly. Finally, the image observer properly determines a value to be used as the fourth sub-pixel output-signal value $X_{4-(p,q)}$ or an equation to be used to express the fourth sub-pixel output-signal value $X_{4-(p,q)}$.

The aforementioned equations for expressing the first signal value $SG_{(p,q)-1}$ and the second signal value $SG_{(p,q)-2}$ are given as follows.

$$SG_{(p,q)-1}=c_{21}[\mathrm{Min}_{(p,q)-1}]\cdot\alpha_0$$

$$SG_{(p,q)-2}=c_{21}[\mathrm{Min}_{(p,q)-2}]\cdot\alpha_0$$

or $$SG_{(p,q)-1}=c_{22}[\mathrm{Min}_{(p,q)-1}]^2\cdot\alpha_0$$

$$SG_{(p,q)-2}=c_{22}[\mathrm{Min}_{(p,q)-2}]^2\cdot\alpha_0$$

As an alternative, the first signal value $SG_{(p,\ q)-1}$ and the second signal value $SG_{(p,\ q)-2}$ are expressed by other equations given below. In the other equations given below, each of notations $c_{23}$, $c_{24}$, $c_{25}$ and $c_{26}$ denotes a constant.

$$SG_{(p,q)-1}=c_{23}[\mathrm{Max}_{(p,q)-1}]^{1/2}\cdot\alpha_0$$

$$SG_{(p,q)-2}=c_{23}[\mathrm{Max}_{(p,q)-2}]^{1/2}\cdot\alpha_0$$

or $$SG_{(p,q)-1}=c_{24}\{\alpha_0\cdot[\mathrm{Min}_{(p,q)-1}/\mathrm{Max}_{(p,q)-1}] \text{ or } \alpha_0\cdot(2^n-1)\}$$

$$SG_{(p,q)-2}=c_{24}\{\alpha_0\cdot[\mathrm{Min}_{(p,q)-2}/\mathrm{Max}_{(p,q)-2}] \text{ or } \alpha_0\cdot(2^n-1)\}$$

As another alternative, the first signal value $SG_{(p,\ q)-1}$ and the second signal value $SG_{(p,\ q)-2}$ are expressed by equations given as follows.

$$SG_{(p,q)-1}=c_{25}(\alpha_0\cdot\{(2^n-1)\cdot\mathrm{Min}_{(p,q)-1}/[\mathrm{Max}_{(p,q)-1}-\mathrm{Min}_{(p,q)-1}]\}\text{or } \alpha_0\cdot(2^n-1))$$

$$SG_{(p,q)-2}=c_{25}(\alpha_0\cdot\{(2^n-1)\cdot\mathrm{Min}_{(p,q)-2}/[\mathrm{Max}_{(p,q)-2}-\mathrm{Min}_{(p,q)-2}]\}\text{or } \alpha_0\cdot(2^n-1))$$

As a further alternative, the first signal value $SG_{(p,\ q)-1}$ and the second signal value $SG_{(p,\ q)-2}$ are expressed by equations given as follows.

$SG_{(p,q)-1}$=The product of $\alpha_0$ and the smaller one of $c_{26}\cdot[\mathrm{Max}_{(p,q)-1}]^{1/2}$ and $c_{26}\cdot\mathrm{Min}_{(p,q)-1}$ $SG_{(p,q)-2}$=The product of $\alpha_0$ and the smaller one of $c_{26}\cdot[\mathrm{Max}_{(p,q)-2}]^{1/2}$ and $c_{26}\cdot\mathrm{Min}_{(p,q)-2}$ It is to be noted that the first sub-pixel output-signal value $X_{1-(p1,\ q)}$ is found on the basis of at least the first sub-pixel input-signal value $x_{1-(p1,\ q)}$, the extension coefficient $\alpha_0$ and the first signal value $SG_{(p,\ q)-1}$. However, the first sub-pixel output-signal value $X_{1-(p1,\ q)}$ can also be found on the basis of $[x_{1-(p1,\ q)}, \alpha_0, SG_{(p,\ q)-1}]$ or on the basis of $[x_{1-(p1,\ q)}, x_{-(p2,\ q)}, \alpha_0, SG_{(p,\ q)-1}]$.

By the same token, the second sub-pixel output-signal value $X_{2-(p1,\ q)}$ is found on the basis of at least the second sub-pixel input-signal value $x_{2-(p1,\ q)}$, the extension coefficient $\alpha_0$ and the first signal value $SG_{(p,\ q)-1}$. However, the second sub-pixel output-signal value $X_{2-(p1,\ q)}$ can also be found on the basis of $[x_{2-(p1,\ q)}, \alpha_0, SG_{(p,\ q)-1}]$ or on the basis of $[x_{2-(p1,\ q)}, x_{2-(p2,\ q)}, \alpha_0, SG_{(p,\ q)-1}]$.

In the same way, the third sub-pixel output-signal value $X_{3-(p1,\ q)}$ is found on the basis of at least the third sub-pixel input-signal value $x_{3-(p1,\ q)}$, the extension coefficient $\alpha_0$ and the first signal value $SG_{(p,\ q)-1}$. However, the third sub-pixel output-signal value $X_{3-(p1,\ q)}$ can also be found on the basis of $[x_{3-(p1,\ q)}, \alpha_0, SG_{(p,\ q)-1}]$ or on the basis of $[x_{3-(p1,\ q)}, x_{3-(p2,\ q)}, \alpha_0, SG_{(p,\ q)-1}]$.

The first sub-pixel output-signal value $X_{1-(p2,\ q)}$, the second sub-pixel output-signal value $X_{2-(p2,\ q)}$ and the third sub-pixel output-signal value $X_{3-(p2,\ q)}$ can be found in the same way as the first sub-pixel output-signal value $X_{1-(p1,\ q)}$, the second sub-pixel output-signal value $X_{2-(p1,\ q)}$ and the third sub-pixel output-signal value $X_{3-(p1,\ q)}$ respectively.

In addition, in the case of the second configurations described above, the fourth sub-pixel output-signal value $X_{4-(p,\ q)}$ is set at an average value which is found from a sum of the first signal value $SG_{(p,\ q)-1}$ and the second signal value $SG_{(p,\ q)-2}$ in accordance with the following equation:

$$X_{4-(p,q)}=(SG_{(p,q)-1}+SG_{(p,q)-2})/2 \tag{2-A}$$

As an alternative, in the case of the second configurations described above, the fourth sub-pixel output-signal value $X_{4-(p,\ q)}$ can be found in accordance with the following equation:

$$X_{4-(p,q)}=C_1\cdot SG_{(p,q)-1}+C_2\cdot SG_{(p,q)-2} \tag{2-B}$$

In Eq. (2-B) given above, each of notations $C_1$ and $C_2$ denotes a constant and the fourth sub-pixel output-signal value $X_{4-(p,\ q)}$ satisfies a relation $X_{4-(p,\ q)}\leq(2^n-1)$. For $(C_1\cdot SG_{(p,\ q)-1}+C_2\cdot SG_{(p,\ q)-2})>(2^n-1)$, the fourth sub-pixel output-signal value $X_{4-(p,\ q)}$ is set at $(2^n-1)$.

As another alternative, in the case of the second configurations described above, the fourth sub-pixel output-signal value $X_{4-(p,\ q)}$ is found in accordance with the following equation:

$$X_{4-(p,q)}=[(SG_{(p,q)-1}^2+SG_{(p,q)-2}^2)/2]^{1/2} \tag{2-C}$$

It is to be noted that one of Eqs. (2-A), (2-B) and (2-C) can be selected in accordance with the value of the first signal value $SG_{(p,\ q)-1}$, in accordance with the value of the second signal value $SG_{(p,\ q)-2}$ or in accordance with the values of both the first signal value $SG_{(p,\ q)-1}$ and the second signal value $SG_{(p,\ q)-2}$. That is to say, in every pixel group, one of Eqs. (2-A), (2-B) and (2-C) can be determined to serve as a common equation used in all pixel groups for finding the fourth sub-pixel output-signal value $X_{4-(p,\ q)}$ or one of Eqs. (2-A), (2-B) and (2-C) can be selected for every pixel group.

It is possible to provide a configuration in which the extension coefficient $\alpha_0$ is determined for every image display frame. In addition, in the case of the second configurations, it is possible to provide a configuration in which, after execution of processes (di) described above where suffix i is a positive integer, the luminance of illumination light radiated by the planar light-source apparatus is reduced on the basis of the extension coefficient $\alpha_0$.

In the image display panel provided by the present invention or the image display panel employed in the image display apparatus assembly provided by the embodiments of the present invention, it is possible to provide a configuration in which every pixel group is composed of a first pixel and a second pixel. That is to say, the number of pixels composing every pixel group is set at 2 (or, $p_0=2$) where notation $p_0$ denotes a group-pixel count representing the number of pixels composing every pixel group. However, the number of pixels composing every pixel group is by no means limited to two. That is to say, the equation $p_0=2$ must by no means be satisfied. In other words, the number of pixels composing every pixel group can be set at 3 or an integer greater than 3 (that is, $p_0\geq3$).

In addition, in these configurations, the row direction of the 2-dimensional matrix cited before is taken as the first direction whereas the column direction of the matrix is taken as the second direction. Let notation Q denote a positive integer representing the number of pixel groups arranged in the second direction. In this case, it is possible to provide a configuration in which the first pixel on the q'th column of the 2-dimensional matrix is placed at a location adjacent to the location of the first pixel on the (q'+1)th column of the matrix whereas the fourth sub-pixel on the q'th column is placed at a location not adjacent to the location of the fourth sub-pixel on the (q'+1)th column where notation q' denotes an integer satisfying the relations $1 \leq q' \leq (Q-1)$ As an alternative, with the row direction taken as the first direction and the column direction taken as the second direction as described above, it is also possible to provide a configuration in which the first pixel on the q'th column is placed at a location adjacent to the location of the second pixel on the (q'+1)th column whereas the fourth sub-pixel on the q'th column is placed at a location not adjacent to the location of the fourth sub-pixel on the (q'+1)th column where notation q' denotes an integer satisfying the relations $1 \leq q' \leq (Q-1)$.

As another alternative, with the row direction taken as the first direction and the column direction taken as the second direction as described above, it is also possible to provide a configuration in which the first pixel on the q'th column is placed at a location adjacent to the location of the first pixel on the (q'+1)th column whereas the fourth sub-pixel on the q'th column is placed at a location adjacent to the location of the fourth sub-pixel on the (q'+1)th column where notation q' denotes an integer which satisfies the relations $1 \leq q' \leq (Q-1)$.

It is to be noted that, for the image display apparatus assembly provided by the embodiments of the present invention as an assembly including desirable implementations and desirable configurations as described above, it is desirable to provide a scheme in which the luminance of illumination light radiated by the planar light-source apparatus to the rear face of the image display apparatus employed in the image display apparatus assembly is reduced on the basis of the extension coefficient $\alpha_0$.

In the so-called second configurations including desirable implementations and desirable configurations as described above, a maximum brightness/lightness value $V_{max}(S)$ expressed as a function of variable saturation S to serve as the maximum of a brightness/lightness value V in an HSV color space enlarged by adding the fourth color is stored in the signal processing section.

In addition, the signal processing section carries out the following processes of:

finding the saturation S and the brightness/lightness value V(S) for each of a plurality of pixels on the basis of the signal values of sub-pixel input signals received for the pixels;

finding an extension coefficient $\alpha_0$ on the basis of at least one of ratios $V_{max}(S)/V(S)$ found for the pixels; and finding sub-pixel output-signal values on the basis of at least the sub-pixel input-signal values and the extension coefficient $\alpha_0$.

By extending the sub-pixel output-signal values on the basis of the extension coefficient $\alpha_0$ as described above, there is no case in which the luminance of light emitted by the white-color display sub-pixel increases but the luminance of light emitted by each of the red-color display sub-pixel, the green-color display sub-pixel or the blue-color display sub-pixel does not increase as is the case with the existing technology. That is to say, the present invention increases not only the luminance of light emitted by the white-color display sub-pixel, but also the luminance of light emitted by each of the red-color display sub-pixel, the green-color display sub-pixel and the blue-color display sub-pixel.

Therefore, the present invention is capable of avoiding the problem of the generation of the color dullness with a high degree of reliability. In addition, the luminance of a displayed image can be increased with the implementation and configuration. As a result, the present invention is optimum for displaying an image such as a static image, an advertisement image or an image displayed in a wait state in a cellular phone. In addition, the luminance of illumination light generated by the planar light-source apparatus can be reduced on the basis of the extension coefficient $\alpha_0$. Thus, the power consumption of the planar light-source apparatus can be decreased as well.

It is to be noted that the signal processing section is capable of finding the sub-pixel output-signal values $X_{1-(p1,\ q)}$, $X_{2-(p1,\ q)}$, $X_{3-(p1,\ q)}$, $X_{1-(p2,\ q)}$, $X_{2-(p2,\ q)}$ and $X_{3-(p2,\ q)}$ on the basis of the extension coefficient $\alpha_0$ and the constant $\chi$. To put it more concretely, the signal processing section is capable of finding the sub-pixel output-signal values $X_{1-(p1,\ q)}$, $X_{2-(p1,\ q)}$, $X_{3-(p1,\ q)}$, $X_{1-(p2,\ q)}$, $X_{2-(p2,\ q)}$ and $X_{3-(p2,\ q)}$ in accordance with the following equations.

$$X_{1-(p1,q)}=\alpha_0 \cdot x_{1-(p1,q)}-\chi \cdot SG_{(p,q)-1} \tag{3-A}$$

$$X_{2-(p1,q)}=\alpha_0 \cdot x_{2-(p1,q)}-\chi \cdot SG_{(p,q)-1} \tag{3-B}$$

$$X_{3-(p1,q)}=\alpha_0 \cdot x_{3-(p1,q)}-\chi \cdot SG_{(p,q)-1} \tag{3-C}$$

$$X_{1-(p2,q)}=\alpha_0 \cdot x_{1-(p2,q)}-\chi \cdot SG_{(p,q)-2} \tag{3-D}$$

$$X_{2-(p2,q)}=\alpha_0 \cdot x_{2-(p2,q)}-\chi \cdot SG_{(p,q)-2} \tag{3-E}$$

$$X_{3-(p2,q)}=\alpha_0 \cdot x_{3-(p2,q)}-\chi \cdot SG_{(p,q)-2} \tag{3-F}$$

In general, the constant $\chi$ cited above is expressed as follows:

$$\chi=BN_4/BN_{1-3}$$

In the above equation, reference notation $BN_{1-3}$ denotes the luminance of light emitted by a pixel serving as a set of first, second and third sub-pixels for a case in which it is assumed that a signal having a value corresponding to the maximum signal value of a first sub-pixel output signal is received for the first sub-pixel, a signal having a value corresponding to the maximum signal value of a second sub-pixel output signal is received for the second sub-pixel and a signal having a value corresponding to the maximum signal value of a third sub-pixel output signal is received for the third sub-pixel. On the other hand, reference notation $BN_4$ denotes the luminance of light emitted by a fourth sub-pixel for a case in which it is assumed that a signal having a value corresponding to the maximum signal value of a fourth sub-pixel output signal is received for the fourth sub-pixel.

It is to be noted that the constant $\chi$ has a value peculiar to the image display panel, the image display apparatus and the image display apparatus assembly and is, thus, determined uniquely in accordance with the image display panel, the image display apparatus and the image display apparatus assembly.

It is possible to provide a configuration in which the extension coefficient $\alpha_0$ is set at a value $\alpha_{min}$ smallest among values found for a plurality of pixels as the values of $V_{max}(S)/V(S)$ [$\equiv\alpha(S)$]. As an alternative, it is also possible to provide a configuration in which, in accordance with the image to be displayed, a value selected typically from those in the range of $(1\pm0.4)$. $\alpha_{min}$ is taken as the extension coefficient $\alpha_0$. As another alternative, it is also possible to provide a configuration in which the extension coefficient $\alpha_0$ is found on the basis of at least one value of $V_{max}(S)/V(S)[\equiv\alpha(S)]$ found for a plurality of pixels. However, the extension coefficient $\alpha_0$ can also be found on the basis of one value such as the smallest value $\alpha_{min}$ or, as a further alternative, a plurality of relatively small values of $\alpha(S)$ are sequentially found, starting with the smallest value $\alpha_{min}$, and an average $\alpha_{ave}$ of the relatively small values of $\alpha(S)$ starting with the smallest value $\alpha_{min}$ is taken as the extension coefficient $\alpha_0$. As a still further alternative, it is also possible to provide a configuration in which a value selected from those in the range of $(1\pm0.4)\cdot\alpha_{ave}$ is taken as the extension coefficient $\alpha_0$. As a still further alternative, it is also possible to provide a configuration in which, if the number of pixels used in the operation to sequentially find the relatively small values of $\alpha(S)$, starting with the smallest value $\alpha_{min}$ is equal to or smaller than a value determined in advance, the number of pixels used in the operation to sequentially find the relatively small values of $\alpha(S)$, starting with the smallest value $\alpha_{min}$ is changed and, then, relatively small values of $\alpha(S)$ are sequentially found again, starting with the smallest value $\alpha_{min}$.

In addition, it is possible to provide a configuration making use of the white color as the fourth color. However, the fourth color is by no means limited to the white color. That is to say, the fourth color can be a color other than the white color. For example, the fourth color can also be the yellow, cyan or magenta color. If a color other than the white color is used as the fourth color and an image display apparatus is a color liquid-crystal display apparatus, it is possible to provide a configuration which further includes a first color filter placed between the first sub-pixel and the image observer to serve as a filter for passing light of the first elementary color, a second color filter placed between the second sub-pixel and the image observer to serve as a filter for passing light of the second elementary color and a third color filter placed between the third sub-pixel and the image observer to serve as a filter for passing light of the third elementary color.

In addition, it is possible to provide a configuration taking all $(P_0 \times Q)$ pixels where $P_0 \equiv p_0 \times P$ as a plurality of pixels for which the saturation S and the brightness/lightness value V(S) are to be found. As an alternative, it is also possible to provide a configuration taking $(P_0/P' \times Q/Q')$ pixels as a plurality of pixels for which the saturation S and the brightness/lightness value V are to be found. In this case, notation P' denotes a positive integer satisfying the relation $P_0 \geq P'$ whereas notation Q' denotes a positive integer which satisfies the relation $Q \geq Q'$. In addition, at least one of the ratios $P_0/P'$ and $Q/Q'$ must be positive integers each equal to or greater than 2. It is to be noted that concrete examples of the ratios $P_0/P'$ and $Q/Q'$ are 2, 4, 8, 16 and so on which are each an nth power of 2 where notation n is a positive integer. By adopting the former configuration, there are no changes of the image quality, and the image quality can thus be sustained well to a maximum extent. If the latter configuration is adopted, on the other hand, the processing speed can be raised and the circuit of the signal processing section can be simplified.

As described above, reference notation $p_0$ denotes the number of pixels pertaining to a pixel group. It is to be noted that, in such a case, with the ratio $P_0/P'$ set at 4 (that is, $P_0/P'=4$) and the ratio $Q/Q'$ set at 4 (that is, $Q/Q'=4$) for example, a saturation S and a brightness/lightness value V(S) are found for every four pixels. Thus, for the remaining three of the four pixels, the value of $V_{max}(S)/V(S)[\equiv\alpha(S)]$ may be smaller than the extension coefficient $\alpha_0$ in some cases. That is to say, the value of the extended sub-pixel output signal may exceed $V_{max}(S)$ in some cases. In such cases, the upper limit of the extended sub-pixel output signal may be set at a value matching $V_{max}(S)$.

A light emitting device can be used as each light source composing the planar light-source apparatus. To put it more concretely, an LED (Light Emitting Diode) can be used as the light source. This is because the light emitting diode serving as a light emitting device occupies only a small space so that a plurality of light emitting devices can be arranged with ease. A typical example of the light emitting diode serving as a light emitting device is a white-light emitting diode. The white-light emitting diode is a light emitting diode which radiates illumination light of the white color. The white-light emitting diode is obtained by combining an ultraviolet-light emitting diode or a blue-light emitting diode with a light emitting particle.

Typical examples of the light emitting particle are a red-light emitting fluorescent particle, a green-light emitting fluorescent particle and a blue-light emitting fluorescent particle. Typical materials for making the red-light emitting fluorescent particle are $Y_2O_3$: Eu, $YVO_4$:Eu, Y (P, V) $O_4$:Eu, 3.5 MgO.0.5 $MgF_2.Ge_2$:Mn, $CaSiO_3$:Pb, Mn, $Mg_6AsO_{11}$:Mn, $(Sr, Mg)_3(PO_4)_3$:Sn, $La_2O_2S$:Eu, $Y_2O_2S$:Eu, (ME:Eu) S, $(M:Sm)_x(Si, Al)_{12}(O, N)_{16}$, $ME_2Si_5N_8$:Eu, (Ca:Eu) $SiN_2$ and (Ca:Eu) $AlSiN_3$. Symbol ME in (ME:Eu) S means an atom of at least one type selected from groups of Ca, Sr and Ba. Symbol ME used in the material names following (ME:Eu) S means the same as that in (ME:Eu) S. On the other hand, symbol M in $(M:Sm)_x(Si, Al)_{12}(O, N)_{16}$ means an atom of at least one type selected from groups of Li, Mg and Ca. Symbol M in the material names following $(M:Sm)_x(Si, Al)_{12}(O, N)_{16}$ means the same as that in $(M:Sm)_x(Si, Al)_{12}(O, N)_{16}$.

In addition, typical materials for making the green-light emitting fluorescent particle are $LaPO_4$:Ce, Tb, $BaMgAl_{10}O_{17}$:Eu, Mn, $Zn_2SiO_4$:Mn, $MgAl_{11}O_{19}$:Ce, Tb, $Y_2SiO_5$:Ce, Tb, $MgAl_{11}O_{19}$:CE, Tb and Mn. Typical materials for making the green-light emitting fluorescent particle also include (Me:Eu) $Ga_2S_4$, $(M:RE)_x(Si, Al)_{12}(O, N)_{16}$, $(M:Tb)_x(Si, Al)_{12}(O, N)_{16}$ and $(M:Yb)_x (Si, Al)_{12}(O, N)_{16}$. Symbol RE in $(M:RE)_x(Si, Al)_{12}(O, N)_{16}$ means Tb and Yb.

In addition, typical materials for making the blue-light emitting fluorescent particle are $BaMgAl_{10}O_{17}$:Eu, $BaMg_2Al_{16}O_{27}$:Eu, $Sr_2P_2O_7$:Eu, $Sr_5 (PO_4)_3Cl$:Eu, (Sr, Ca, Ba, Mg)$_5(PO_4)_3Cl$:Eu, $CaWO_4$, and $CaWO_4$:Pb.

However, the light emitting particle is by no means limited to the fluorescent particle. For example, the light emitting particle can be a light emitting particle having a quantum well structure such as a 2-dimensional quantum well structure, a 1-dimensional quantum well structure (or a quantum fine line) or a 0-dimensional quantum well structure (or a quantum dot). The light emitting particle having a quantum well structure typically makes use of a quantum effect by localizing a wave function of carriers in order to convert the carriers into light with a high degree of efficiency in a silicon-family material of an indirect transition type in the same way as a direct transition type.

In addition, in accordance with a generally known technology, a rare earth atom added to a semiconductor material sharply emits light by virtue of an intra-cell transition phenomenon. That is to say, the light emitting particle can be a light emitting particle applying this technology.

As an alternative, the light source of the planar light-source apparatus can be configured as a combination of a red-light emitting device for emitting light of the red color, a green-light emitting device for emitting light of the green color and a blue-light emitting element for emitting light of the blue color. A typical example of the light of the red color is light having a main light emission waveform of 640 nm, a typical example of the light of the green color is light having a main light emission waveform of 530 nm and a typical example of the light of the blue color is light having a main light emission waveform of 450 nm. A typical example of the red-light emitting device is a light emitting diode, a typical example of the green-light emitting device is a light emitting diode of the GaN family and a typical example of the blue-light emitting device is a light emitting diode of the GaN family. In addition, the light source may also include light emitting devices for emitting light of the fourth color, the fifth color and so on which are other than the red, green and blue colors.

The LED (light emitting diode) may have the so-called face-up structure or a flip-chip structure. That is to say, the light emitting diode is configured to have a substrate and a light emitting layer created on the substrate. The substrate and the light emitting layer may form a structure in which light is radiated from the light emitting layer to the external world. Alternatively, the substrate and the light emitting layer may form a substrate in which light is radiated from the light emitting layer to the external world by way of the substrate. To put it more concretely, the light emitting diode has a laminated structure typically including a substrate, a first chemical compound semiconductor layer created on the substrate to serve as a layer of a first conduction type such as the n-conduction type, an active layer created on the first chemical compound semiconductor layer and a second chemical compound semiconductor layer created on the active layer to serve as a layer of a second conduction type such as the p-conduction type. In addition, the light emitting diode has a first electrode electrically connected to the first chemical compound semiconductor layer and a second electrode electrically connected to the second chemical compound semiconductor layer. Each of the layers composing the light emitting diode can be made from a generally known chemical compound semiconductor material which is selected on the basis of the wavelength of light to be emitted by the light emitting diode.

The planar light-source apparatus also referred to as a backlight can have one of two types. That is to say, the planar light-source apparatus can be a planar light-source apparatus of a right-below type disclosed in documents such as Japanese Patent Laid-Open No. Sho 63-187120 and Japanese Patent Laid-open No. 2002-277870 or a planar light-source apparatus of an edge-light type (or a side-light type) disclosed in documents such as Japanese Patent Laid-open No. 2002-131552.

In the case of the planar light-source apparatus of the right-below type, the light emitting devices each described previously to serve as a light source can be laid out to form an array in a case. However, the arrangement of the light emitting devices is by no means limited to such a configuration. In the case of a configuration in which a plurality of red-color light emitting devices, a plurality of green-color light emitting devices and a plurality of blue-color light emitting devices are laid out to form an array inside a case, the array of these light emitting devices is composed of a plurality of sets each including a red-color light emitting device, a green-color light emitting device and a blue-color light emitting device. The set is a group of light emitting devices employed in an image display panel. To put it more concretely, the groups each including light emitting devices compose an image display apparatus. A plurality of light emitting device groups are laid out continuously in the horizontal direction of the display screen of the image display panel to form a continuous array of groups each including light emitting devices. A plurality of such arrays of groups each including light emitting devices are laid out in the vertical direction of the display screen of the image display panel to form a 2-dimensional matrix. As is obvious from the above description, a light emitting device group is composed of one red-color light emitting device, one green-color light emitting device and one blue-color light emitting device. As a typical alternative, however, a light emitting device group may be composed of one red-color light emitting device, two green-color light emitting devices and one blue-color light emitting device. As another typical alternative, a light emitting device group may be composed of two red-color light emitting devices, two green-color light emitting devices and one blue-color light emitting device. That is to say, a light emitting device group is one of a plurality of combinations each composed of red-color light emitting devices, green-color light emitting devices and blue-color light emitting devices.

It is to be noted that the light emitting device can be provided with a light fetching lens like one described on page 128 of Nikkei Electronics, No. 889, Dec. 20, 2004.

If the planar light-source apparatus of the right-below type is configured to include a plurality of planar light-source units, each of the planar light-source units can be implemented as one aforementioned group of light emitting devices or at least two such groups each including light emitting devices. As an alternative, each planar light-source unit can be implemented as one white-color light emitting diode or at least two white-color light emitting diodes.

If the planar light-source apparatus of the right-below type is configured to include a plurality of planar light-source units, a separation wall can be provided between every two adjacent planar light-source units. The separation wall can be made from a nontransparent material which does not pass on light radiated by a light emitting device of the planar light-source apparatus. Concrete examples of such a material are the acryl family resin, the polycarbonate resin and the ABS resin. As an alternative, the separation wall can also be made from a material which passes on light radiated by a light emitting device of the planar light-source apparatus. Concrete examples of such a material are the polymethacrylic methyl acid resin (PMMA), the polycarbonate resin (PC), the polyarylate resin (PAR), the polyethylene terephthalate resin (PET) and glass.

A light diffusion/reflection function or a mirror-surface reflection function can be provided on the surface of the partition wall. In order to provide the light diffusion/reflection function on the surface of the partition wall, unevenness is created on the surface of the partition wall by adoption of a sand blast technique or by pasting a film having unevenness on the surface thereof to the surface of the separation wall to serve as a light diffusion film. In addition, in order to provide the mirror-surface reflection function on the surface of the partition wall, typically, a light reflection film is pasted to the surface of the partition wall or a light reflection layer is created on the surface of the partition wall by carrying out a coating process for example.

The planar light-source apparatus of the right-below type can be configured to have a light diffusion plate, an optical function sheet group and a light reflection sheet. The optical function sheet group typically includes a light diffusion sheet, a prism sheet and a light polarization conversion sheet. A commonly known material can be used for making each of the light diffusion plate, the light diffusion sheet, the prism sheet, the light polarization conversion sheet and the light reflection sheet. The optical function sheet group may include a plurality of sheets which are separated from each other by a gap or stacked on each other to form a laminated structure. For example, the light diffusion sheet, the prism sheet and the light polarization conversion sheet can be stacked on each other to form a laminated structure. The light diffusion plate and the optical function sheet group are provided between the planar light-source apparatus and the image display panel.

In the case of the planar light-source apparatus of the edge-light type, on the other hand, a light guiding plate is provided to face the image display panel. A concrete example of the image display panel is the image display panel employed in a liquid-crystal display apparatus. On a side face of the light guiding plate, light emitting devices are provided. In the following description, the side face of the light guiding plate is referred to as a first side face. The light guiding plate has a bottom face serving as a first face, a top face serving as a second face, the first side face cited above, a second side face, a third side face facing the first side face and a fourth side face facing the second side face. A typical example of a more concrete whole shape of the light guiding plate is a top-cut square conic shape resembling a wedge. In this case, the two mutually facing side faces of the top-cut square conic shape correspond to the first and second faces respectively whereas the bottom face of the top-cut square conic shape corresponds to the first side face. In addition, it is desirable to provide the surface of the bottom face serving as the first face with protrusions and/or dents. Incident light is received from the first side face of the light guiding plate and radiated to the image display panel from the top face which serves as the second face. The second face of the light guiding plate can be made smooth like a mirror surface or provided with blast engraving surface having a light diffusion effect so as to create a surface with infinitesimal unevenness portions.

It is desirable to provide the bottom face (or the first face) of the light guiding plate with protrusions and/or dents. That is to say, it is desirable to provide the first face of the light guiding plate with protrusions, dents or unevenness portions including protrusions and dents. If the first face of the light guiding plate is provided with unevenness portions including protrusions and dents, a protrusion and a dent can be placed at contiguous locations or noncontiguous locations. It is possible to provide a configuration in which the protrusions and/or the dents provided on the first face of the light guiding plate are aligned in a stretching direction which forms an angle determined in advance in conjunction with the direction of illumination light incident to the light guiding plate. In such a configuration, the cross-sectional shape of contiguous protrusions or contiguous dents for a case in which the light guiding plate is cut over a virtual plane vertical to the first face in the direction of illumination light incident to the light guiding plate is typically the shape of a triangle, the shape of any quadrangle such as a square, a rectangle or a trapezoid, the shape of any polygon or a shape enclosed by a smooth curve. Examples of the shape enclosed by a smooth curve are a circle, an eclipse, a paraboloid, a hyperboloid and a catenary. It is to be noted that the predetermined angle formed by the direction of illumination light incident to the light guiding plate in conjunction with the stretching direction of the protrusions and/or the dents provided on the first face of the light guiding plate has a value in the range 60 to 120 degrees. That is to say, if the direction of illumination light incident to the light guiding plate corresponds to the angle of 0 degrees, the stretching direction corresponds to an angle in the range 60 to 120 degrees.

As an alternative, every protrusion and/or every dent which are provided on the first face of the light guiding plate can be configured to serve respectively as every protrusion and/or every dent which are laid out non-contiguously in a stretching direction forming an angle determined in advance in conjunction with the direction of illumination light incident to the light guiding plate. In this configuration, the shape of noncontiguous protrusions and noncontiguous dents can be the shape of a pyramid, the shape of a circular cone, the shape of a cylinder, the shape of a polygonal column such as a triangular column or a rectangular column or any of a variety of cubical shapes enclosed by a smooth curved surface. Typical examples of a cubical shape enclosed by a smooth curved surface are a portion of a sphere, a portion of a spheroid, a portion of a cubic paraboloid and a portion of a cubic hyperboloid. It is to be noted that, in some cases, the light guiding plate may include protrusions and dents. These protrusions and dents are formed on the peripheral edges of the first face of the light guiding plate. In addition, illumination light radiated by a light source to the light guiding plate collides with either of a protrusion and a dent which are created on the first face of the light guiding plate and is dispersed. The height, depth, pitch and shape of every protrusion and/or every dent can be fixed or changed in accordance with the distance from the light source. If the height, depth, pitch and shape of every protrusion and/or every dent are changed in accordance with the distance from the light source, for example, the pitch of every protrusion and the pitch of every dent can be made smaller as the distance from the light source increases. The pitch of every protrusion or the pitch of every dent means a pitch extended in the direction of illumination light incident to the light guiding plate.

In a planar light-source apparatus provided with a light guiding plate, it is desirable to provide a light reflection member facing the first face of the light guiding plate. In addition, an image display panel is placed to face the second face of the light guiding plate. To put it more concretely, the liquid-crystal display apparatus is placed to face the second face of the light guiding plate. Light emitted by a light source reaches the light guiding plate from the first side face which is typically the bottom face of the top-cut square conic shape. Then, the light collides with a protrusion or a dent and is dispersed. Subsequently, the light is radiated from the first face and reflected by the light reflection member to again arrive at the first face. Finally, the light is radiated from the second face to the image display panel. For example, a light diffusion sheet or a prism sheet can be placed at a location between the second face of the light guiding plate and the image display panel. In addition, the illumination light radiated by the light source can be led directly or indirectly to the light guiding plate. If the illumination light radiated by the light source is led indirectly to the light guiding plate, an optical fiber is typically used for leading the light to the light guiding plate.

It is desirable to make the light guiding plate from a material that does not much absorb illumination light radiated by the light source. Typical examples of the material for making the light guiding plate include glass and plastic materials such as the polymethacrylic methyl acid resin (PMMA), the polycarbonate resin (PC), the acryl family resin, the amorphous polypropylene family resin and the styrene family resin including the AS resin.

In this present invention, the method for driving the planar light-source apparatus and the condition for driving the apparatus are not prescribed in particular. Instead, the light sources can be controlled collectively. That is to say, for example, a plurality of light emitting devices are driven at the same time. As an alternative, the light emitting devices are driven in units each including a plurality of light emitting devices. This driving method is referred to as a group driving technique. To put it concretely, the planar light-source apparatus is composed of a plurality of planar light-source units whereas the display area of the image display panel is divided into the same plurality of virtual display area units. For example, the planar light-source apparatus is composed of (S×T) planar light-source units whereas the display area of the image display panel is divided into (S×T) virtual display area units each associated with one of the (S×T) planar light-source units. In such a configuration, the light emission state of each of the (S×T) planar light-source units is driven individually.

A driving circuit for driving the planar light-source apparatus is referred to as a planar light-source apparatus driving circuit which typically includes an LED (Light Emitting Device) driving circuit, a processing circuit and a storage device (to serve as a memory). On the other hand, a driving circuit for driving the image display panel is referred to as an image display panel driving circuit which is composed of commonly known circuits. It is to be noted that a temperature control circuit may be employed in the planar light-source apparatus driving circuit.

The control of the display luminance and the light-source luminance is executed for each image display frame. The display luminance is the luminance of illumination light radiated from a display area unit whereas the light-source luminance is the luminance of illumination light emitted by a planar light-source unit. It is to be noted that, as electrical signals, the driving circuits described above receive a frame frequency also referred to as a frame rate and a frame time which is expressed in terms of seconds. The frame frequency is the number of images transmitted per second whereas the frame time is the reciprocal of the frame frequency.

A transmission-type liquid-crystal display apparatus typically includes a front panel, a rear panel and a liquid-crystal material sandwiched by the front and rear panels. The front panel employs first transparent electrodes whereas the rear panel employs second transparent electrodes.

To put it more concretely, the front panel typically has a first substrate, the aforementioned first transparent electrodes each also referred to as a common electrode and a polarization film. The first substrate is typically a glass substrate or a silicon substrate. Each of the first transparent electrodes which are provided on the inner face of the first substrate is typically an ITO device. The polarization film is provided on the outer face of the first substrate.

In addition, in a color liquid-crystal display apparatus of the transmission type, color filters covered by an overcoat layer made of acryl resin or epoxy resin are provided on the inner face of the first substrate. On top of that, the front panel has a configuration in which the first transparent electrode is created on the overcoat layer. It is to be noted that an orientation film is created on the first transparent electrode.

On the other hand, to put it more concretely, the rear panel typically has a second substrate, switching devices, the aforementioned second transparent electrodes each also referred to as a pixel electrode and a polarization film. The second substrate is typically a glass substrate or a silicon substrate. The switching devices are provided on the inner face of the second substrate. Each of the second transparent electrodes which are each controlled by one of the switching devices to a conductive or a non-conductive state is typically an ITO device. The polarization film is provided on the outer face of the second substrate. On the entire face including the second transparent electrodes, an orientation film is created.

A variety of members composing the liquid-crystal display apparatus including the transmission-type image display apparatus can be selected from commonly known members. By the same token, a variety of liquid-crystal materials for making the liquid-crystal display apparatus including the transmission-type image display apparatus can also be selected from commonly known liquid-crystal materials. Typical examples of the switching device are a 3-terminal device and a 2-terminal device. Typical examples of the 3-terminal device include a MOS-type FET (Field Effect Transistor) and a TFT (Thin Film Transistor) which are transistors created on a single-crystal silicon semiconductor substrate. On the other hand, typical examples of the 2-terminal device are a MIM device, a varistor device and a diode.

Let notation ($P_0$, Q) denotes a pixel count ($P_0$×Q) representing the number of pixels laid out to form a 2-dimensional matrix on the image display panel 30. To put it in detail, notation $P_0$ denotes the number of pixels laid out in the first direction to form a row whereas notation Q denotes the number of such rows laid out in the second direction to form the 2-dimensional matrix. Actual numerical values of the pixel count ($P_0$, Q) are VGA (640, 480), S-VGA (800, 600), XGA (1,024, 768), APRC (1,152, 900), S-XGA (1,280, 1,024), U-XGA (1,600, 1,200), HD-TV (1,920, 1,080), Q-XGA (2,048, 1,536), (1,920, 1,035), (720, 480) and (1,280, 960) which each represent an image display resolution. However, numerical values of the pixel count ($P_0$, Q) are by no means limited to these typical examples. Typical relations between the values of the pixel count ($P_0$, Q) and the values (S, T) are shown in Table 1 given below even though relations between the values of the pixel count ($P_0$, Q) and the values (S, T) are by no means limited to those shown in the table. Typically, the number of pixels composing one display area unit is in the range 20×20 to 320×240. It is desirable to set the number of pixels composing one display area unit in the range 50×50 to 200×200. The number of pixels composing one display area unit can be fixed or changed from unit to unit.

As described earlier, (S×T) is the number of virtual display area units each associated with one of the (S×T) planar light-source units.

TABLE 1

| | S value | T value |
|---|---|---|
| VGA (640, 480) | 2~32 | 2~24 |
| S-VGA (800, 600) | 3~40 | 2~30 |
| XGA (1024, 768) | 4~50 | 3~39 |
| APRC (1152, 900) | 4~58 | 3~45 |
| S-XGA (1280, 1024) | 4~64 | 4~51 |
| U-XGA (1600, 1200) | 6~80 | 4~60 |
| HD-TV (1920, 1080) | 6~86 | 4~54 |
| Q-XGA (2048, 1536) | 7~102 | 5~77 |
| (1920, 1035) | 7~64 | 4~52 |
| (720, 480) | 3~34 | 2~24 |
| (1280, 960) | 4~64 | 3~48 |

With regard to the image display apparatus provided by the present invention and the method for driving the image display apparatus, the image display apparatus can typically be a color image display apparatus of either a direct-view type or a projection type. As an alternative, the image display apparatus can be a direct-view type or a projection type color image display apparatus adopting the field sequential system. It is to be noted that the number of light emitting devices composing the image display apparatus is determined on the basis of specifications required of the apparatus. In addition, on the basis of the specifications required of the image display apparatus, the apparatus can be configured to further include light bulbs.

The image display apparatus is by no means limited to a color liquid-crystal display apparatus. Other typical examples of the image display apparatus are an organic electro luminescence display apparatus (or an organic EL display apparatus), an inorganic electro luminescence display apparatus (or an inorganic EL display apparatus), a cold cathode field electron emission display apparatus (FED), a surface transmission type electron emission display apparatus (SED), a plasma display apparatus (PDP), a diffraction lattice-light conversion apparatus employing diffraction lattice-light conversion devices (GLV), a digital micro-mirror device (DMD) and a CRT. In addition, the color image display apparatus is also by no means limited to a transmission-type liquid-crystal display apparatus. For example, the color image display apparatus can also be a reflection-type liquid-crystal display apparatus or a semi-transmission-type liquid-crystal display apparatus.

First Embodiment

A first embodiment implements an image display panel provided by the present invention, a method for driving an image display apparatus employing the image display panel, an image display apparatus assembly employing the image display apparatus and a method for driving an image display apparatus assembly. To put it more concretely, the first embodiment implements a configuration according to the (1-A)th mode, a configuration according the (1-A-1)th mode and the first configuration mentioned previously.

Figure 4:
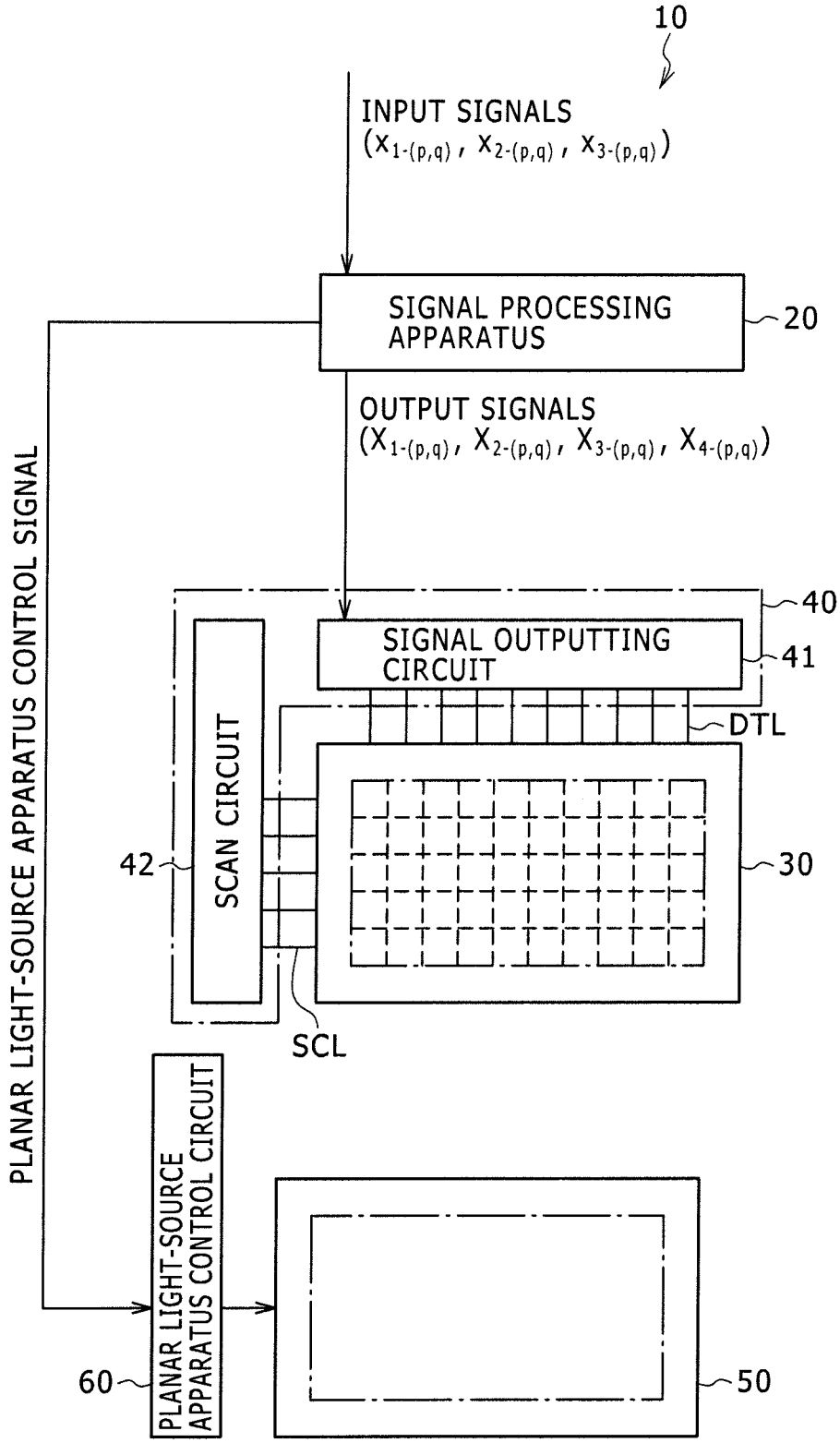
FIG. 4 is a conceptual diagram showing an image display apparatus according to the first embodiment.

As shown in a conceptual diagram of FIG. 4, the image display apparatus 10 according to the first embodiment employs an image display panel 30 and a signal processing section 20. The image display apparatus assembly according to the first embodiment employs the image display apparatus 10 and a planar light-source apparatus 50 for radiating illumination light to the rear face of the image display apparatus 10. To put it more concretely, the planar light-source apparatus 50 is a section for radiating illumination light to the rear face of the image display panel 30 employed in the image display apparatus 10.

In a model diagram of FIG. 1 showing the image display panel 30 according to the first embodiment, reference notation R denotes a first sub-pixel serving as a first light emitting device for emitting light of the first elementary color such as the red color whereas reference notation G denotes a second sub-pixel serving as a second light emitting device for emitting light of the second elementary color such as the green color. By the same token, reference notation B denotes a third sub-pixel serving as a third light emitting device for emitting light of the third elementary color such as the blue color whereas reference notation W denotes a fourth sub-pixel serving as a fourth light emitting device for emitting light of the white color.

A pixel Px includes a first sub-pixel R, a second sub-pixel G and a third sub-pixel B. A plurality of such pixels Px are laid out in a first direction and a second direction to form a 2-dimensional matrix. A pixel group PG has at least a first pixel $Px_1$ and a second pixel $Px_2$ which are adjacent to each other in the first direction. That is to say, a first pixel $Px_1$ and a second pixel $Px_2$ are the aforementioned pixels Px composing a pixel group PG.

In the case of the first embodiment, to put it more concretely, a pixel group PG has a first pixel $Px_1$ and a second pixel $Px_2$ which are adjacent to each other in the first direction. Let reference notation $p_0$ denote the number of pixels Px composing a pixel group PG. Thus, in the case of the first embodiment, the value of $p_0$ is 2 (that is, $p_0=2$). In addition, a fourth sub-pixel W is placed between the first pixel $Px_1$ and the second pixel $Px_2$ in every pixel group PG. In the case of the first embodiment, the fourth sub-pixel W is a sub-pixel for emitting light of the white color as described above.

Figure 5:
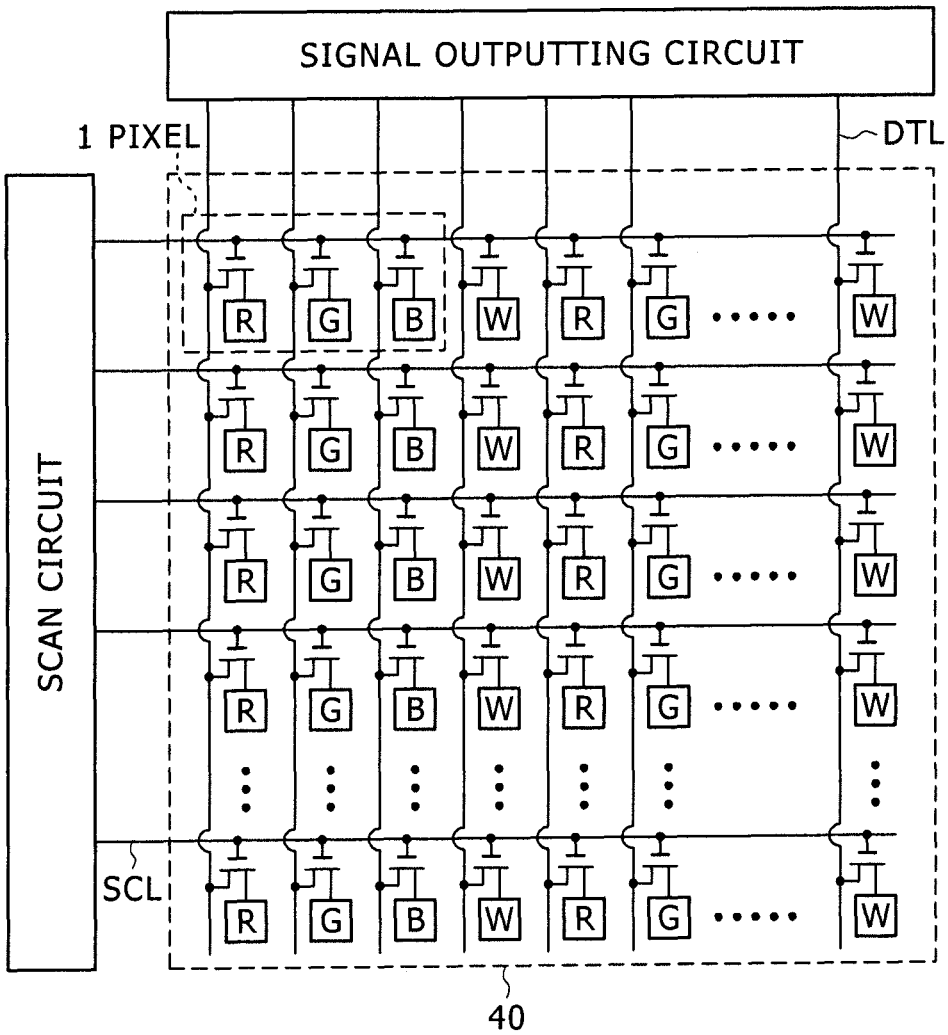
FIG. 5 is a conceptual diagram showing the image display panel employed in the image display apparatus according to the first embodiment and circuits for driving the image display panel.

It is to be noted that FIG. 5 is properly given as a diagram showing interconnections among the first sub-pixels R each emitting light of the red color, the second sub-pixels G each emitting light of the green color, the third sub-pixels B each emitting light of the blue color and the fourth sub-pixels W each emitting light of the white color. The layout shown in the diagram of FIG. 5 as the layout of the first sub-pixels R, the second sub-pixels G, the third sub-pixels B and the fourth sub-pixels W will be referred later in description of a third embodiment.

Let reference notation P denote a positive integer representing the number of pixel groups PG laid out in the first direction to form a row whereas reference notation Q denote a positive integer representing the number of such rows groups PG laid out in the second direction. Since each pixel group PG includes $p_0$ pixels Px, $P_0(=p_0\times P)$ pixels are laid out in the horizontal direction serving as the first direction to form a row and Q such rows are laid out in the vertical direction serving as the second direction to form a 2-dimensional matrix which includes $(P_0\times Q)$ pixels Px. In addition, in the case of the first embodiment, the value of $p_0$ is 2 (that is, $p_0=2$) as described above.

Figure 2:
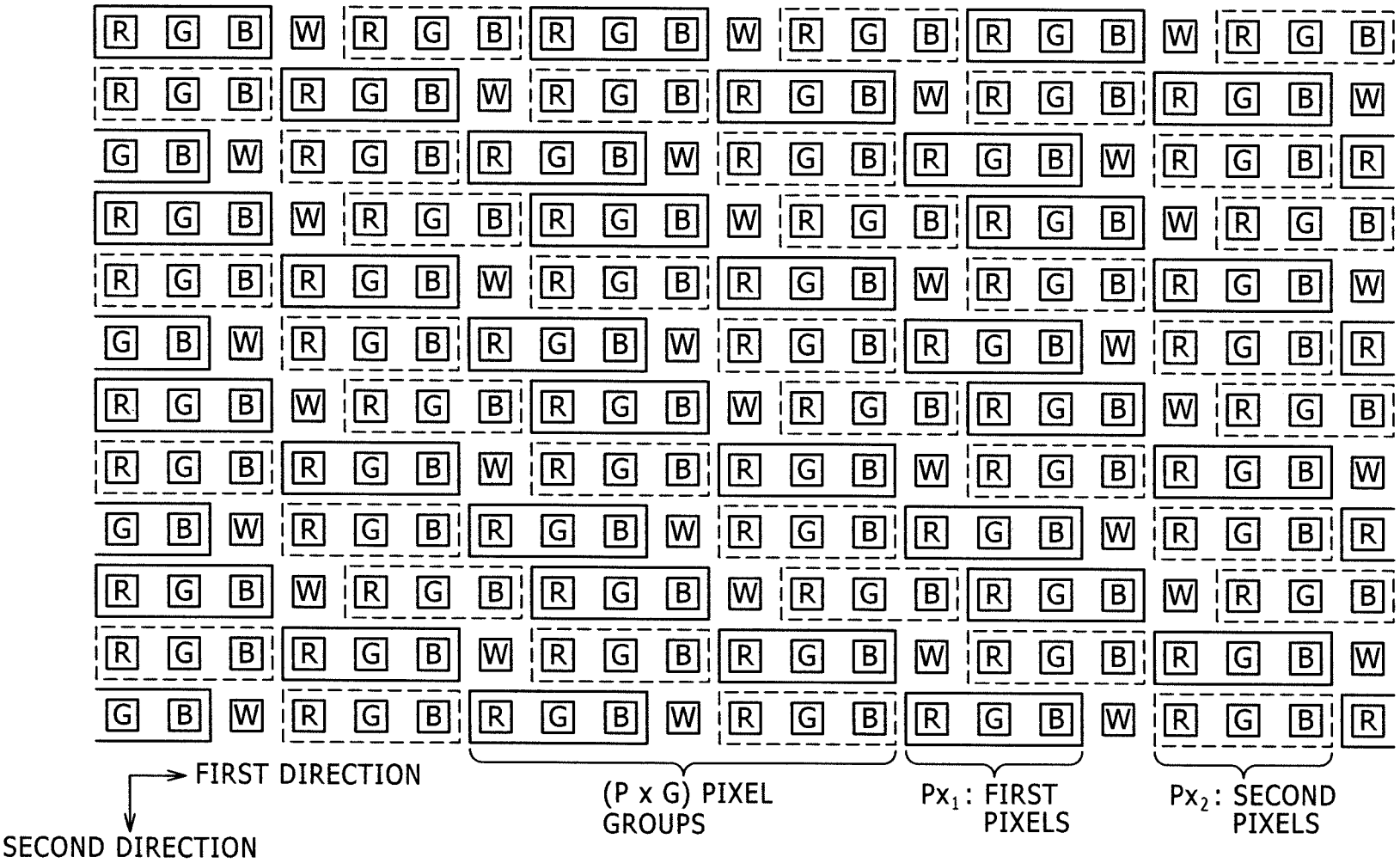
FIG. 2 is a model diagram showing the locations of pixels and pixel groups in an image display panel according to a second embodiment of the present invention.
Figure 3:
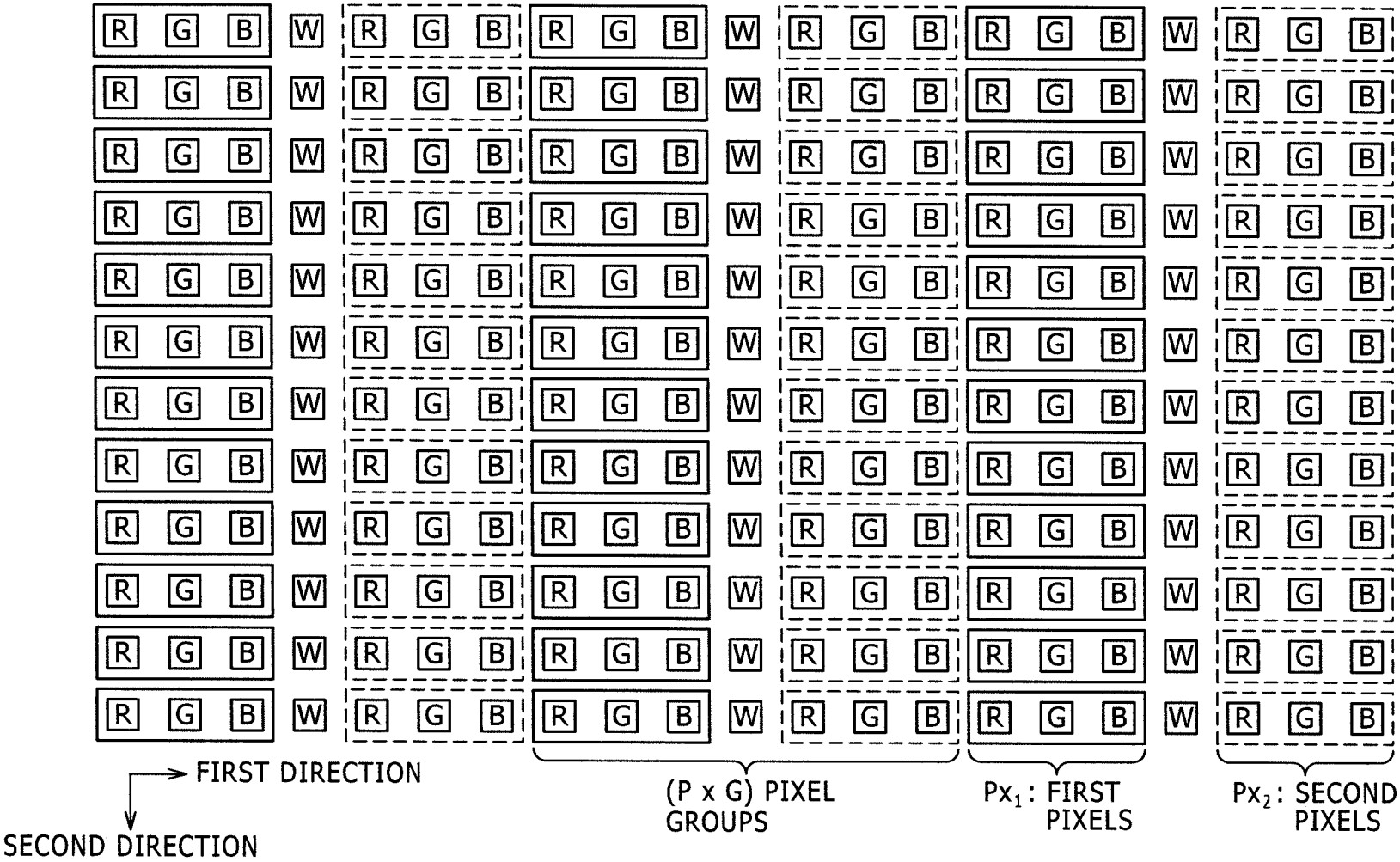
FIG. 3 is a model diagram showing the locations of pixels and pixel groups in an image display panel according to a third embodiment of the present invention.

On top of that, in the case of the first embodiment, the horizontal direction is taken as the first direction whereas the vertical direction is taken as the second direction. In this case, it is possible to provide a configuration in which the first pixel $Px_1$ on the q'th column is placed at a location adjacent to the location of the first pixel $Px_1$ on the (q'+1)th column whereas the fourth sub-pixel W on the q'th column is placed at a location not adjacent to the location of the fourth sub-pixel W on the (q'+1)th column where notation q' denotes an integer which satisfies the relations $1\leq q'\leq(Q-1)$. That is to say, in the second direction, the second pixels $Px_2$ and the fourth sub-pixels W are provided alternately. It is to be noted that, in the image display panel shown in the diagram of FIG. 1, a first sub-pixel R, a second sub-pixel G and a third sub-pixel B which form a first pixel $Px_1$ are put in a box enclosed by a solid line whereas a first sub-pixel R, a second sub-pixel G and a third sub-pixel B which form a second pixel $Px_2$ are put in a box enclosed by a dashed line. By the same token, in an image display panel shown in each of diagrams of FIGS. 2 and 3 to be described later, a first sub-pixel R, a second sub-pixel G and a third sub-pixel B which form a first pixel $Px_1$ are put in a box enclosed by a solid line whereas a first sub-pixel R, a second sub-pixel G and a third sub-pixel B which form a second pixel $Px_2$ are put in a box enclosed by a dashed line. As described above, in the second direction, the second pixels $Px_2$ and the fourth sub-pixels W are provided alternately. Thus, it is possible to reliably prevent a streaky pattern from appearing on the displayed image due to the existence of the fourth sub-pixels W even though the prevention of such a pattern also depends on the pixel pitch.

To put it more concretely, the image display apparatus according to the first embodiment is a color liquid-crystal display apparatus of the transmission type. Thus, the image display panel 30 employed in the image display apparatus according to the first embodiment is a color liquid-crystal display apparatus. In this case, it is possible to provide a configuration which further includes a first color filter placed between the first sub-pixel and the image observer to serve as a filter for passing light of the first elementary color, a second color filter placed between the second sub-pixel and the image observer to serve as a filter for passing light of the second elementary color and a third color filter placed between the third sub-pixel and the image observer to serve as a filter for passing light of the third elementary color. It is to be noted that each the fourth sub-pixels is not provided with a color filter. In place of a color filter, the fourth sub-pixels can be provided with a transparent resin layer for preventing a large quantity of unevenness to be generated in the fourth sub-pixels due to the absence of the color filters for the fourth sub-pixels.

In addition, the signal processing section 20 generates a first sub-pixel output signal, a second sub-pixel output signal and a third sub-pixel output signal for respectively the first sub-pixel R, the second sub-pixel G and the third sub-pixel B which pertain to the first pixel $Px_1$ included in each of the pixel groups PG on the basis of respectively a first sub-pixel input signal received for the first sub-pixel R, a second sub-pixel input signal received for the second sub-pixel G and a third sub-pixel input signal received for the third sub-pixel B. On top of that, the signal processing section 20 also generates a first sub-pixel output signal, a second sub-pixel output signal and a third sub-pixel output signal for respectively the first sub-pixel R, the second sub-pixel G and the third sub-pixel B which pertain to the second pixel $Px_2$ included in each of the pixel groups PG on the basis of respectively a first sub-pixel input signal received for the first sub-pixel R, a second sub-pixel input signal received for respectively the second sub-pixel G and a third sub-pixel input signal received for the third sub-pixel B. In addition, the signal processing section 20 also generates a fourth sub-pixel output signal on the basis of the first sub-pixel input signal, the second sub-pixel input signal and the third sub-pixel input signal which are received for the first pixel $Px_1$ included in each of the pixel groups PG and on the basis of the first sub-pixel input signal, the second sub-pixel input signal and the third sub-pixel input signal which are received for the second pixel $Px_2$ included in the pixel group PG.

As shown in a diagram of FIG. 4, in the first embodiment, the signal processing section 20 supplies the sub-pixel output signals to an image display panel driving circuit 40 for driving the image display panel 30 which is actually a color liquid-crystal display panel and supplies control signals to a planar light-source apparatus control circuit 60 for driving the planar light-source apparatus 50. The image display panel driving circuit 40 employs a signal outputting circuit 41 and a scan circuit 42. It is to be noted that the scan circuit 42 controls switching devices in order to put the switching devices in turned-on and turned-off states. Each of the switching devices is typically a TFT for controlling the operation (that is, the optical transmittance) of a sub-pixel employed in the image display panel 30. On the other hand, the signal outputting circuit 41 holds video signals to be sequentially output to the image display panel 30. The signal outputting circuit 41 is electrically connected to the image display panel 30 by lines DTL whereas the scan circuit 42 is electrically connected to the image display panel 30 by lines SCL.

It is to be noted that, in the case of every embodiment, reference notation n denoting a display gradation bit count representing the number of display gradation bits is set at 8 (that is, n=8). In other words, the number of display gradation bits is 8. To put it more concretely, the value of the display gradation is in the range 0 to 255. It is to be noted that the maximum value of the display gradation is expressed by an expression $(2^n-1)$ in some cases.

In the case of the first embodiment, with regard to the first pixel $Px_{(p,\ q)-1}$ pertaining to the (p, q)th pixel group $PG_{(p,\ q)}$ where notation p denotes an integer satisfying the relations $1 \le p \le P$ whereas notation q denotes an integer satisfying the relations $1 \le q \le Q$, the signal processing section 20 receives the following sub-pixel input signals:

a first sub-pixel input signal provided with a first sub-pixel input-signal value $x_{1-(p1,\ q)}$;

a second sub-pixel input signal provided with a second sub-pixel input-signal value $x_{2-(p1,\ q)}$; and a third sub-pixel input signal provided with a third sub-pixel input-signal value $x_{3-(p1,\ q)}$.

In addition, with regard to the second pixel $Px_{(p,\ q)-2}$ pertaining to the (p, q)th pixel group $PG_{(p,\ q)}$, on the other hand, the signal processing section 20 receives the following sub-pixel input signals:

a first sub-pixel input signal provided with a first sub-pixel input-signal value $x_{1-(p2,\ q)}$;

a second sub-pixel input signal provided with a second sub-pixel input-signal value $x_{2-(p2,\ q)}$; and a third sub-pixel input signal provided with a third sub-pixel input-signal value $x_{3-(p2,\ q)}$.

With regard to the first pixel $Px_{(p,\ q)-1}$ pertaining to the (p, q)th pixel group $PG_{(p,\ q)}$, the signal processing section 20 generates the following sub-pixel output signals:

a first sub-pixel output signal provided with a first sub-pixel output-signal value $X_{1-(p1,\ q)}$ and used for determining the display gradation of the first sub-pixel a second sub-pixel output signal provided with a second sub-pixel output-signal value $X_{2-(p1,\ q)}$ and used for determining the display gradation of the second sub-pixel G; and a third sub-pixel output signal provided with a third sub-pixel output-signal value $X_{3-(p1,\ q)}$ and used for determining the display gradation of the third sub-pixel B.

In addition, with regard to the second pixel $Px_{(p,\ q)-2}$ pertaining to the (p, q)th pixel group $PG_{(p,\ q)}$, on the other hand, the signal processing section 20 generates the following sub-pixel output signals:

a first sub-pixel output signal provided with a first sub-pixel output-signal value $X_{1-(p2,\ q)}$ and used for determining the display gradation of the first sub-pixel R;

a second sub-pixel output signal provided with a second sub-pixel output-signal value $X_{2-(p2,\ q)}$ and used for determining the display gradation of the second sub-pixel G; and a third sub-pixel output signal provided with a third sub-pixel output-signal value $X_{3-(p2,\ q)}$ and used for determining the display gradation of the third sub-pixel B.

On top of that, with regard to the fourth sub-pixel W pertaining to the (p, q)th pixel group $PG_{(p,\ q)}$, the signal processing section 20 generates a fourth sub-pixel output signal provided with a fourth sub-pixel output-signal value $X_{4-(p,\ q)}$ and used for determining the display gradation of the fourth sub-pixel W.

In the case of the first embodiment, for every pixel group PG, the signal processing section 20 finds the fourth sub-pixel output signal cited above on the basis of the first sub-pixel input signal, the second sub-pixel input signal and the third sub-pixel input signal which are received for the first pixel $Px_1$ pertaining to the pixel group PG and on the basis of the first sub-pixel input signal, the second sub-pixel input signal and the third sub-pixel input signal which are received for the second pixel $Px_2$ pertaining to the pixel group PG and supplies the fourth sub-pixel output signal to the image display panel driving circuit 40.

To put it more concretely, in the case of the first embodiment which implements the (1-A)th mode, the signal processing section 20 finds the fourth sub-pixel output signal on the basis of a first signal value $SG_{(p,\ q)-1}$ found from the first sub-pixel input signal, the second sub-pixel input signal and the third sub-pixel input signal which are received for the first pixel $Px_1$ pertaining to the pixel group PG and on the basis of a second signal value $SG_{(p,\ q)-2}$ found from the first sub-pixel input signal, the second sub-pixel input signal and the third sub-pixel input signal which are received for the second pixel $Px_2$ pertaining to the pixel group PG and supplies the fourth sub-pixel output signal to the image display panel driving circuit 40.

In addition, the first embodiment also implements a configuration according to the (1-A-1)th mode as described above. That is to say, in the case of the first embodiment, the first signal value $SG_{(p,\ q)-1}$ is determined on the basis of a first minimum value $Min_{(p,\ q)-1}$ whereas the second signal value $SG_{(p,\ q)-2}$ is determined on the basis of a second minimum value $Min_{(p,\ q)-2}$. The first minimum value $Min_{(p,\ q)-1}$ cited above is the value smallest among the three sub-pixel input-signal values $x_{1-(p1,\ q)}$, $x_{2-(p1,\ q)}$ and $x_{3-(p1,\ q)}$ whereas the second minimum value $Min_{(p,\ q)-2}$ mentioned above is the value smallest among the three sub-pixel input-signal values $x_{1-(p2,q)}$, $x_{2-(p2,q)}$ and $x_{3-(p2,q)}$.

As will be described later, on the other hand, a first maximum value $Max_{(p, q)-1}$ is the value largest among the three sub-pixel input-signal values $x_{1-(p1, q)}$, $x_{2-(p1, q)}$ and $X_{3-(p1, q)}$ whereas a second maximum value $Max_{(p, q)-2}$ is the value largest among the three sub-pixel input-signal values $x_{1-(p2, q)}$, $x_{2-(p2, q)}$ and $x_{3-(p2, q)}$.

To put it more concretely, the first signal value $SG_{(p, q)-1}$ is determined in accordance with Eq. (11-A) given below whereas the second signal value $SG_{(p, q)-2}$ is determined in accordance with Eq. (11-B) given below even though techniques for finding the first signal value $SG_{(p, q)-1}$ and the second signal value $SG_{(p, q)-2}$ are by no means limited to these equations.

$$SG_{(p,q)-1}=\mathrm{Min}_{(p,q)-1} \tag{11-A}$$

$$SG_{(p,q)-2}=\mathrm{Min}_{(p,q)-2} \tag{11-B}$$

In addition, in the case of the first embodiment, the fourth sub-pixel output-signal value $X_{4-(p, q)}$ is set at an average value which is found from a sum of the first signal value $SG_{(p, q)-1}$ and the second signal value $SG_{(p, q)-2}$ in accordance with the following equation:

$$X_{4-(p,q)}=(SG_{(p,q)-1}+SG_{(p,q)-2})/2 \tag{1-A}$$

In addition, the first embodiment also implements the first configuration described above. That is to say, in the case of the first embodiment, the signal processing section 20 finds:

the first sub-pixel output-signal value $X_{1-(p1, q)}$ on the basis of at least the first sub-pixel input-signal value $x_{1-(p1, q)}$, the first maximum value $Max_{(p, q)-1}$, the first minimum value $Min_{(p, q)-1}$ and the first signal value $SG_{(p, q)-1}$;

the second sub-pixel output-signal value $X_{2-(p, q)}$ on the basis of at least the second sub-pixel input-signal value $X_{2-(p1, q)}$, the first maximum value $Max_{(p, q)-1}$, the first minimum value $Min_{(p, q)-1}$ and the first signal value $SG_{(p, q)-1}$;

the third sub-pixel output-signal value $X_{3-(p1, q)}$ on the basis of at least the third sub-pixel input-signal value $X_{3-(p1, q)}$, the first maximum value $Max_{(p, q)-1}$, the first minimum value $Min_{(p, q)-1}$ and the first signal value $SG_{(p, q)-1}$;

the first sub-pixel output-signal value $X_{1-(p2, q)}$ on the basis of at least the first sub-pixel input-signal value $x_{1-(p2, q)}$, the second maximum value $Max_{(p, q)-2}$, the second minimum value $Min_{(p, q)-2}$ and the second signal value $SG_{(p, q)-2}$;

the second sub-pixel output-signal value $X_{2-(p2, q)}$ on the basis of at least the second sub-pixel input-signal value $x_{2-(p2, q)}$, the second maximum value $Max_{(p, q)-2}$, the second minimum value $Min_{(p, q)-2}$ and the second signal value $SG_{(p, q)-2}$; and the third sub-pixel output-signal value $X_{3-(p2, q)}$ on the basis of at least the third sub-pixel input-signal value $x_{3-(p2, q)}$, the second maximum value $Max_{(p, q)-2}$, the second minimum value $Min_{(p, q)-2}$ and the second signal value $SG_{(p, q)-2}$.

To put it more concretely, in the case of the first embodiment, the signal processing section 20 finds:

the first sub-pixel output-signal value $X_{1-(p1, q)}$ on the basis of $[x_{1-(p1, q)}, Max_{(p, q)-1}, Min_{(p, q)-1}, SG_{(p, q)-1}, \chi]$;

the second sub-pixel output-signal value $X_{2-(p1, q)}$ on the basis of $[x_{2-(p1, q)}, Max_{(p, q)-1}, Min_{(p, q)-1}, SG_{(p, q)-1}, \chi]$;

the third sub-pixel output-signal value $X_{3-(p1, q)}$ on the basis of $[x_{3-(p1, q)}, Max_{(p, q)-1}, Min_{(p, q)-1}, SG_{(p, q)-1}, \chi]$;

the first sub-pixel output-signal value $X_{1-(p2, q)}$ on the basis of $[x_{1-(p2, q)}, Max_{(p, q)-2}, Min_{(p, q)-2}, SG_{(p, q)-2}, \chi]$;

the second sub-pixel output-signal value $X_{2-(p2, q)}$ on the basis of $[x_{2-(p2, q)}, Max_{(p, q)-2}, Min_{(p, q)-2}, SG_{(p, q)-2}, \chi]$; and the third sub-pixel output-signal value $X_{3-(p2, q)}$ on the basis of $[x_{3-(p2, q)}, Max_{(p, q)-2}, Min_{(p, q)-2}, SG_{(p, q)-2}, \chi]$;

As an example, with regard to the first pixel $Px_{(p, q)-1}$ pertaining to a pixel group $PG_{(p, q)}$, the signal processing section 20 receives sub-pixel input-signal values typically satisfying a relation (12-A) given below and, with regard to the second pixel $Px_{(p, q)-2}$ pertaining to the pixel group $PG_{(p, q)}$, the signal processing section 20 receives sub-pixel input-signal values typically satisfying a relation (12-B) given as follows:

$$x_{3-(p1,q)}<x_{1-(p1,q)}<x_{2-(p1,q)} \tag{12-A}$$

$$x_{2-(p2,q)}<x_{3-(p2,q)}<x_{1-(p2,q)} \tag{12-B}$$

In this case, the first minimum value $Min_{(p, q)-1}$ and the second minimum value $Min_{(p, q)-2}$ are set as follows:

$$\mathrm{Min}_{(p,q)-1}=x_{3-(p1,q)} \tag{13-A}$$

$$\mathrm{Min}_{(p,q)-2}=x_{2-(p2,q)} \tag{13-B}$$

Then, the signal processing section 20 determines the first signal value $SG_{(p, q)-1}$ on the basis of the first minimum value $Min_{(p, q)-1}$ in accordance with Eq. (14-A) given below and the second signal value $SG_{(p, q)-2}$ on the basis of the second minimum value $Min_{(p, q)-2}$ in accordance with Eq. (14-B) given as follows:

$$\begin{aligned} SG_{(p,q)-1} &= \mathrm{Min}_{(p-q)-1} \\ &= x_{3-(p1,q)} \end{aligned} \tag{14-A}$$

$$\begin{aligned} SG_{(p,q)-2} &= \mathrm{Min}_{(p-q)-2} \\ &= x_{2-(p2,q)} \end{aligned} \tag{14-B}$$

In addition, the signal processing section 20 finds the fourth sub-pixel output-signal value $X_{4-(p, q)}$ in accordance with Eq. (15) given as follows:

$$\begin{aligned} X_{4-(p,q)} &= \frac{(SG_{(p,q)-1}+SG_{(p,q)-2})}{2} \\ &= \frac{(x_{3-(p1,q)}+x_{2-(p2,q)})}{2} \end{aligned} \tag{15}$$

By the way, with regard to the luminance based on the values of the sub-pixel input signals and the values of the sub-pixel output signals, in order to meet a requirement of not changing the chromaticity, it is necessary to satisfy the equations given below. In the equations, each of the first signal value $SG_{(p, q)-1}$ and the second signal value $SG_{(p, q)-2}$ is multiplied by the constant $\chi$ in order to make the fourth sub-pixel brighter than the other sub-pixels by $\chi$ times as will be described later.

$$x_{1-(p1,q)}/\mathrm{Max}_{(p,q)-1}=(X_{1-(p1,q)}+\chi\cdot SG_{(p,q)-1})/(\mathrm{Max}_{(p,q)-1}+\chi\cdot SG_{(p,q)-1}) \tag{16-A}$$

$$x_{2-(p1,q)}/\mathrm{Max}_{(p,q)-1}=(X_{2-(p1,q)}+\chi\cdot SG_{(p,q)-1})/(\mathrm{Max}_{(p,q)-1}+\chi\cdot SG_{(p,q)-1}) \tag{16-B}$$

$$x_{3-(p1,q)}/\mathrm{Max}_{(p,q)-1}=(X_{3-(p1,q)}+\chi\cdot SG_{(p,q)-1})/(\mathrm{Max}_{(p,q)-1}+\chi\cdot SG_{(p,q)-1}) \tag{16-C}$$

$$x_{1-(p2,q)}/\mathrm{Max}_{(p,q)-2}=(X_{1-(p2,q)}+\chi\cdot SG_{(p,q)-2})/(\mathrm{Max}_{(p,q)-2}+\chi\cdot SG_{(p,q)-2}) \tag{16-D}$$

$$x_{2-(p2,q)}/\mathrm{Max}_{(p,q)-2}=(X_{2-(p2,q)}+\chi\cdot SG_{(p,q)-2})/(\mathrm{Max}_{(p,q)-2}+\chi\cdot SG_{(p,q)-2}) \tag{16-E}$$

$$x_{3-(p2,q)}/\mathrm{Max}_{(p,q)-2}=(X_{3-(p2,q)}+\chi\cdot SG_{(p,1)-2})/(\mathrm{Max}_{(p,q)-2}+\chi\cdot SG_{(p,q)-2}) \tag{16-F}$$

It is to be noted that the constant $\chi$ cited above is expressed as follows:

$$\chi = BN_4/BN_{1\text{-}3}$$

In the above equation, reference notation $BN_{1\text{-}3}$ denotes the luminance of light emitted by a pixel serving as a set of first, second and third sub-pixels for a case in which it is assumed that a first sub-pixel input signal having a value corresponding to the maximum signal value of a first sub-pixel output signal is received for the first sub-pixel, a second sub-pixel input signal having a value corresponding to the maximum signal value of a second sub-pixel output signal is received for the second sub-pixel and a third sub-pixel input signal having a value corresponding to the maximum signal value of a third sub-pixel output signal is received for the third sub-pixel. On the other hand, reference notation $BN_4$ denotes the luminance of light emitted by a fourth sub-pixel for a case in which it is assumed that a fourth sub-pixel input signal having a value corresponding to the maximum signal value of a fourth sub-pixel output signal is received for the fourth sub-pixel.

In this case, the constant $\chi$ has a value peculiar to the image display panel 30, the image display apparatus employing the image display panel 30 and the image display apparatus assembly including the image display apparatus and is, thus, determined uniquely in accordance with the image display panel 30, the image display apparatus and the image display apparatus assembly.

To put it more concretely, in the case of the first embodiment and the second to tenth embodiments to be described later, the constant $\chi$ cited above is expressed as follows:

$$\chi = BN_4/BN_{1\text{-}3} = 1.5$$

In the above equation, reference notation $BN_{1\text{-}3}$ denotes the luminance of the white color for a case in which it is assumed that a first sub-pixel input signal having a value $x_{1-(p,\ q)}$ corresponding to the maximum display gradation of a first sub-pixel is received for the first sub-pixel, a second sub-pixel input signal having a value $x_{2-(p,\ q)}$ corresponding to the maximum display gradation of a second sub-pixel is received for the second sub-pixel and a third sub-pixel input signal having a value $x_{3-(p,\ q)}$ corresponding to the maximum display gradation of a third sub-pixel is received for the third sub-pixel. The signal value $x_{1-(p,\ q)}$ corresponding to the maximum display gradation of the first sub-pixel, the signal value $x_{2-(p,\ q)}$ corresponding to the maximum display gradation of the second sub-pixel and the third signal value $x_{3-(p,\ q)}$ corresponding to the maximum display gradation of the third sub-pixel are given as follows:

$$x_{1-(p,q)} = 255,$$

$$x_{2-(p,q)} = 255 \text{ and}$$

$$x_{3-(p,q)} = 255$$

On the other hand, reference notation $BN_4$ denotes the luminance of light emitted by a fourth sub-pixel for a case in which it is assumed that a fourth sub-pixel input signal having a value corresponding to the maximum display gradation of 255 set for a fourth sub-pixel is received for the fourth sub-pixel.

The values of the sub-pixel output signals can be found in accordance with Eqs. (17-A) to (17-F) which are derived from Eqs. (16-A) to (16-F) respectively.

$$X_{1-(p1,q)} = \{x_{1-(p1,q)} \cdot (\mathrm{Max}_{(p,q)-1} + \chi \cdot SG_{(p,q)-1})\} / \mathrm{Max}_{(p,q)-1} - \chi \cdot SG_{(p,q)-1} \quad (17\text{-A})$$

$$X_{2-(p1,q)} = \{x_{2-(p1,q)} \cdot (\mathrm{Max}_{(p,q)-1} + \chi \cdot SG_{(p,q)-1})\} / \mathrm{Max}_{(p,q)-1} - \chi \cdot SG_{(p,q)-1} \quad (17\text{-B})$$

$$X_{3-(p1,q)} = \{x_{3-(p1,q)} \cdot (\mathrm{Max}_{(p,q)-1} + \chi \cdot SG_{(p,q)-1})\} / \mathrm{Max}_{(p,q)-1} - \chi \cdot SG_{(p,q)-1} \quad (17\text{-C})$$

$$X_{1-(p2,q)} = \{x_{1-(p2,q)} \cdot (\mathrm{Max}_{(p,q)-2} + \chi \cdot SG_{(p,q)-2})\} / \mathrm{Max}_{(p,q)-2} - \chi \cdot SG_{(p,q)-2} \quad (17\text{-D})$$

$$X_{2-(p2,q)} = \{x_{2-(p2,q)} \cdot (\mathrm{Max}_{(p,q)-2} + \chi \cdot SG_{(p,q)-2})\} / \mathrm{Max}_{(p,q)-2} - \chi \cdot SG_{p,q)-2} \quad (17\text{-E})$$

$$X_{3-(p2,q)} = \{x_{3-(p2,q)} \cdot (\mathrm{Max}_{(p,q)-2} + \chi \cdot SG_{(p,q)-2})\} / \mathrm{Max}_{(p,q)-2} - \chi \cdot SG_{(p,q)-2} \quad (17\text{-F})$$

Figure 6:
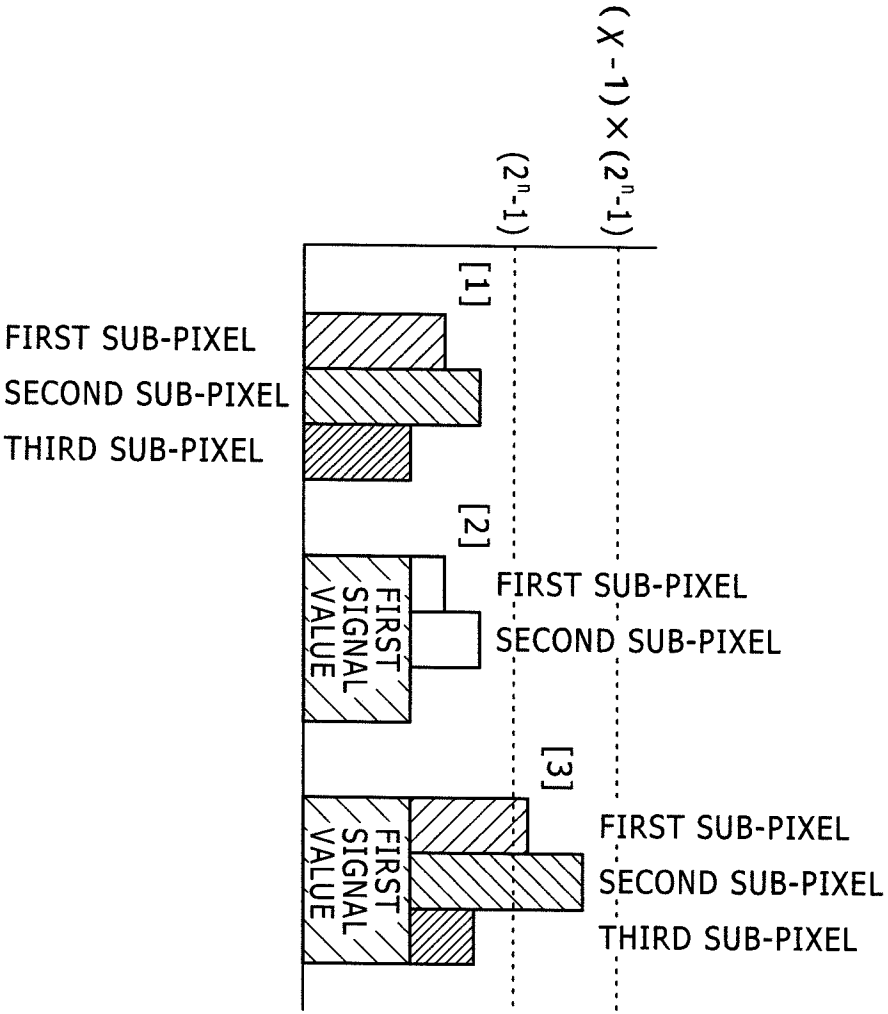
FIG. 6 is a model diagram showing sub-pixel input-signal values and sub-pixel output-signal values in a method for driving the image display apparatus according to the first embodiment.

Notation [1] shown in a diagram of FIG. 6 represents the values of sub-pixel input signals received for a pixel serving as a set which includes the first, second and third sub-pixels. Notation [2] represents a state obtained as a result of subtracting the first signal value $SG_{(p,\ q)-1}$ from the values of the sub-pixel input signals received for the pixel serving as a set which includes the first, second and third sub-pixels. Notation [3] represents sub-pixel output-signal values computed in accordance with Eqs. (17-A), (17-B) and (17-C) as the values of the sub-pixel output signals which are supplied to the pixel serving as a set including the first, second and third sub-pixels.

It is to be noted that the vertical axis of the diagram of FIG. 6 represents the luminance. The luminance $BN_{1\text{-}3}$ of the pixel serving as a set including the first, second and third sub-pixels is $(2^n-1)$. The luminance $BN_{1\text{-}3}$ of the pixel including the additional fourth sub-pixel is $(BN_{1\text{-}3}+BN_4)$ which is expressed as $(\chi+1)\times(2^n-1)$.

The following description explains extension processing to find the sub-pixel output-signal values $X_{1-(p1,\ q)}$, $X_{2-(p1,\ q)}$, $X_{3-(p1,\ q)}$, $X_{1-(p2,\ q)}$, $X_{2-(p2,\ q)}$, $X_{3-(p2,\ q)}$ and $X_{4-(p,\ q)}$ of the sub-pixel output signals for the (p, q)th pixel group $PG_{(p,\ q)}$. It is to be noted that processes to be described below are carried out to sustain ratios among the luminance of the first elementary color displayed by the first and fourth sub-pixels, the luminance of the second elementary color displayed by the second and fourth sub-pixels and the luminance of the third elementary color displayed by the third and fourth sub-pixels in every entire pixel group PG which includes the first pixel $Px_1$ and the second pixel $Px_2$. In addition, the processes are carried out to keep (or sustain) also the color hues. On top of that, the processes are carried out also to sustain (or hold) gradation-luminance characteristics, that is, gamma and $\gamma$ characteristics.

Process 100

First of all, the signal processing section 20 finds the first signal value $SG_{(p,\ q)-1}$ and the second signal value $SG_{(p,\ q)-2}$ for every pixel group $PG_{(p,\ q)}$ on the basis of the values of sub-pixel input signals received for the pixel group $PG_{(p,\ q)}$ in accordance with respectively Eqs. (11-A) and (11-B) shown below. The signal processing section 20 carries out this process for all (P×Q) pixel groups $PG_{(p,\ q)}$. Then, the signal processing section 20 finds the fourth sub-pixel output-signal value $X_{4-(p,\ q)}$ in accordance with Eq. (1-A) shown below.

$$SG_{(p,q)-1} = \mathrm{Min}_{(p,q)-1} \quad (11\text{-A})$$

$$SG_{(p,q)-2} = \mathrm{Min}_{(p,q)-2} \quad (11\text{-B})$$

$$X_{4-(p,q)} = (SG_{(p,q)-1} + SG_{(p,q)-2})/2 \quad (1\text{-A})$$

Process 110

Subsequently, the signal processing section 20 finds the sub-pixel output-signal values $X_{1-(p1,\ q)}$, $X_{2-(p1,\ q)}$, $X_{3-(p1,\ q)}$, $X_{1-(p2,\ q)}$, $X_{2-(p2,\ q)}$ and $X_{3-(p2,\ q)}$ in accordance with Eqs. (17-A) to (17-F) respectively on the basis of the first signal value $SG_{(p,\ q)-1}$ and the second signal value $SG_{(p,\ q)-2}$ which have been found for every pixel group $PG_{(p,\ q)}$. The signal processing section 20 carries out this process for all (P×Q) pixel groups $PG_{(p,q)}$. Then, the signal processing section 20 supplies the sub-pixel output-signal values found in this way to the sub-pixels by way of the image display panel driving circuit 40.

It is to be noted that the ratios among sub-pixel output-signal values for the first pixel $Px_1$ pertaining to a pixel group PG are defined as follows:

$$X_{1-(p1,q)}:X_{2-(p1,q)}:X_{3-(p1,q)}.$$

By the same token, the ratios among sub-pixel output-signal values for the second pixel $Px_2$ pertaining to a pixel group PG are defined as follows:

$$X_{1-(p2,q)}:X_{2-(p2,q)}:X_{3-(p2,q)}.$$

In the same way, the ratios among sub-pixel input-signal values for the first pixel $Px_1$ pertaining to a pixel group PG are defined as follows:

$$x_{1-(p1,q)}:x_{2-(p1,q)}:x_{3-(p1,q)}.$$

Likewise, the ratios among sub-pixel input-signal values for the second pixel $Px_2$ pertaining to a pixel group PG are defined as follows:

$$x_{1-(p2,q)}:x_{2-(p2,q)}:x_{3-(p2,q)}.$$

The ratios among sub-pixel output-signal values for the first pixel $Px_1$ are a little bit different from the ratios among sub-pixel input-signal values for the first pixel $Px_1$ whereas the ratios among sub-pixel output-signal values for the second pixel $Px_2$ are a little bit different from the ratios among sub-pixel input-signal values for the second pixel $Px_2$. Thus, if every pixel is observed independently, the color hue for a sub-pixel input signal varies a little bit from pixel to pixel. If an entire pixel group PG is observed, however, the color hue does not vary from pixel group to pixel group. In processes explained in the following description, this phenomenon occurs similarly.

A control coefficient $\beta_0$ for controlling the luminance of illumination light radiated by the planar light-source apparatus 50 is found in accordance with Eq. (18) given below. In the equation, notation $X_{max}$ denotes the largest value among the values of the sub-pixel output signals generated for all (P×Q) pixel groups $PG_{(p,q)}$.

$$\beta_0=X_{max}/(2^n-1) \tag{18}$$

In accordance with the image display apparatus assembly according to the first embodiment and the method for driving the image display apparatus assembly, each of the sub-pixel output-signal values $X_{1-(p1,q)}$, $X_{2-(p1,q)}$, $X_{3-(p1,q)}$, $X_{1-(p2,q)}$, $X_{2-(p2,q)}$ and $X_{3-(p2,q)}$ for the (p, q)th pixel group PG is extended by $\beta_0$ times. Therefore, in order to set the luminance of a displayed image at the same level as the luminance of an image displayed without extending each of the sub-pixel output-signal values, the luminance of illumination light radiated by the planar light-source apparatus 50 needs to be reduced by $(1/\beta_0)$ times. As a result, the power consumption of the planar light-source apparatus 50 can be decreased.

In accordance with the method for driving the image display apparatus according to the first embodiment and the method for driving the image display apparatus assembly employing the image display apparatus, for every pixel group PG, the signal processing section 20 finds the value of the fourth sub-pixel output signal on the basis of the first signal value $SG_{(p,q)-1}$ found from the values of the first, second and third sub-pixel input signals received for the first pixel $Px_1$ pertaining to the pixel group PG and on the basis of the second signal value $SG_{(p,q)-2}$ found from the values of the first, second and third sub-pixel input signals received for the second pixel $Px_2$ pertaining to the pixel group PG, supplying the fourth sub-pixel output signal to the image display panel driving circuit 40. That is to say, the signal processing section 20 finds the value of the fourth sub-pixel output signal on the basis of the values of sub-pixel input signals received for the first pixel $Px_1$ and the second pixel $Px_2$ which are adjacent to each other. Thus, the sub-pixel output signal for the fourth sub-pixel can be optimized. In addition, since one fourth sub-pixel is provided for each pixel group PG having at least a first pixel $Px_1$ and a second pixel $Px_2$, the area of the aperture of every sub-pixel can be further prevented from decreasing. As a result, the luminance can be raised with a high degree of reliability and the quality of the displayed image can be improved.

For example, in accordance with technologies disclosed in Japanese Patent No. 3,167,026 and Japanese Patent No. 3,805,150 as technologies setting the first-direction length of each pixel at $L_1$, it is necessary to divide every pixel into four sub-pixels. Thus, the first-direction length of a sub-pixel is 0.25 $L_1$ (=$L_1$/4).

In the case of the first embodiment, on the other hand, the first-direction length of a sub-pixel is 0.286 $L_1$, (=2$L_1$/7). Thus, in comparison with the technologies disclosed in Japanese Patent No. 3167026 and Japanese Patent No. 3805150, the first-direction length of a sub-pixel in the first embodiment is increased by 14%.

By the way, if the difference between the first minimum value $Min_{(p,q)-1}$ of the first pixel $Px_{(p,q)-1}$ and the second minimum value $Min_{(p,q)-2}$ of the second pixel $Px_{(p,q)-2}$ is large, the use of Eq. (1-A) may result in a case in which the luminance of light emitted by the fourth sub-pixel does not increase to a desired level. In order to avoid such a case, it is desirable to find the fourth sub-pixel output-signal value $X_{4-(p,q)}$ in accordance with Eq. (1-B) given below in place of Eq. (1-A).

$$X_{4-(p,q)}=C_1\cdot SG_{(p,q)-1}+C_2\cdot SG_{(p,q)-2} \tag{1-B}$$

In the above equation, each of notations $C_1$ and $C_2$ denotes a constant used as a weight. The fourth sub-pixel output-signal value $X_{4-(p,q)}$ satisfies the relation $X_{4-(p,q)}\leq(2^n-1)$. If the value of the expression $(C_1\cdot SG_{(p,q)-1}+C_2\cdot SG_{(p,q)-2}$ is greater than $(2^n-1)$(that is, for $(C_1\cdot SG_{(p,q)-1}+C_2\cdot SG_{(p,q)-2}>(2^n-1))$, the fourth sub-pixel output-signal value $X_{4-(p,q)}$ is set at $(2^n-1)$ (that is, $X_{4-(p,q)}=(2^n-1)$). It is to be noted that the constants $C_1$ and $C_2$ each used as a weight may be changed in accordance with the first signal value $SG_{(p,q)-1}$ and the second signal value $SG_{(p,q)-2}$. As an alternative, the fourth sub-pixel output-signal value $X_{4-(p,q)}$ is found as the root of the average of the sum of the squared first signal value $SG_{(p,q)-1}$ and the squared second signal value $SG_{(p,q)-2}$ as follows:

$$X_{4-(p,q)}=[(SG_{(p,q)-1}^2+SG_{(p,q)-2}^2)/2]^{1/2} \tag{1-C}$$

As another alternative, the fourth sub-pixel output-signal value $X_{4-(p,q)}$ is found as the root of the product of the first signal value $SG_{(p,q)-1}$ and the second signal value $SG_{(p,q)-2}$ as follows:

$$X_{4-(p,q)}=(SG_{(p,q)-1}\cdot SG_{(p,q)-2})^{1/2} \tag{1-D}$$

For example, the image display apparatus and/or the image display apparatus assembly employing the image display apparatus are prototyped and, typically, an image observer evaluates the image displayed by the image display apparatus and/or the image display apparatus assembly. Finally, the image observer properly determines an equation to be used to express the fourth sub-pixel output-signal value $X_{4-(p,q)}$.

In addition, if desired, the sub-pixel output-signal values $X_{1-(p1,\ q)}$, $X_{2-(p1,\ q)}$, $X_{3-(p1,\ q)}$, $X_{1-(p2,\ q)}$, $X_{2-(p2,\ q)}$ and $X_{3-(p2,\ q)}$ can be found as the values of the following expressions respectively:

$$[x_{1-(p1,q)}, x_{1-(p2,q)}, \mathrm{Max}_{(p,q)-1}, \mathrm{Min}_{(p,q)-1}, SG_{(p,q)-1}, \chi];$$

$$[x_{2-(p1,q)}, x_{2-(p2,q)}, \mathrm{Max}_{(p,q)-1}, \mathrm{Min}_{(p,q)-1}, SG_{(p,q)-1}, \chi];$$

$$[x_{3-(p1,q)}, x_{3-(p2,q)}, \mathrm{Max}_{(p,q)-1}, \mathrm{Min}_{(p,q)-1}, SG_{(p,q)-1}, \chi];$$

$$[x_{1-(p2,q)}, x_{1-(p1,q)}, \mathrm{Max}_{(p,q)-2}, \mathrm{Min}_{(p,q)-2}, SG_{(p,q)-2}, \chi];$$

$$[x_{2-(p2,q)}, x_{2-(p1,q)}, \mathrm{Max}_{(p,q)-2}, \mathrm{Min}_{(p,q)-2}, SG_{(p,q)-2}, \chi];$$

and $$[x_{3-(p2,q)}, x_{3-(p1,q)}, \mathrm{Max}_{(p,q)-2}, \mathrm{Min}_{(p,q)-2}, SG_{(p,q)-2}, \chi].$$

To put it more concretely, the sub-pixel output-signal values $X_{1-(p1,\ q)}$, $X_{2-(p1,\ q)}$, $X_{3-(p1,\ q)}$, $X_{1-(p2,\ q)}$, $X_{2-(p2,\ q)}$ and $X_{3-(p2,\ q)}$ are found in accordance with respectively Eqs. (19-A) to (19-F) given below in place of aforementioned Eqs. (17-A) to (17-F) respectively. It is to be noted that, in Eqs. (19-A) to (19-F), each of notations $C_{111}$, $C_{112}$, $C_{121}$, $C_{122}$, $C_{131}$, $C_{132}$, $C_{211}$, $C_{212}$, $C_{221}$, $C_{222}$, $C_{231}$ and $C_{232}$ denotes a constant.

$$X_{1-(p1,q)}=\{(C_{111}\cdot x_{1-(p1,q)}+C_{112}\cdot x_{1-(p2,q)})\cdot(\mathrm{Max}_{(p,q)-1}+\chi\cdot SG_{(p,q)-1})\}/\mathrm{Max}_{(p,q)-1}-\chi\cdot SG_{(p,q)-1} \quad (19\text{-A})$$

$$X_{2-(p1,q)}=\{(C_{121}\cdot x_{2-(p1,q)}+C_{122}\cdot x_{2-(p2,q)})\cdot(\mathrm{Max}_{(p,q)-1}+\chi\cdot SG_{(p,q)-1})\}/\mathrm{Max}_{(p,q)-1}-\chi\cdot SG_{(p,q)-1} \quad (19\text{-B})$$

$$X_{3-(p1,q)}=\{(C_{131}\cdot x_{3-(p1,q)}+C_{132}\cdot x_{3-(p2,q)})\cdot(\mathrm{Max}_{(p,q)-1}+\chi\cdot SG_{(p,q)-1})\}/\mathrm{Max}_{(p,q)-1}-\chi\cdot SG_{(p,q)-1} \quad (19\text{-C})$$

$$X_{1-(p2,q)}=\{(C_{211}\cdot x_{1-(p1,q)}+C_{212}\cdot x_{1-(p2,q)})\cdot(\mathrm{Max}_{(p,q)-2}+\chi\cdot SG_{(p,q)-2})\}/\mathrm{Max}_{(p,q)-2}-\chi\cdot SG_{(p,q)-2} \quad (19\text{-D})$$

$$X_{2-(p2,q)}=\{(C_{221}\cdot x_{2-(p1,q)}+C_{222}\cdot x_{2-(p2,q)})\cdot(\mathrm{Max}_{(p,q)-2}+\chi\cdot SG_{(p,q)-2})\}/\mathrm{Max}_{(p,q)-2}-\chi\cdot SG_{(p,q)-2} \quad (19\text{-E})$$

$$X_{3-(p2,q)}=\{(C_{231}\cdot x_{3-(p1,q)}+C_{232}\cdot x_{3-(p2,q)})\cdot(\mathrm{Max}_{(p,q)-2}+\chi\cdot SG_{(p,q)-2})\}/\mathrm{Max}_{(p,q)-2}-\chi\cdot SG_{(p,q)-2} \quad (19\text{-F})$$

Second Embodiment

A second embodiment is obtained as a modified version of the first embodiment. To be more specific, the second embodiment is obtained as a modified version of the array consisting of the first pixel $Px_1$, the second pixel $Px_2$ and the fourth sub-pixel W. That is to say, in the case of the second embodiment, as shown in a model diagram of FIG. 2 in which the row direction is taken as the first direction whereas the column direction is taken as the second direction, it is possible to provide a configuration in which the first pixel $Px_1$ on the q'th column is placed at a location adjacent to the location of the second pixel $Px_2$ on the (q'+1)th column whereas the fourth sub-pixel W on the q'th column is placed at a location not adjacent to the location of the fourth sub-pixel W on the (q'+1)th column where notation q' denotes an integer satisfying the relations $1 \le q' \le (Q-1)$.

Except for the difference described above as a difference of the array consisting of the first pixel $Px_1$, the second pixel $Px_2$ and the fourth sub-pixel W, an image display panel according to the second embodiment, a method for driving an image display apparatus employing the image display panel and a method for driving an image display apparatus assembly including the image display apparatus are identical with respectively the image display panel according to the first embodiment, the method for driving the image display apparatus employing the image display panel and the method for driving the image display apparatus assembly including the image display apparatus.

Third Embodiment

A third embodiment is also obtained as a modified version of the first embodiment. To be more specific, the third embodiment is obtained as a modified version of the array consisting of the first pixel $Px_1$, the second pixel $Px_2$ and the fourth sub-pixel W. That is to say, in the case of the third embodiment, as shown in a model diagram of FIG. 3 in which the row direction is taken as the first direction whereas the column direction is taken as the second direction, it is possible to provide a configuration in which the first pixel $Px_1$ on the q'th column is placed at a location adjacent to the location of the first pixel $Px_1$ on the (q'+1)th column whereas the fourth sub-pixel W on the q'th column is placed at a location adjacent to the location of the fourth sub-pixel W on the (q'+1)th column where notation q' denotes an integer satisfying the relations $1 \le q' \le (Q-1)$. In typical examples shown in FIGS. 3 and 5, the first sub-pixel, the second sub-pixel, the third sub-pixel and the fourth sub-pixel are laid out to form an array which resembles a stripe array.

Except for the difference described above as a difference of the array consisting of the first pixel $Px_1$, the second pixel $Px_2$ and the fourth sub-pixel W, an image display panel according to the third embodiment, a method for driving an image display apparatus employing the image display panel and a method for driving an image display apparatus assembly including the image display apparatus are identical with respectively the image display panel according to the first embodiment, the method for driving the image display apparatus employing the image display panel and the method for driving the image display apparatus assembly including the image display apparatus.

Fourth Embodiment

A fourth embodiment is also obtained as a modified version of the first embodiment. However, the fourth embodiment implements the configuration according to the (1-A-2)th mode and the second configuration, which have been described earlier.

An image display apparatus 10 according to the fourth embodiment also employs an image display panel 30 and a signal processing section 20. An image display apparatus assembly according to the fourth embodiment has the image display apparatus 10 and a planar light-source apparatus 50 for radiating illumination light to the rear face of the image display panel 30 employed in the image display apparatus 10. The image display panel 30, the signal processing section 20 and the planar light-source apparatus 50, which are employed in the image display apparatus 10 according to the fourth embodiment, can be made identical with respectively the image display panel 30, the signal processing section 20 and the planar light-source apparatus 50, which are employed in the image display apparatus 10 according to the first embodiment. Thus, detailed description of the image display panel 30, the signal processing section 20 and the planar light-source apparatus 50, which are employed in the image display apparatus 10 according to the fourth embodiment, is omitted in order to avoid duplications of explanations.

The signal processing section 20 employed in the image display apparatus 10 according to the fourth embodiment carries out the following processes of:

(B-1): finding the saturation S and the brightness/lightness value V(S) for each of a plurality of pixels on the basis of the signal values of sub-pixel input signals received for the pixels;

(B-2): finding an extension coefficient $\alpha_0$ on the basis of at least one of ratios $V_{max}(S)/V(S)$ found for the pixels;

(B-3-1): finding the first signal value $SG_{(p,q)-1}$ on the basis of at least the sub-pixel input-signal values $x_{1-(p1,q)}$, $x_{2-(p1,q)}$ and $x_{3-(p1,q)}$;

(B-3-2): finding the second signal value $SG_{(p,q)-2}$ on the basis of at least the sub-pixel input-signal values $x_{1-(p2,q)}$, $x_{2-(p2,q)}$ and $x_{3-(p2,q)}$;

(B-4-1): finding the first sub-pixel output-signal value $X_{1-(p1,q)}$ on the basis of at least the first sub-pixel input-signal value $x_{1-(p1,q)}$, the extension coefficient $\alpha_0$ and the first signal value $SG_{(p,q)-1}$;

(B-4-2): finding the second sub-pixel output-signal value $X_{2-(p1,q)}$ on the basis of at least the second sub-pixel input-signal value $x_{2-(p1,q)}$, the extension coefficient $\alpha_0$ and the first signal value $SG_{(p,q)-1}$;

(B-4-3): finding the third sub-pixel output-signal value $X_{3-(p1,q)}$ on the basis of at least the third sub-pixel input-signal value $x_{3-(p1,q)}$, the extension coefficient $\alpha_0$ and the first signal value $SG_{(p,q)-1}$;

(B-4-4): finding the first sub-pixel output-signal value $X_{1-(p2,q)}$ on the basis of at least the first sub-pixel input-signal value $X_{1-(p2,q)}$, the extension coefficient $\alpha_0$ and the second signal value $SG_{(p,q)-2}$;

(B-4-5): finding the second sub-pixel output-signal value $X_{2-(p2,q)}$ on the basis of at least the second sub-pixel input-signal value $x_{2-(p2,q)}$, the extension coefficient $\alpha_0$ and the second signal value $SG_{(p,q)-2}$; and (B-4-6): finding the third sub-pixel output-signal value $X_{3-(p2,q)}$ on the basis of at least the third sub-pixel input-signal value $x_{3-(p2,q)}$, the extension coefficient $\alpha_0$ and the second signal value $SG_{(p,q)-2}$.

As described above, the fourth embodiment implements the configuration according to the (1-A-2)th mode. That is to say, in the case of the fourth embodiment, the signal processing section 20 determines the first signal value $SG_{(p,q)-1}$ on the basis of the saturation $S_{(p,q)-1}$ and the brightness/lightness value $V_{(p,q)-1}$ in the HSV color space as well as on the basis of the constant $\chi$ which is dependent on the image display apparatus 10. In addition, the signal processing section 20 also determines the second signal value $SG_{(p,q)-2}$ on the basis of the saturation $S_{(p,q)-2}$ and the brightness/lightness value $V_{(p,q)-2}$ in the HSV color space as well as on the basis of the constant $\chi$.

The saturations $S_{(p,q)-1}$ and $S_{(p,q)-2}$ cited above are expressed by respectively Eqs. (41-1) and (41-3) given below whereas the brightness/lightness values $V_{(p,q)-1}$ and $V_{(p,q)-2}$ mentioned above are expressed by Eqs. (41-2) and (41-4) respectively as follows:

$$S_{(p,q)-1}=(\mathrm{Max}_{(p,q)-1}-\mathrm{Min}_{(p,q)-1})/\mathrm{Max}_{(p,q)-1} \quad (41\text{-}1)$$

$$V_{(p,q)-1}=\mathrm{Max}_{(p,q)-1} \quad (41\text{-}2)$$

$$S_{(p,q)-2}=(\mathrm{Max}_{(p,q)-2}-\mathrm{Min}_{(p,q)-2})/\mathrm{Max}_{(p,q)-2} \quad (41\text{-}3)$$

$$V_{(p,q)-2}=\mathrm{Max}_{(p,q)-2} \quad (41\text{-}4)$$

On top of that, the fourth embodiment implements the second configuration as described above. That is to say, a maximum brightness/lightness value $V_{max}(S)$ expressed as a function of variable saturation S to serve as the maximum of a brightness/lightness value V in an HSV color space enlarged by adding the fourth color is stored in the signal processing section 20.

In addition, the signal processing section 20 carries out the following processes of:

(a): finding the saturation S and the brightness/lightness value V(S) for each of a plurality of pixels on the basis of the signal values of sub-pixel input signals received for the pixels;

(b): finding an extension coefficient $\alpha_0$ on the basis of at least one of ratios $V_{max}(S)/V(S)$ found for the pixels;

(c1): finding the first signal value $SG_{(p,q)-1}$ on the basis of at least the sub-pixel input-signal values $x_{1-(p1,q)}$, $x_{2-(p1,q)}$ and $x_{3-(p1,q)}$;

(c2): finding the second signal value $SG_{(p,q)-2}$ on the basis of at least the sub-pixel input-signal values $x_{1-(p2,q)}$, $x_{2-(p2,q)}$ and $x_{3-(p2,q)}$;

(d1): finding the first sub-pixel output-signal value $X_{1-(p1,q)}$ on the basis of at least the first sub-pixel input-signal value $x_{1-(p1,q)}$, the extension coefficient $\alpha_0$ and the first signal value $SG_{(p,q)-1}$;

(d2): finding the second sub-pixel output-signal value $X_{2-(p1,q)}$ on the basis of at least the second sub-pixel input-signal value $x_{2-(p1,q)}$, the extension coefficient $\alpha_0$ and the first signal value $SG_{(p,q)-1}$;

(d3): finding the third sub-pixel output-signal value $X_{3-(p1,q)}$ on the basis of at least the third sub-pixel input-signal value $x_{3-(p1,q)}$, the extension coefficient $\alpha_0$ and the first signal value $SG_{(p,q)-1}$;

(d4): finding the first sub-pixel output-signal value $X_{1-(p2,q)}$ on the basis of at least the first sub-pixel input-signal value $x_{1-(p2,q)}$, the extension coefficient $\alpha_0$ and the second signal value $SG_{(p,q)-2}$;

(d5): finding the second sub-pixel output-signal value $X_{2-(p2,q)}$ on the basis of at least the second sub-pixel input-signal value $x_{2-(p2,q)}$, the extension coefficient $\alpha_0$ and the second signal value $SG_{(p,q)-2}$; and (d6): finding the third sub-pixel output-signal value $X_{3-(p2,q)}$ on the basis of at least the third sub-pixel input-signal value $x_{3-(p2,q)}$, the extension coefficient $\alpha_0$ and the second signal value $SG_{(p,q)-2}$.

As described above, the signal processing section 20 finds the first signal value $SG_{(p,q)-1}$ on the basis of at least the sub-pixel input-signal values $x_{1-(p1,q)}$, $x_{2-(p1,q)}$ and $x_{3-(p1,q)}$. By the same token, the signal processing section 20 finds the second signal value $SG_{(p,q)-2}$ on the basis of at least the sub-pixel input-signal values $x_{1-(p2,q)}$, $x_{2-(p2,q)}$ and $x_{3(p2,q)}$. To put it more concretely, in the case of the fourth embodiment, however, the signal processing section 20 determines the first signal value $SG_{(p,q)-1}$ on the basis of the first minimum value $\mathrm{Min}_{(p,q)-1}$ and the extension coefficient $\alpha_0$. By the same token, the signal processing section 20 determines the second signal value $SG_{(p,q)-2}$ on the basis of the second minimum value $\mathrm{Min}_{(p,q)-2}$ and the extension coefficient $\alpha_0$. To put it even more concretely, the signal processing section 20 determines the first signal value $SG_{(p,q)-1}$ and the second signal value $SG_{(p,q)-2}$ in accordance with respectively Eqs. (42-A) and (42-B) which are given below. It is to be noted that Eqs. (42-A) and (42-B) are derived by setting each of the constants $c_{21}$ and $c_{22}$ used in equations given previously at 1, that is, $c_{21}=1$ and $c_{22}=1$. As is obvious from Eq. (42-A), the first signal value $SG_{(p,q)-1}$ is obtained as a result of dividing the product of the first minimum value $\mathrm{Min}_{(p,q)-1}$ and the extension coefficient $\alpha_0$ by the constant $\chi$. By the same token, the second signal value $SG_{(p,q)-2}$ is obtained as a result of dividing the product of the second minimum value $\mathrm{Min}_{(p,q)-2}$ and the extension coefficient $\alpha_0$ by the constant $\chi$. However, techniques for finding the first signal value $SG_{(p,q)-1}$ and the second signal value $SG_{(p,q)-2}$ are by no means limited to such divisions.

$$SG_{(p,q)-1}=[\mathrm{Min}_{(p,q)-1}]\cdot\alpha_0/\chi \quad (42\text{-A})$$

$$SG_{(p,q)-2}=[\mathrm{Min}_{(p,q)-2}]\cdot\alpha_0\chi \quad (42\text{-B})$$

In addition, as described above, the signal processing section 20 finds the first sub-pixel output-signal value $X_{1-(p1,q)}$ on the basis of at least the first sub-pixel input-signal value $x_{1-(p1,q)}$, the extension coefficient $\alpha_0$ and the first signal value $SG_{(p,q)-1}$. To put it more concretely, the signal processing section 20 finds the first sub-pixel output-signal value $X_{1-(p1,q)}$ on the basis of:

$$[x_{1-(p1,q)},\alpha_0,SG_{(p,q)-1},\chi].$$

By the same token, the signal processing section 20 finds the second sub-pixel output-signal value $X_{2-(p1,q)}$ on the basis of at least the second sub-pixel input-signal value $x_{2-(p1,q)}$, the extension coefficient $\alpha_0$ and the first signal value $SG_{(p,q)-1}$. To put it more concretely, the signal processing section 20 finds the second sub-pixel output-signal value $X_{2-(p1,q)}$ on the basis of:

$$[x_{2-(p1,q)},\alpha_0,SG_{(p,q)-1},\chi].$$

In the same way, the signal processing section 20 finds the third sub-pixel output-signal value $X_{3-(p1,q)}$ on the basis of at least the third sub-pixel input-signal value $x_{3-(p1,q)}$, the extension coefficient $\alpha_0$ and the first signal value $SG_{(p,q)-1}$. To put it more concretely, the signal processing section 20 finds the third sub-pixel output-signal value $X_{3-(p1,q)}$ on the basis of:

$$[x_{3-(p1,q)},\alpha_0,SG_{(p,q)-1},\chi].$$

Likewise, the signal processing section 20 finds the first sub-pixel output-signal value $X_{1-(p2,q)}$ on the basis of at least the first sub-pixel input-signal value $x_{1-(p2,q)}$, the extension coefficient $\alpha_0$ and the second signal value $SG_{(p,q)-2}$. To put it more concretely, the signal processing section 20 finds the first sub-pixel output-signal value $X_{1-(p2,q)}$ on the basis of:

$$[x_{1-(p2,q)},\alpha_0,SG_{(p,q)-2},\chi].$$

Similarly, the signal processing section 20 finds the second sub-pixel output-signal value $X_{2-(p2,q)}$ on the basis of at least the second sub-pixel input-signal value $x_{2-(p2,q)}$, the extension coefficient $\alpha_0$ and the second signal value $SG_{(p,q)-2}$. To put it more concretely, the signal processing section 20 finds the second sub-pixel output-signal value $X_{2-(p2,q)}$ on the basis of:

$$[x_{2-(p2,q)},\alpha_0,SG_{(p,q)-2},\chi].$$

By the same token, the signal processing section 20 finds the third sub-pixel output-signal value $X_{3-(p2,q)}$ on the basis of at least the third sub-pixel input-signal value $x_{3-(p2,q)}$, the extension coefficient $\alpha_0$ and the second signal value $SG_{(p,q)-2}$. To put it more concretely, the signal processing section 20 finds the third sub-pixel output-signal value $X_{3-(p2,q)}$ on the basis of:

$$[x_{3-(p2,q)},\alpha_0,SG_{(p,q)-2},\chi].$$

The signal processing section 20 is capable of finding the sub-pixel output-signal values $X_{1-(p1,q)}$, $X_{2-(p1,q)}$, $X_{3-(p1,q)}$, $X_{1-(p2,q)}$, $X_{2-(p2,q)}$ and $X_{3-(p2,q)}$ on the basis of the extension coefficient $\alpha_0$ and the constant $\chi$. To put it more concretely, the signal processing section is capable of finding the sub-pixel output-signal values $X_{1-(p1,q)}$, $X_{2-(p1,q)}$, $X_{3-(p1,q)}$, $X_{1-(p2,q)}$, $X_{2-(p2,q)}$ and $X_{3-(p2,q)}$ in accordance with the following equations respectively.

$$X_{1-(p1,q)}=\alpha_0-x_{1-(p1,q)}-\chi\cdot SG_{(p,q)-1} \quad (3\text{-A})$$

$$X_{2-(p1,q)}=\alpha_0\cdot x_{2-(p1,q)}-\chi\cdot SG_{(p,q)-1} \quad (3\text{-B})$$

$$X_{3-(p1,q)}=\alpha_0\cdot x_{3-(p1,q)}-\chi\cdot SG_{(p,q)-1} \quad (3\text{-C})$$

$$X_{1-(p2,q)}=\alpha_0\cdot x_{1-(p2,q)}-\chi\cdot SG_{(p,q)-2} \quad (3\text{-D})$$

$$X_{2-(p2,q)}=\alpha_0\cdot x_{2-(p2,q)}-\chi\cdot SG_{(p,q)-2} \quad (3\text{-E})$$

$$X_{3-(p2,q)}=\alpha_0\cdot x_{3-(p2,q)}-\chi\cdot SG_{(p,q)-2} \quad (3\text{-F})$$

In addition, the signal processing section 20 finds the fourth sub-pixel output-signal value $X_{4-(p,q)}$ as an average value which is computed from a sum of the first signal value $SG_{(p,q)-1}$ and the second signal value $SG_{(p,q)-2}$ in accordance with the following equation:

$$X_{4-(p,q)}=(SG_{(p,q)-1}+SG_{(p,q)-2})/2 \quad (2\text{-A})$$

$$=\{[\mathrm{Min}_{(p,q)-1}]\cdot\alpha_0/\chi+[\mathrm{Min}_{(p,q)-2}]\cdot\alpha_0/\chi\}/2 \quad (2\text{-A}')$$

The extension coefficient $\alpha_0$ used in the above equation is determined for every image display frame. In addition, the luminance of illumination light radiated by the planar light-source apparatus 50 is reduced in accordance with the extension coefficient $\alpha_0$.

In the case of the fourth embodiment, a maximum brightness/lightness value $V_{max}(S)$ expressed as a function of variable saturation S to serve as the maximum of a brightness/lightness value V in an HSV color space enlarged by adding the white color serving as the fourth color is stored in the signal processing section 20. That is to say, by adding the fourth color which is the white color, the dynamic range of the brightness/lightness value V in the HSV color space is widened.

These points are described as follows.

Figure 7A:
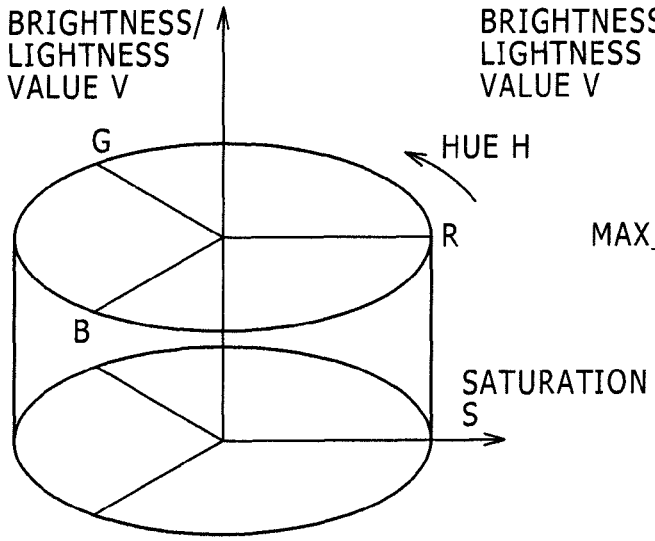
Figure 7B:
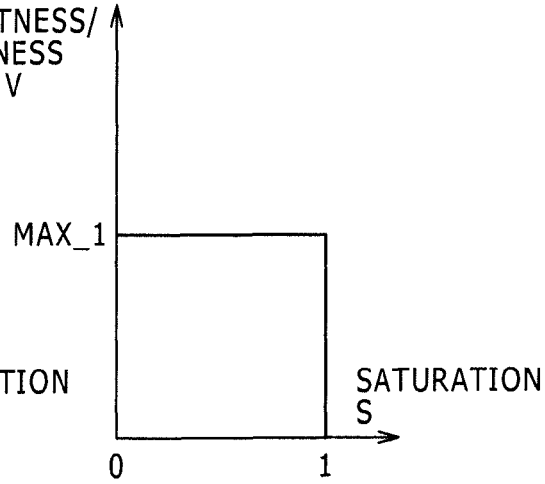
FIG. 7B is a model diagram showing a relation between a saturation (S) and a brightness/lightness value (V) in the cylindrical HSV color space.

In general, the saturation $S_{(p,q)}$ and the brightness/lightness value $V_{(p,q)}$ in a cylindrical HSV color space are found for the first pixel $Px_{(p,q)-1}$ pertaining to the (p, q)th pixel group $PG_{(p,q)}$ on the basis of the first-pixel first sub-pixel input-signal value $x_{1-(p,q)}$, the second-pixel second sub-pixel input-signal value $x_{2-(p,q)}$ and the third-pixel third sub-pixel input-signal value $x_{3-(p,q)}$, which are received for the first pixel $Px_{(p,q)-1}$, in accordance with Eqs. (41-1) and (41-2) respectively as described above. By the same token, the saturation $S_{(p,q)}$ and the brightness/lightness value $V_{(p,q)}$ in the cylindrical HSV color space are found for the second pixel $Px_{(p,q)-2}$ pertaining to the (p, q)th pixel group $PG_{(p,q)}$ on the basis of the first-pixel first sub-pixel input-signal value $x_{1-(p,q)}$, the second-pixel second sub-pixel input-signal value $x_{2-(p,q)}$ and the third-pixel third sub-pixel input-signal value $x_{3-(p,q)}$, which are received for the second pixel $Px_{(p,q)-2}$, in accordance with Eqs. (41-3) and (41-4) respectively as described above. The cylindrical HSV color space is shown in a conceptual diagram of FIG. 7A whereas the relation between the saturation S and the brightness/lightness value V is shown in a model diagram of FIG. 7B. It is to be noted that, in the model diagram of FIG. 7B as well as model diagrams of FIGS. 7D, 8A and 8B to be described later, notation MAX_1 denotes the value of the expression $(2^n-1)$ representing the brightness/lightness value V whereas notation MAX_2 denotes the value of the expression $(2^n-1)\times(\chi+1)$ representing the brightness/lightness value V. The saturation S can have a value in the range 0 to 1 whereas the brightness/lightness value V is in the range 0 to $(2^n-1)$.

Figure 7C:
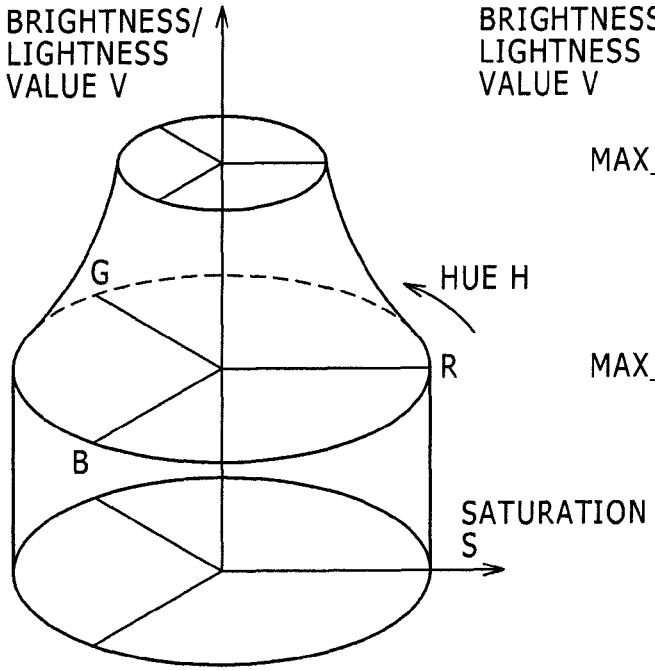
Figure 7D:
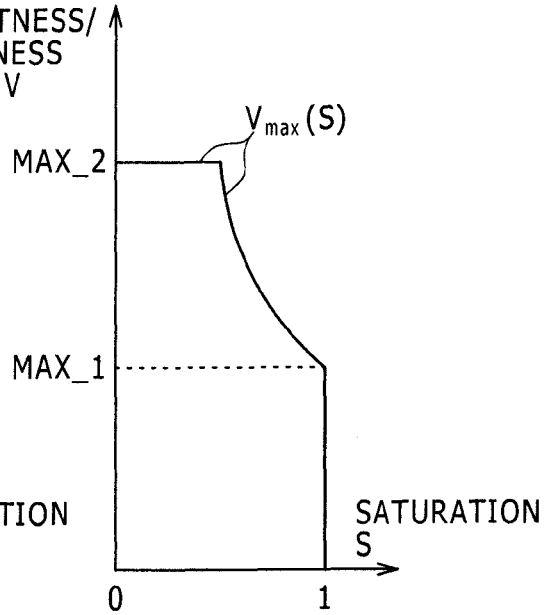
FIG. 7D is a model diagram showing a relation between the saturation (S) and the brightness/lightness value (V) in the enlarged cylindrical HSV color space.

FIG. 7C is a conceptual diagram showing a cylindrical HSV color space enlarged by addition of the white color serving as the fourth color in the fourth embodiment whereas FIG. 7D is a model diagram showing a relation between the saturation (S) and the brightness/lightness value (V). No color filter is provided for the fourth sub-pixel W for displaying the white color.

By the way, if the fourth sub-pixel output-signal value $X_{4-(p,\ q)}$ is expressed by Eq. (2-A') given earlier, the maximum $V_{max}(S)$ of the brightness/lightness value V is represented by the following equations.

For $S \leq S_0$:

$$V_{max}(S)=(\chi+1)\cdot(2^n-1) \quad (43\text{-}1)$$

For $S_0<S\leq 1$:

$$V_{max}(S)=(2^n-1)\cdot(1/S) \quad (43\text{-}2)$$

where $S_0$ is expressed by the following equation:

$$S_0=1/(\chi+1)$$

The maximum brightness/lightness value $V_{max}(S)$ is obtained as described above. The maximum brightness/lightness value $V_{max}(S)$ expressed as a function of variable saturation S in the enlarged HSV color space to serve as the maximum of a brightness/lightness value V is stored in a kind of lookup table in the signal processing section 20.

The following description explains an extension process of finding the sub-pixel output-signal values $X_{1-(p1,\ q)}$, $X_{2-(p1,\ q)}$, $X_{3-(p1,\ q)}$, $X_{1-(p2,\ q)}$, $X_{2-(p2,\ q)}$ and $X_{3-(p2,\ q)}$ of the sub-pixel output signals supplied to the (p, q)th pixel group $PG_{(p,\ q)}$. It is to be noted that, in the same way as the first embodiment, processes to be described below are carried out in the same way as the first embodiment to sustain ratios among the luminance of the first elementary color displayed by the first and fourth sub-pixels, the luminance of the second elementary color displayed by the second and fourth sub-pixels and the luminance of the third elementary color displayed by the third and fourth sub-pixels in every entire pixel group PG which consists of a first pixel $Px_1$ and a second pixel $Px_2$. In addition, the processes are carried out to keep (or sustain) also the color hues. On top of that, the processes are carried out also to sustain (or hold) gradation-luminance characteristics, that is, gamma and γ characteristics.

Process 400

First of all, the signal processing section 20 finds the saturation S and the brightness/lightness value V(S) for every pixel group $PG_{(p,\ q)}$ on the basis of the values of sub-pixel input signals received for sub-pixels pertaining to a plurality of pixels. To put it more concretely, the saturation $S_{(p,\ q)-1}$ and the brightness/lightness value $V_{(p,\ q)-1}$ are found for the first pixel $Px_{(p,\ q)-1}$ pertaining to the (p, q)th pixel group $PG_{(p,\ q)}$ on the basis of the first-pixel first sub-pixel input-signal value $x_{1-(p1,\ q)}$, the second-pixel second sub-pixel input-signal value $x_{2-(p1,\ q)}$ and the third-pixel third sub-pixel input-signal value $x_{3-(p1,\ q)}$, which are received for the first pixel $Px_{(p,\ q)-1}$, in accordance with Eqs. (41-1) and (41-2) respectively as described above. By the same token, the saturation $S_{(p,\ q)-2}$ and the brightness/lightness value $V_{(p,\ q)-2}$ are found for the second pixel $Px_{(p,\ q)-2}$ pertaining to the (p, q)th pixel group $PG_{(p,\ q)}$ on the basis of the first-pixel first sub-pixel input-signal value $x_{1-(p2,\ q)}$, the second-pixel second sub-pixel input-signal value $x_{2-(p2,\ q)}$ and the third-pixel third sub-pixel input-signal value $x_{3-(p2,\ q)}$, which are received for the second pixel $Px_{(p,\ q)-2}$, in accordance with Eqs. (41-3) and (41-4) respectively as described above. This process is carried out for all pixel groups $PG_{(p,\ q)}$. Thus, the signal processing section 20 finds (P×Q) sets each consisting of ($S_{(p,\ q)-1}$, $S_{(p,\ q)-2}$, $V_{(p,\ q)-1}$, $V_{(p,\ q)-2}$).

Process 410

Then, the signal processing section 20 finds the extension coefficient $\alpha_0$ n the basis of at least one of ratios $V_{max}(S)/V(S)$ found for the pixels groups $PG_{(p,\ q)}$.

Figure 8A:
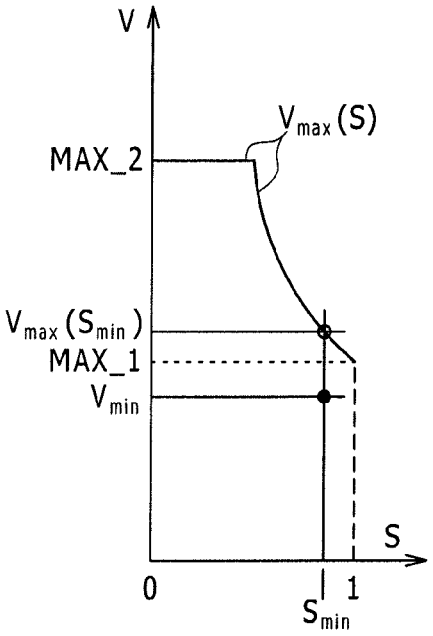
FIGS. 8A and 8B are each a model diagram showing a relation between the saturation (S) and the brightness/lightness value (V) in a cylindrical HSV color space enlarged by adding a white color to serve as a fourth color in a fourth embodiment of the present invention.
Figure 8B:
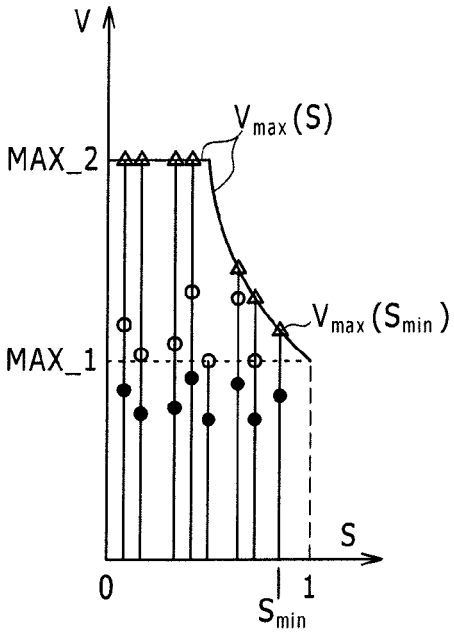

To put it more concretely, in the case of the fourth embodiment, the signal processing section 20 takes the value $\alpha_{min}$ smallest among the ratios $V_{max}(S)/V(S)$, which have been found for all the ($P_0$×Q) pixels, as the extension coefficient $\alpha_0$. That is to say, the signal processing section 20 finds the value of $\alpha_{(p,\ q)}(=V_{max}(S)/V_{(p,\ q)}(S))$ for each of the ($P_0$×Q) pixels and takes the value $\alpha_{min}$ smallest among the values of $\alpha_{(p,\ q)}$ as the extension coefficient $\alpha_0$. It is to be noted that FIG. 8A is given as a conceptual diagram showing a cylindrical HSV color space enlarged by addition of the white color serving as the fourth color in the fourth embodiment whereas FIG. 8B is given as a model diagram showing a relation between the saturation (S) and the brightness/lightness value (V). In the diagrams of FIGS. 8A and 8B, reference notation $S_{min}$ denotes the value of the saturation S that gives the smallest extension coefficient $\alpha_{min}$ whereas reference notation $V_{min}$ denotes the value of the brightness/lightness value V(S) at the saturation $S_{min}$. Reference notation $V_{max}$ ($S_{min}$) denotes the maximum brightness/lightness value $V_{max}(S)$ at the saturation $S_{min}$. In the diagram of FIG. 8B, each of black circles indicates the brightness/lightness value V(S) whereas each of white circles indicates the value of V (s)×$\alpha_0$. Each of white triangular marks indicates the maximum brightness/lightness value $V_{max}(S)$ at a saturation S.

Process 420

Then, the signal processing section 20 finds the fourth sub-pixel output-signal value $X_{4-(p,\ q)}$ for the (p, q)th pixel group $PG_{(p,\ q)}$ on the basis of at least the sub-pixel input-signal values $x_{1-(p1,\ q)}$, $x_{2-(p1,\ q)}$, $x_{3-(p1,\ q)}$, $x_{1-(p2,\ q)}$, $x_{2-(p2,\ q)}$ and $x_{3-(p2,\ q)}$. To put it more concretely, in the case of the fourth embodiment, the signal processing section 20 determines the fourth sub-pixel output-signal value $X_{4-(p,\ q)}$ on the basis of the first minimum value $Min_{(p,\ q)-1}$, the second minimum value $Min_{(p,\ q)-2}$, the extension coefficient $\alpha_0$ and the constant χ. To put it even more concretely, in the case of the fourth embodiment, the signal processing section 20 determines the fourth sub-pixel output-signal value $X_{4-(p,\ q)}$ in accordance with the following equation:

$$X_{4-(p,q)}=\{[Min_{(p,q)-1}]\cdot\alpha_0/\chi+[Min_{(p,q)-2}]\cdot\alpha_0/\chi\}2 \quad (2\text{-A}')$$

It is to be noted that the signal processing section 20 finds the fourth sub-pixel output-signal value $X_{4-(p,\ q)}$ for each of the (P×Q) pixel groups $PG_{(p,\ q)}$.

Process 430

Then, the signal processing section 20 determines the sub-pixel output-signal values $X_{1-(p1,\ q)}$, $X_{2-(p1,\ q)}$, $X_{3-(p1,\ q)}$, $X_{1-(p2,\ q)}$, $X_{2-(p2,\ q)}$ and $X_{3-(p2,\ q)}$ on the basis of the ratios of an upper limit $V_{max}$ in the color space to the sub-pixel input-signal values $x_{1-(p1,\ q)}$, $x_{2-(p1,\ q)}$, $x_{3-(p1,\ q)}$, $x_{1-(p2,\ q)}$, $x_{2-(p2,\ q)}$ and $x_{3-(p2,\ q)}$ respectively. That is to say, for the (p, q)th pixel group $PG_{(p,\ q)}$, the signal processing section 20 finds:

the first sub-pixel output-signal value $X_{1-(p1,\ q)}$ on the basis of the first sub-pixel input-signal value $x_{1-(p1,\ q)}$, the extension coefficient $\alpha_0$ and the first signal value $SG_{(p,\ q)-1}$;

the second sub-pixel output-signal value $X_{2-(p1,\ q)}$ on the basis of the second sub-pixel input-signal value $x_{2-(p1,\ q)}$, the extension coefficient $\alpha_0$ and the first signal value $SG_{(p,\ q)-1}$;

the third sub-pixel output-signal value $X_{3-(p1,\ q)}$ on the basis of the third sub-pixel input-signal value $x_{3-(p1,\ q)}$, the extension coefficient $\alpha_0$ and the first signal value $SG_{(p,\ q)-1}$;

the first sub-pixel output-signal value $X_{1-(p2,\ q)}$ on the basis of the first sub-pixel input-signal value $x_{1-(p2,\ q)}$, the extension coefficient $\alpha_0$ and the second signal value $SG_{(p,\ q)-2}$;

the second sub-pixel output-signal value $X_{2-(p2,\ q)}$ on the basis of the second sub-pixel input-signal value $x_{2-(p2,\ q)}$, the extension coefficient $\alpha_0$ and the second signal value $SG_{(p,\ q)-2}$; and the third sub-pixel output-signal value $X_{3-(p2,\ q)}$ on the basis of the third sub-pixel input-signal value $x_{3-(p2,\ q)}$, the extension coefficient $\alpha_0$ and the second signal value $SG_{(p,\ q)-2}$.

It is to be noted that processes 420 and 430 can be carried out at the same time. As an alternative, process 420 is carried out after the execution of process 430 has been completed.

To put it more concretely, the signal processing section 20 finds the sub-pixel output-signal values $X_{1-(p1,\ q)}$, $X_{2-(p1,\ q)}$, $X_{3-(p1,\ q)}$, $X_{1-(p2,\ q)}$, $X_{2-(p2,\ q)}$ and $X_{3-(p2,\ q)}$ for the (p, q)th pixel group $PG_{(p,\ q)}$ on the basis of Eqs. (3-A) to (3-F) respectively as follows:

$$X_{1-(p1,q)}=\alpha_0 \cdot x_{1-(p1,q)}-\chi \cdot SG_{(p,q)-1} \quad (3\text{-A})$$

$$X_{2-(p1,q)}=\alpha_0 \cdot x_{2-(p1,q)}-\chi SG_{(p,q)-1} \quad (3\text{-B})$$

$$X_{3-(p1,q)}=\alpha_0 \cdot x_{3-(p1,q)}-\chi \cdot SG_{(p,q)-1} \quad (3\text{-C})$$

$$X_{1-(p2,q)}=\alpha_0 \cdot x_{1-(p2,q)}-\chi \cdot SG_{(p,q)-2} \quad (3\text{-D})$$

$$X_{2-(p2,q)}=\alpha_0 \cdot x_{2-(p2,q)}-\chi \cdot SG_{(p,q)-2} \quad (3\text{-E})$$

$$X_{3-(p2,q)}=\alpha_0 \cdot x_{3-(p2,q)}-\chi \cdot SG_{(p,q)-2} \quad (3\text{-F})$$

Figure 9:
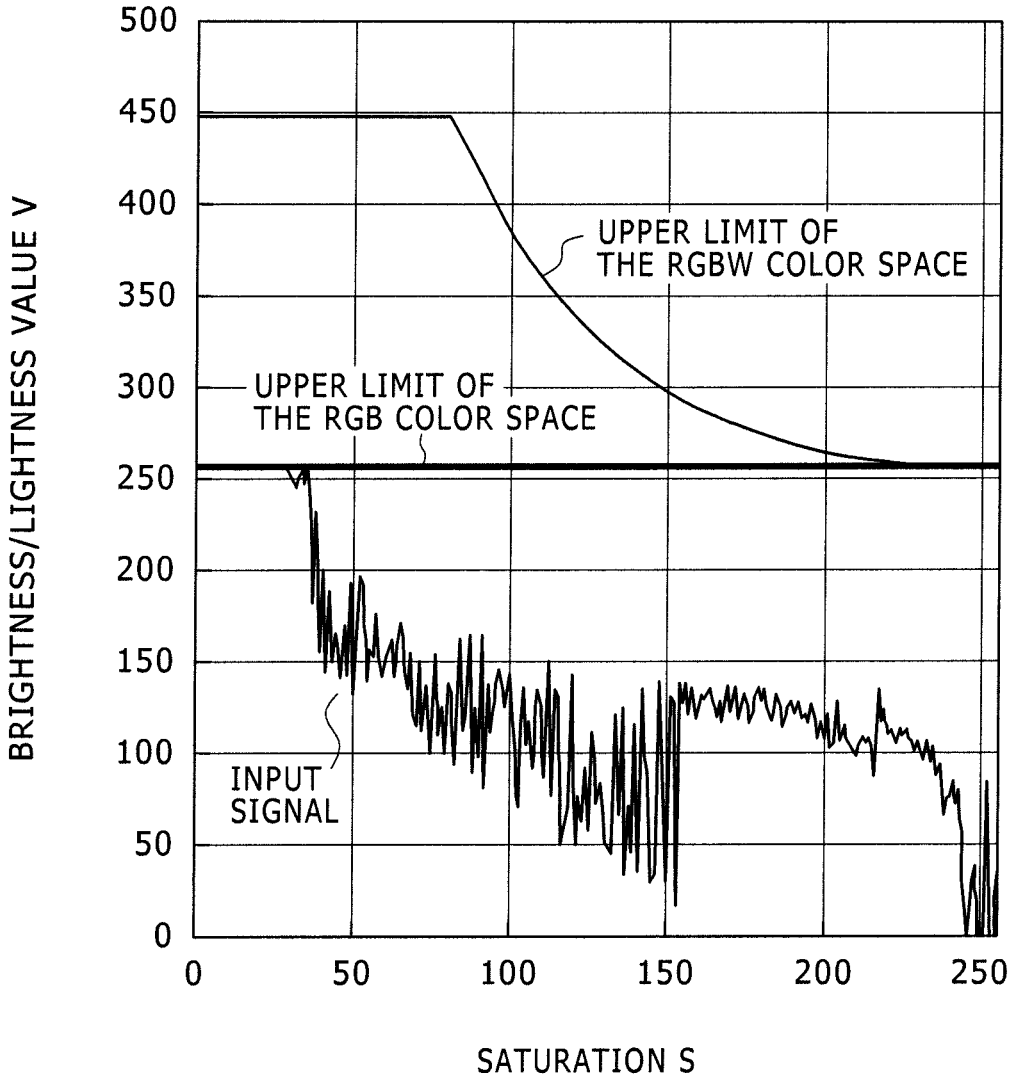
FIG. 9 is a diagram showing an existing HSV color space prior to addition of a white color to serve as a fourth color in the fourth embodiment, an HSV color space enlarged by adding a white color to serve as a fourth color in the fourth embodiment and a typical relation between the saturation (S) and brightness/lightness value (V) of a sub-pixel input signal.
Figure 10:
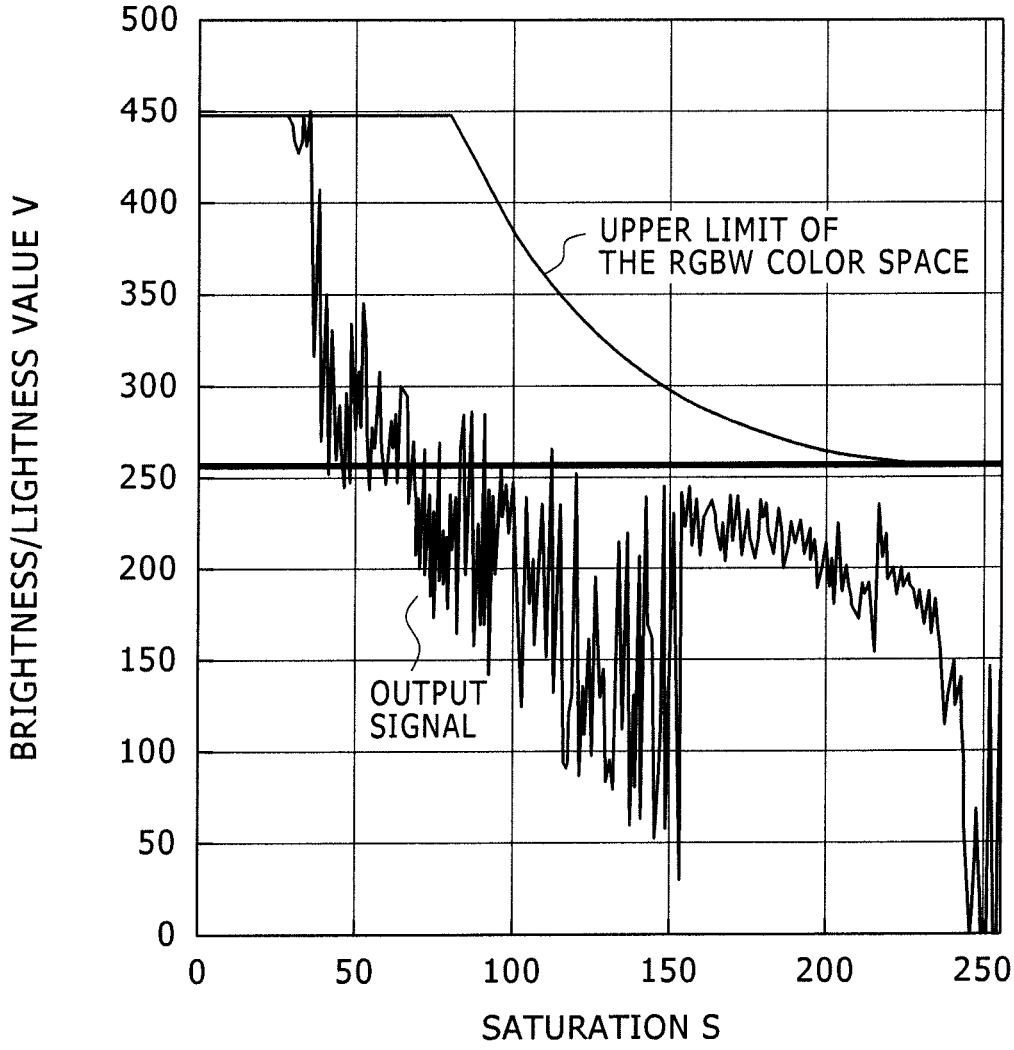
FIG. 10 is a diagram showing an existing HSV color space prior to addition of a white color to serve as a fourth color in the fourth embodiment, an HSV color space enlarged by adding a white color to serve as a fourth color in the fourth embodiment and a typical relation between the saturation (S) and brightness/lightness value (V) of a sub-pixel output signal completing an extension process.

FIG. 9 is a diagram showing an existing HSV color space prior to addition of a white color to serve as a fourth color in the fourth embodiment, an HSV color space enlarged by adding a white color to serve as a fourth color in the fourth embodiment and a typical relation between the saturation (S) and brightness/lightness value (V) of a sub-pixel input signal. FIG. 10 is a diagram showing an existing HSV color space prior to addition of a white color to serve as a fourth color in the fourth embodiment, an HSV color space enlarged by adding a white color to serve as a fourth color in the fourth embodiment and a typical relation between the saturation (S) and brightness/lightness value (V) of a sub-pixel output signal completing an extension process. It is to be noted that the saturation (S) represented by the horizontal axis in each of the diagrams of FIGS. 9 and 10 has a value in the range 0 to 255 even though the saturation (S) naturally has a value in the range 0 to 1. That is to say, the value of the saturation (S) represented by the horizontal axis in the diagrams of FIGS. 9 and 10 is multiplied by 255.

An important point in this case is the fact that the first minimum value $Min_{(p,\ q)-1}$ and the second minimum value $Min_{(p,\ q)-2}$ are extended by multiplying the first minimum value $Min_{(p,\ q)-1}$ and the second minimum value $Min_{(p,\ q)-2}$ by the extension coefficient $\alpha_0$ in accordance with Eq. (2-A'). By extending the first minimum value $Min_{(p,\ q)-1}$ and the second minimum value $Min_{(p,\ q)-2}$ through multiplication of the first minimum value $Min_{(p,\ q)-1}$ and the second minimum value $Min_{(p,\ q)-2}$ by the extension coefficient $\alpha_0$ in this way, not only is the luminance of the white-color display sub-pixel serving as the fourth sub-pixel increased, but the luminance of light emitted by each of the red-color display sub-pixel serving as the first sub-pixel, the green-color display sub-pixel serving as the second sub-pixel and the blue-color display sub-pixel serving as the third sub-pixel is also raised as well as indicated by respectively Eqs. (3-A) to (3-F) given above. Therefore, it is possible to avoid the problem of the generation of the color dullness with a high degree of reliability. That is to say, in comparison with a case in which the first minimum value $Min_{(p,\ q)-1}$ and the second minimum value $Min_{(p,\ q)-2}$ are not extended by the extension coefficient $\alpha_0$, by extending the first minimum value $Min_{(p,\ q)-1}$ and the second minimum value $Min_{(p,\ q)-2}$ through the use of the extension coefficient $\alpha_0$, the luminance of the whole image is multiplied by the extension coefficient $\alpha_0$. Thus, an image such as a static image can be displayed at a high luminance. That is to say, the driving method is optimum for such applications.

For $\chi$=1.5 and $(2^n-1)$=255 or n=8, the sub-pixel output-signal values $X_{1-(p1,\ q)}$, $X_{2-(p1,\ q)}$ and $X_{3-(p1,\ q)}$ as well as the signal value $SG_{(p,\ q)-1}$ which are obtained from the sub-pixel input-signal values $x_{1-(p,\ q)}$, $x_{2-(p,\ q)}$ and $x_{3-(p,\ q)}$ are related with the sub-pixel input-signal values $x_{1-(p1,\ q)}$, $x_{2-(p1,\ q)}$ and $x_{3-(p1,\ q)}$ in accordance with Table 2. It is to be noted that, in order to make the explanation simple, the following equations are assumed: $SG_{(p,\ q)-1}=SG_{(p,\ q)-}2=X_{4-(p,\ q)}$.

In Table 2, the value of $\alpha_{min}$ is 1.467 shown at the intersection of the fifth input row and the right-most column. Thus, if the extension coefficient $\alpha_0$ is set at 1.467 (=$\alpha_{min}$), the sub-pixel output-signal value by no means exceeds $(2^8-1)$.

If the value of $\alpha(S)$ on the third input row is used as the extension coefficient $\alpha_0$ (=1.592), however, the sub-pixel output-signal value for the sub-pixel input-signal values on the third row by no means exceeds $(2^8-1)$. Nevertheless, the sub-pixel output-signal value for the input values on the fifth row exceeds $(2^8-1)$ as indicated by Table 3. If the value of $\alpha_{min}$ is used as the extension coefficient $\alpha_0$ in this way, the sub-pixel output-signal value by no means exceeds $(2^8-1)$.

TABLE 2

| No | $x_1$ | $x_2$ | $x_3$ | Max | Min | S | V | $V_{max}$ | $\alpha = V_{max}/V$ |
|---|---|---|---|---|---|---|---|---|---|
| 1 | 240 | 255 | 160 | 255 | 160 | 0.373 | 255 | 638 | 2.502 |
| 2 | 240 | 160 | 160 | 240 | 160 | 0.333 | 240 | 638 | 2.658 |
| 3 | 240 | 80 | 160 | 240 | 80 | 0.667 | 240 | 382 | 1.592 |
| 4 | 240 | 100 | 200 | 240 | 100 | 0.583 | 240 | 437 | 1.821 |
| 5 | 255 | 81 | 160 | 255 | 81 | 0.682 | 255 | 374 | 1.467 |

| No | $X_4$ | $X_1$ | $X_2$ | $X_3$ |
|---|---|---|---|---|
| 1 | 156 | 118 | 140 | 0 |
| 2 | 156 | 118 | 0 | 0 |
| 3 | 78 | 235 | 0 | 118 |
| 4 | 98 | 205 | 0 | 146 |
| 5 | 79 | 255 | 0 | 116 |

TABLE 3

| No | $x_1$ | $x_2$ | $x_3$ | Max | Min | S | V | $V_{max}$ | $\alpha = V_{max}/V$ |
|---|---|---|---|---|---|---|---|---|---|
| 1 | 240 | 255 | 160 | 255 | 160 | 0.373 | 255 | 638 | 2.502 |
| 2 | 240 | 160 | 160 | 240 | 160 | 0.333 | 240 | 638 | 2.658 |
| 3 | 240 | 80 | 160 | 240 | 80 | 0.667 | 240 | 382 | 1.592 |
| 4 | 240 | 100 | 200 | 240 | 100 | 0.583 | 240 | 437 | 1.821 |
| 5 | 255 | 81 | 160 | 255 | 81 | 0.682 | 255 | 374 | 1.467 |

| No | $X_4$ | $X_1$ | $X_2$ | $X_3$ |
|---|---|---|---|---|
| 1 | 170 | 127 | 151 | 0 |
| 2 | 170 | 127 | 0 | 0 |
| 3 | 85 | 255 | 0 | 127 |
| 4 | 106 | 223 | 0 | 159 |
| 5 | 86 | 277 | 0 | 126 |

In the case of the first input row of Table 2 for example, the sub-pixel input-signal values $x_{1-(p,\ q)}$, $x_{2-(p,\ q)}$ and $x_{3-(p,\ q)}$ are 240, 255 and 160 respectively. By making use of the extension coefficient $\alpha_0$ (=1.467), the luminance values of signals to be displayed are found on the basis of the sub-pixel input-signal values $x_{1-(p,\ q),\ x2-(p,\ q)}$ and $x_{3-(p,\ q)}$ as values conforming to the 8-bit display as follows:

The luminance value of light emitted by the first sub-pixel=$\alpha_0 \cdot X_{1-(p1,q)}$=1.467×240=352

The luminance value of light emitted by the second sub-pixel=$\alpha_0 \cdot X_{2-(p1,q)}$=1.467×255=374

The luminance value of light emitted by the third sub-pixel=$\alpha_0 \cdot X_{3-(p1,q)}$=1.467×160=234

On the other hand, the first signal value $SG_{(p,\ q)-1}$ or the fourth sub-pixel output-signal value $X_{4-(p,\ q)}$ found for the fourth sub-pixel is 156. Thus, the luminance of light emitted by the fourth sub-pixel is $\chi \cdot X_{4-(p,\ q)}$=1.5×156=234.

As a result, the first sub-pixel output-signal value $X_{1-(p1,\ q)}$ of the first sub-pixel, the second sub-pixel output-signal value $X_{2-(p1,\ q)}$ of the second sub-pixel and the third sub-pixel output-signal value $X_{3-(p1,\ q)}$ of the third sub-pixel are found as follows:

$$X_{1-(p1,q)}=352-234=118$$

$$X_{2-(p1,q)}=374-234=140$$

$$X_{3-(p1,q)}=234-234=0$$

Thus, in the case of sub-pixels pertaining to a pixel associated with sub-pixel input signals with values shown on the first input row of Table 2, the sub-pixel output-signal value of a sub-pixel with a smallest sub-pixel input-signal value is 0. In the case of typical data shown in Table 2, the sub-pixel with a smallest sub-pixel input-signal value is the third sub-pixel. Accordingly, the display of the third sub-pixel is replaced by the fourth sub-pixel. In addition, the first sub-pixel output-signal value $X_{1-(p,\ q)}$ for the first sub-pixel, the second sub-pixel output-signal value $X_{2-(p,\ q)}$ for the second sub-pixel and the third sub-pixel output-signal value $X_{3-(p,\ q)}$ for the third sub-pixel are smaller than the naturally desired values.

In the image display apparatus assembly according to the fourth embodiment and the method for driving the image display apparatus assembly, the sub-pixel output-signal values $X_{1-(p1,\ q)}$, $X_{2-(p1,\ q)}$, $X_{3-(p1,\ q)}$, $X_{1-(p2,\ q)}$, $X_{2-(p2,\ q)}$, $X_{3-(p2,\ q)}$ and $X_{4-(p,\ q)}$ for the (p, q)th pixel group $PG_{(p,\ q)}$ are extended by making use of the extension coefficient $\alpha_0$ as a multiplication factor. Therefore, in order to obtain the same image luminance as that of an image with the sub-pixel output-signal values $X_{1-(p1,\ q)}$, $X_{2-(p1,\ q)}$, $X_{3-(p1,\ q)}$, $X_{1-(p2,\ q)}$, $X_{2-(p2,\ q)}$ and $X_{3-(p2,\ q)}$ not extended, it is necessary to reduce the luminance of illumination light radiated by the planar light-source apparatus 50 on the basis of the extension coefficient $\alpha_0$. To put it more concretely, the luminance of illumination light radiated by the planar light-source apparatus 50 needs to be multiplied by $(1/\alpha_0)$. Thus, the power consumption of the planar light-source apparatus 50 can be decreased.

Figure 11:
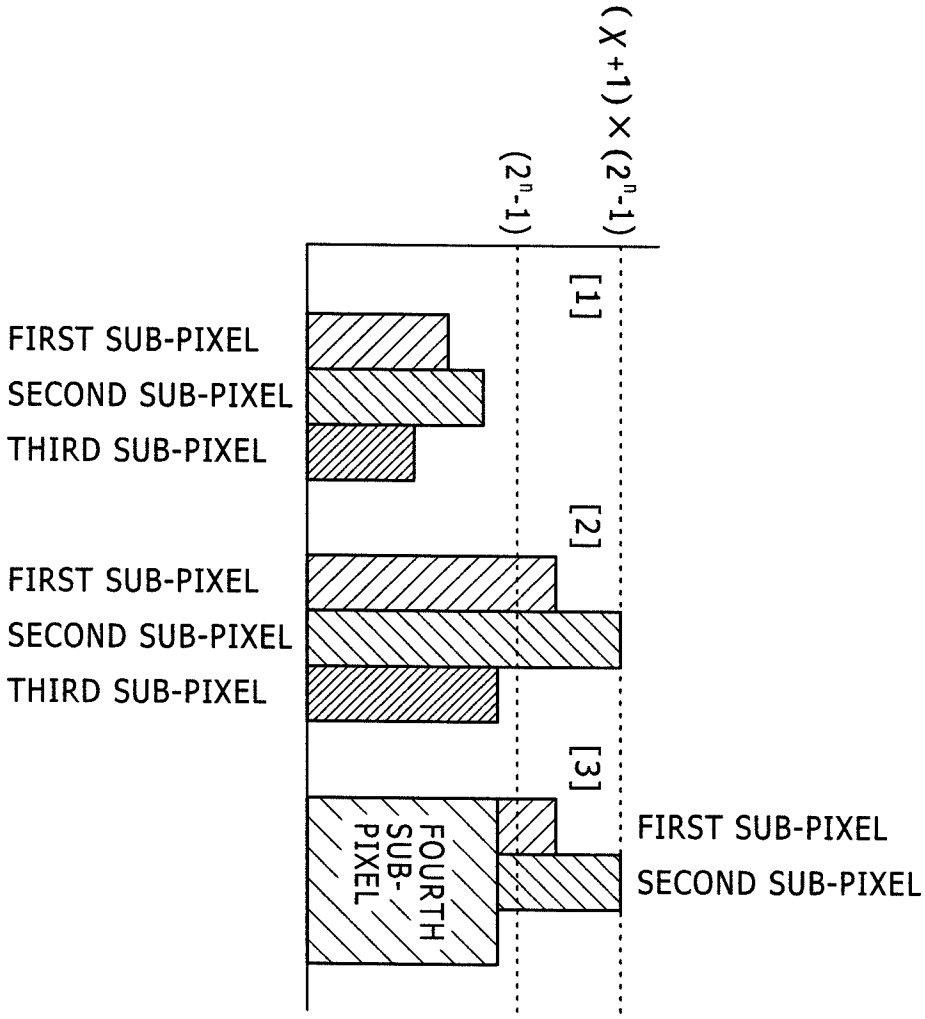
FIG. 11 is a model diagram showing sub-pixel input-signal values and sub-pixel output-signal values in an extension process of a method for driving an image display apparatus according to the fourth embodiment and a method for driving an image display apparatus assembly including the image display apparatus.

By referring to a diagram of FIG. 11, the following description explains an extension process carried out in accordance with a method for driving the image display apparatus according to the fourth embodiment and a method for driving an image display apparatus assembly employing the image display apparatus. FIG. 11 is a model diagram showing sub-pixel input-signal values and sub-pixel output-signal values in the extension process. In the model diagram of FIG. 11, notation [1] indicates sub-pixel input-signal values for a pixel consisting of a first sub-pixel, a second sub-pixel and a third sub-pixel for which $\alpha_{min}$ has been found. Notation [2] indicates a state of carrying out the extension process. The extension process is carried out by multiplying the sub-pixel input-signal values indicated by notation [1] by the extension coefficient $\alpha_0$. Notation [3] indicates a state which exists after carrying out the extension process. To be more specific, notation [3] indicates the sub-pixel output-signal values $X_{1-(p1,\ q)}$, $X_{2-(p1,\ q)}$, $X_{3-(p1,\ q)}$ and $X_{4-(p1,\ q)}$ which are obtained as a result of the extension process. As is obvious from the typical data shown in the diagram of FIG. 11, a maximum implementable luminance is obtained for the second sub-pixel.

In the same way as the first embodiment, also in the case of the fourth embodiment, the fourth sub-pixel output-signal value $X_{4-(p,\ q)}$ can be found in accordance with the following equation:

$$X_{4-(p,q)}=C_1 \cdot SG_{(p,q)-1}+C_2 \cdot SG_{(p,q)-2} \tag{2-B}$$

In the above equation, each of notations $C_1$ and $C_2$ denotes a constant used as a weight. The fourth sub-pixel output-signal value $X_{4-(p,\ q)}$ satisfies the relation $X_{4-(p,\ q)} \leq (2^n-1)$. If the value of the expression $(C_1 \cdot SG_{(p,\ q)-1}+C_2 \cdot SG_{(p,\ q)-2}$ is greater than $(2^n-1)$ (that is, for $(C_1 \cdot SG_{(p,\ q)-1}+C_2 \cdot SG_{(p,\ q)-2} > (2^n-1)$), the fourth sub-pixel output-signal value $X_{4-(p,\ q)}$ is set at $(2^n-1)$ (that is, $X_{4-(p,\ q)}=(2^n-1)$). As an alternative, in the same way as the first embodiment, the fourth sub-pixel output-signal value $X_{4-(p,\ q)}$ is found as the root of the average of the sum of the squared first signal value $SG_{(p,\ q)-1}$ and the squared second signal value $SG_{(p,\ q)-2}$ as follows:

$$X_{4-(p,q)}=[(SG_{(p,q)-1}{}^2+SG_{(p,q)-2}{}^2)/2]^{1/2} \tag{2-C}$$

As another alternative, in the same way as the first embodiment, the fourth sub-pixel output-signal value $X_{4-(p,\ q)}$ is found as the root of the product of the first signal value $SG_{(p,\ q)-1}$ and the second signal value $SG_{(p,\ q)-2}$ as follows:

$$X_{4-(p,q)}=(SG_{(p,q)-1} \cdot SG_{(p,q)-2})^{1/2} \tag{2-D}$$

In addition, also in the case of the fourth embodiment, the sub-pixel output-signal values $X_{1-(p1,\ q)}$, $X_{2-(p1,\ q)}$, $X_{3-(p1,\ q)}$, $X_{1-(p2,\ q)}$, $X_{2-(p2,\ q)}$ and $X_{3-(p2,\ q)}$ can be found as the values of the following expressions respectively in the same way as the first embodiment:

$$[x_{1-(p1,q)}, x_{1-(p2,q)}, \alpha_0, SG_{(p,q)-1}, \chi];$$

$$[x_{2-(p1,q)}, x_{2-(p2,q)}, \alpha_0, SG_{(p,q)-1}, \chi];$$

$$[x_{3-(p1,q)}, x_{3-(p2,q)}, \alpha_0, SG_{(p,q)-1}, \chi];$$

$$[x_{1-(p1,q)}, x_{1-(p2,q)}, \alpha_0, SG_{(p,q)-2}, \chi];$$

$$[x_{2-(p1,q)}, x_{2-(p2,q)}, \alpha_0, SG_{(p,q)-2}, \chi]; \text{ and}$$

$$[x_{3-(p1,q)}, x_{3-(p2,q)}, \alpha_0, SG_{(p,q)-2}, \chi].$$

Fifth Embodiment

A fifth embodiment is obtained as a modified version of the fourth embodiment. The existing planar light-source apparatus of the right-below type can be used as the planar light-source apparatus. In the case of the fifth embodiment, however, a planar light-source apparatus 150 of a distributed driving method to be described later is used. In the following description, the distributed driving method is also referred to as a division driving method. The extension process itself is identical with the extension process of the fourth embodiment.

Figure 12:
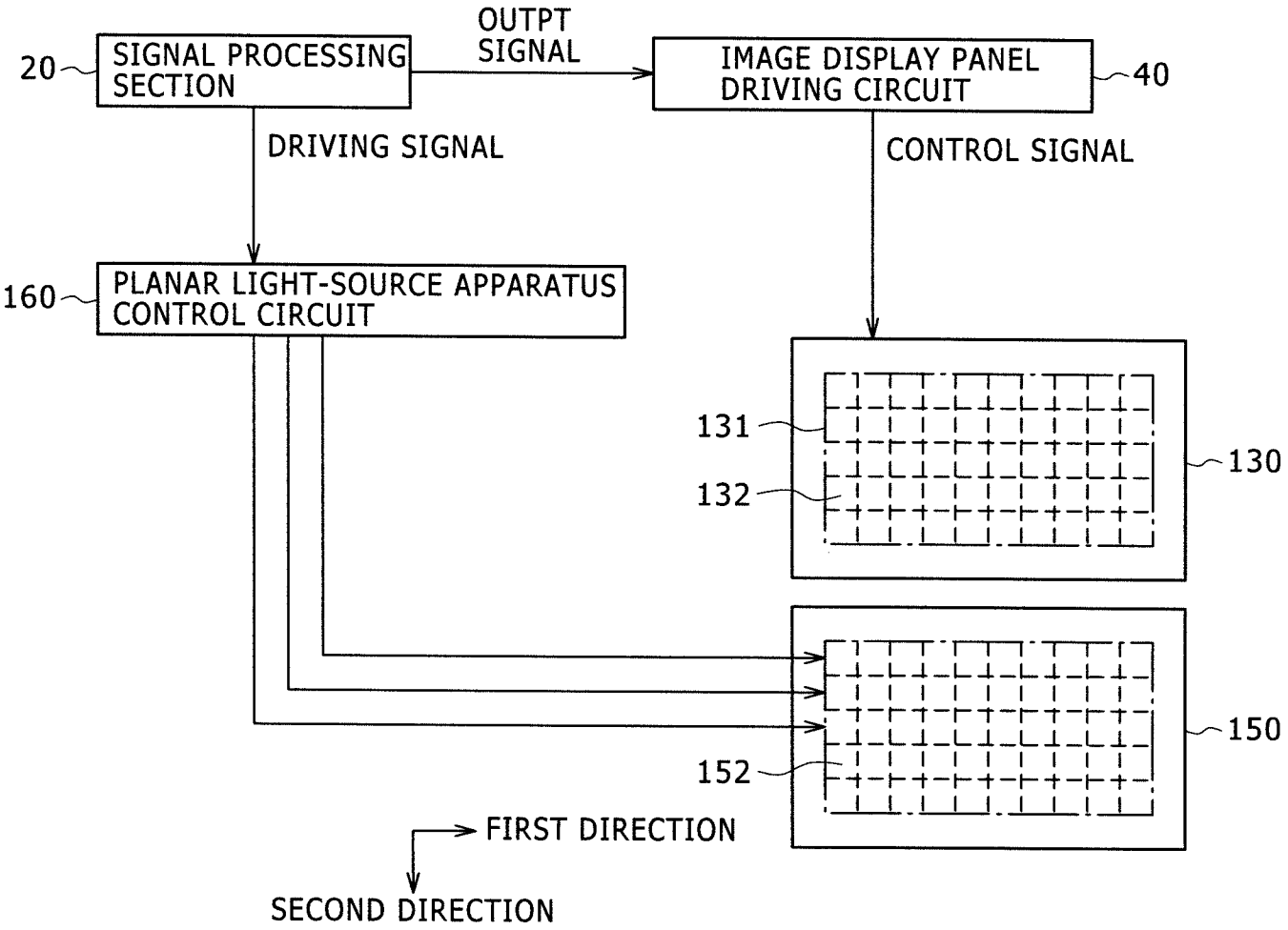
FIG. 12 is a conceptual diagram showing an image display panel and a planar light-source apparatus which compose an image display apparatus assembly according to a fifth embodiment of the present invention.

In the case of the fifth embodiment, it is assumed that the display area 131 of the image display panel 130 composing the color liquid-crystal display apparatus is divided into (S×T) virtual display area units 132 as shown in a conceptual diagram of FIG. 12. The planar light-source apparatus 150 of a division driving method has (S×T) planar light-source units 152 which are each associated with one of the (S×T) virtual display area units 132. The light emission state of each of the (S×T) planar light-source units 152 is controlled individually.

As shown in the conceptual diagram of FIG. 12, the display area 131 of the image display panel 130 serving as a color image liquid-crystal display panel has ($P_0$×Q) pixels laid out to form a 2-dimensional matrix which consists of $P_0$ columns and Q rows. That is to say, $P_0$ pixels are arranged in the first direction (that is, the horizontal direction) to form a row and such Q rows are laid out in the second direction (that is, the vertical direction) to form the 2-dimensional matrix. As described above, it is assumed that the display area 131 of the image display panel 130 composing the color liquid-crystal display apparatus is divided into (S×T) virtual display area units 132. Since the product S×T representing the number of virtual display area units 132 is smaller than the product ($P_0$×Q) representing the number of pixels, each of the (S×T) virtual display area units 132 has a configuration which includes a plurality of pixels.

To put it more concretely, for example, the image display resolution conforms to the HD-TV specifications. If the number of pixels laid out to form a 2-dimensional matrix is ($P_0$×Q), a pixel count representing the number of pixels laid out to form a 2-dimensional matrix is represented by notation ($P_0$, Q). For example, the number of pixels laid out to form a 2-dimensional matrix is (1920, 1080). In addition, as described above, it is assumed that the display area 131 of the image display panel 130 composing the color liquid-crystal display apparatus is divided into (S×T) virtual display area units 132. In the conceptual diagram of FIG. 12, the display area 131 is shown as a large dashed-line block whereas each of the (S×T) virtual display area units 132 is shown as a small dotted-line block in the large dashed-line block. The virtual display area unit count (S, T) is (19, 12). In order to make the conceptual diagram of FIG. 12 simple, however, the number of virtual display area units 132, that is, the number of planar light-source units 152, is made smaller than (19, 12).

As described above, each of the (S×T) virtual display area units 132 has a configuration which includes a plurality of pixels. Thus, each of the (S×T) virtual display area units 132 has a configuration which includes about 10,000 pixels.

In general, the image display panel 130 is driven on a line-after-line basis. To put it more concretely, the image display panel 130 has scan electrodes each extended in the first direction to form a row of the matrix cited above and data electrodes each extended in the second direction to form a column of the matrix in which the scan and data electrodes cross each other at pixels each located at an intersection corresponding to an element of the matrix. The scan circuit 42 employed in the image display panel driving circuit 40 shown in the conceptual diagram of FIG. 12 supplies a scan signal to a specific one of the scan electrodes in order to select the specific scan electrode and scan pixels connected to the selected scan electrode. An image of 1 screen is displayed on the basis of data signals already supplied from the signal outputting circuit 41 also employed in the image display panel driving circuit 40 to the pixels by way of the data electrodes as sub-pixel output signals.

Referred also to as a backlight, the planar light-source apparatus 150 of the right-below type has (S×T) planar light-source units 152 which are each associated with one of the (S×T) virtual display area units 132. That is to say, a planar light-source unit 152 radiates illumination light to the rear face of a virtual display area unit 132 associated with the planar light-source unit 152. Light sources each employed in a planar light-source unit 152 is controlled individually. It is to be noted that, in actuality, the planar light-source apparatus 150 is placed right below the image display panel 130. In the conceptual diagram of FIG. 12, however, the image display panel 130 and the planar light-source apparatus 150 are shown separately.

As described above, it is assumed that the display area 131 composed of pixels laid out to form a 2-dimensional matrix to serve as the display area 131 of the image display panel 130 composing the color liquid-crystal display apparatus is divided into (S×T) virtual display area units 132. For example, the virtual display area unit count (S, T) is (19, 12) as described above. This state of division is expressed in terms of rows and columns as follows. The (S×T) virtual display area units 132 can be said to be laid out on the display area 131 to form a matrix consisting of (T rows)×(S columns). Also as described earlier, each virtual display area unit 132 is composed to include $M_0$×$N_0$ pixels. For example, the pixel count ($M_0$, $N_0$) is about 10,000 as described above. By the same token, the layout of the $M_0$×$N_0$ pixels in a virtual display area unit 132 can be expressed in terms of rows and columns as follows. The pixels can be said to be laid out on the virtual display area unit 132 to form a matrix consisting of $N_0$ rows× $M_0$ columns.

Figure 14:
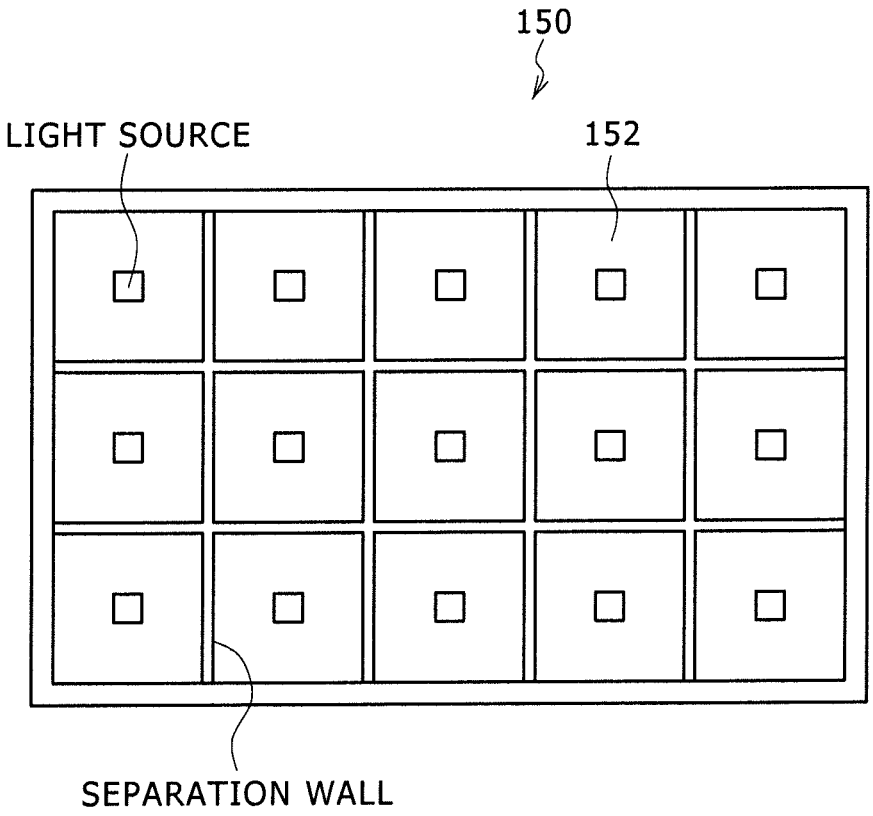
FIG. 14 is a model diagram showing locations and an array of elements such as planar light-source units in the planar light-source apparatus employed in the image display apparatus assembly according to the fifth embodiment.

FIG. 14 is a model diagram showing locations of elements such as the planar light-source units 152 and an array of the elements in the planar light-source apparatus 150 employed in the image display apparatus assembly according to the fifth embodiment. A light source included in each of the planar light-source units 152 is a light emitting diode 153 driven on the basis of a PWM (Pulse Width Modulation) control technique. The luminance of illumination light radiated by the planar light-source unit 152 is controlled to increase or decrease by respectively increasing or decreasing the duty ratio of the pulse modulation control of the light emitting diode 153 included in the planar light-source unit 152.

Figure 13:
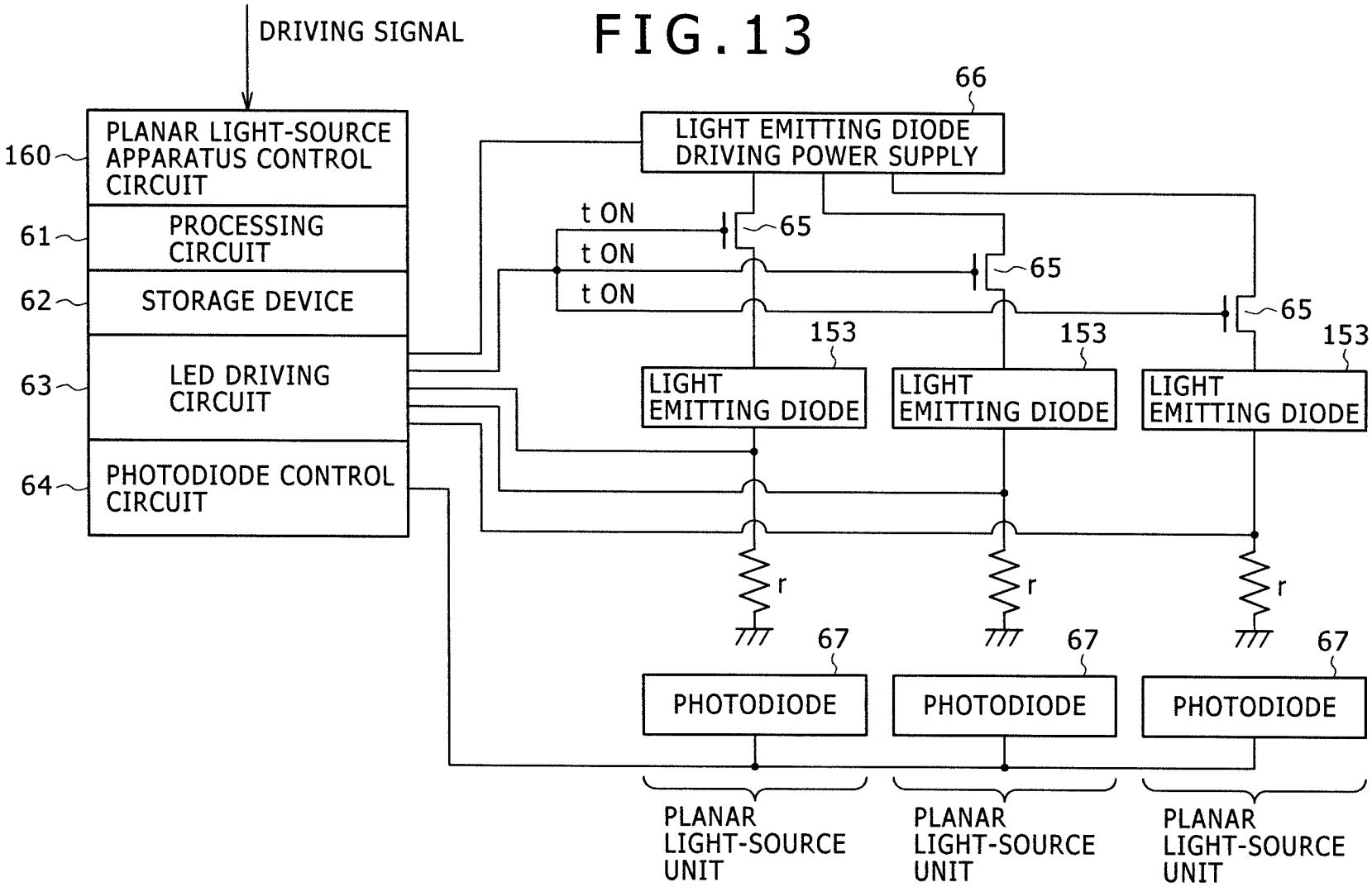
FIG. 13 is a diagram showing a planar light-source apparatus control circuit of the planar light-source apparatus employed in the image display apparatus assembly according to the fifth embodiment.

The illumination light emitted by the light emitting diode 153 is radiated to penetrate a light diffusion plate and propagate to the rear face of the image display panel 130 by way of an optical functional sheet group not shown in the diagrams of FIGS. 13 and 14. The optical functional sheet group includes a light diffusion sheet, a prism sheet and a polarization conversion sheet. As shown in the diagram of FIG. 13, a photodiode 67 employed in a planar light-source apparatus driving circuit 160 to be described below by referring to the diagram of FIG. 13 is provided for a planar light-source unit 152 to serve as an optical sensor. The photodiode 67 is used for measuring the luminance and chromaticity of illumination light emitted by the light emitting diode 153 employed in the planar light-source unit 152 for which the photodiode 67 is provided.

As shown in the diagrams of FIGS. 12 and 13, the planar light-source apparatus driving circuit 160 for driving the planar light-source unit 152 on the basis of a planar light-source apparatus control signal received from the signal processing section 20 as a driving signal controls the light emitting diodes 153 of the planar light-source unit 152 in order to put the light emitting diodes 153 in turned-on and turned-off states by adoption of a PWM (Pulse Width Modulation) control technique. As shown in the diagram of FIG. 13, the planar light-source apparatus driving circuit 160 employs elements including a processing circuit 61, a storage device 62 to serve as a memory, an LED driving circuit 63, a photodiode control circuit 64, FETs each serving as a switching device 65 and a light emitting diode driving power supply 66 serving as a constant-current source in addition to the photodiodes 67 cited above. Commonly known circuits and/or devices can be used as these elements composing the planar light-source apparatus driving circuit 160.

The light emission state of the light emitting diode 153 for a current image display frame is measured by the photodiode 67 which then outputs a signal representing a result of the measurement to the photodiode control circuit 64. The photodiode control circuit 64 and the processing circuit 61 convert the measurement result signal into data for example representing the luminance and chromaticity of illumination light emitted by the light emitting diode 153, supplying the data to the LED driving circuit 63. The LED driving circuit 63 then controls the switching device 65 in order to adjust the light emission state of the light emitting diode 153 for the next image display frame in a feedback control mechanism.

On the downstream side of the light emitting diode 153, a resistor r for detection of a current flowing through the light emitting diode 153 is connected in series with the light emitting diode 153. The current flowing through the current detection resistor r is converted into a voltage appearing between the two ends of the resistor r, that is, a voltage drop along the resistor r. The LED driving circuit 63 also controls the operation of the light emitting diode driving power supply 66 so that the voltage drop between the two ends of the current detection resistor r is sustained at a constant magnitude determined in advance. In the diagram of FIG. 13, only one light emitting diode driving power supply 66 serving as a constant-current source is shown. In actuality, however, a light emitting diode driving power supply 66 is provided for every light emitting diode 153. It is to be noted that, in the diagram of FIG. 13, only 3 light emitting diodes 153 are shown whereas, in the diagram of FIG. 14, only one light emitting diode 153 is included in one planar light-source unit 152. In actuality, however, the number of light emitting diodes 153 included in one planar light-source unit 152 is by no means limited to one.

As described previously, every pixel is configured as a set of four sub-pixels, i.e., first, second, third and fourth sub-pixels. The luminance of light emitted by each of the sub-pixels is controlled by adoption of an 8-bit control technique. The control of the luminance of light emitted by every sub-pixel is referred to as gradation control for setting the luminance at one of $2^8$ levels, i.e., levels of 0 to 255. Thus, a PWM (Pulse Width Modulation) sub-pixel output signal for controlling the light emission time of every light emitting diode 153 employed in the planar light-source unit 152 is also controlled to a value PS at one of $2^8$ levels, i.e., the levels of 0 to 255. However, the method for controlling the luminance of light emitted by each of the sub-pixels is by no means limited to the 8-bit control technique. For example, the luminance of light emitted by each of the sub-pixels can also be controlled by adoption of a 10-bit control technique. In this case, the luminance of light emitted by each of the sub-pixels is controlled to a value at one of $2^{10}$ levels, i.e., levels of 0 to 1,023 whereas a PWM (Pulse Width Modulation) sub-pixel output signal for controlling the light emission time of every light emitting diode 153 employed in the planar light-source unit 152 is also controlled to a value PS at one of $2^{10}$ levels, i.e., the levels of 0 to 1,023. In the case of the 10-bit control technique, a value at the levels of 0 to 1,023 is represented by a 10-bit expression which is 4 times the 8-bit expression representing a value at the levels of 0 to 255 for the 8-bit control technique.

Figure 15A:
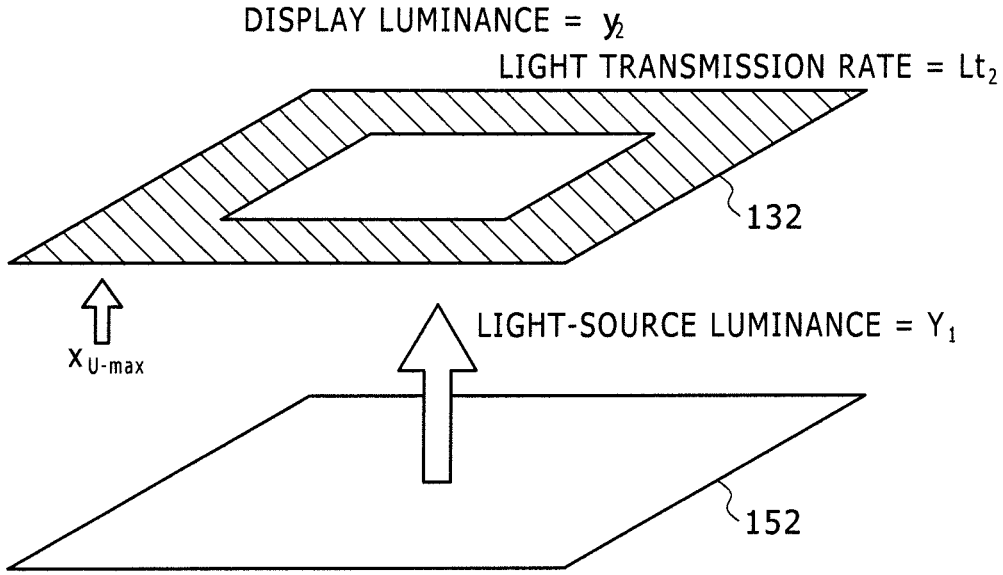
FIGS. 15A and 15B are each a conceptual diagram to be referred to in explanation of a state of increasing and decreasing a light-source luminance $Y_2$ of a planar light-source unit in accordance with control executed by a planar light-source apparatus driving circuit so that the planar light-source unit produces a second prescribed value $Y_2$ of the display luminance on the assumption that a control signal corresponding to a signal maximum value $X_{max-(s,t)}$ in the display area unit has been supplied to the sub-pixel.

Quantities related to the optical transmittance Lt (also referred to as the aperture ratio) of a sub-pixel, the display luminance y of light radiated by a display-area portion corresponding to the sub-pixel and the light-source luminance Y of illumination light emitted by the planar light-source unit 152 are shown in diagrams of FIG. 15A as well as 15B and defined as follows.

A light-source luminance $Y_1$ is the highest value of the light-source luminance Y. In the following description, the light-source luminance $Y_1$ is also referred to as a light-source luminance first prescribed value in some cases.

An optical transmittance $Lt_1$ is the maximum value of the optical transmittance Lt (also referred to as the aperture ratio Lt) of a sub-pixel in a virtual display area unit 132. In the following description, the optical transmittance $Lt_1$ is also referred to as an optical-transmittance first prescribed value in some cases.

An optical transmittance $Lt_2$ is the optical transmittance (also referred to as the aperture ratio) which is exhibited by a sub-pixel when it is assumed that a control signal corresponding to a signal maximum value $X_{max-(s,t)}$ in the display area unit 132 has been supplied to the sub-pixel. The signal maximum value $X_{max-(s,t)}$ is the largest value among values of sub-pixel output signals generated by the signal processing section 20 and supplied to the image display panel driving circuit 40 to serve as signals for driving all sub-pixels composing the virtual display area unit 132. In the following description, the optical transmittance $Lt_2$ is also referred to as an optical-transmittance second prescribed value in some cases. It is to be noted that the following relations are satisfied: $0 \leq Lt_2 \leq Lt_1$.

A display luminance $y_2$ is a display luminance obtained on the assumption that the light-source luminance is the light-source luminance first prescribed value $Y_1$ and the optical transmittance (also referred to as the aperture ratio) of the sub-pixel is the optical-transmittance second prescribed value $Lt_2$. In the following description, the display luminance $y_2$ is also referred to as a display luminance second prescribed value in some cases.

A light-source luminance $Y_2$ is a light-source luminance to be exhibited by the planar light-source unit 152 in order to set the luminance of light emitted by a sub-pixel at the display luminance second prescribed value $y_2$ when it is assumed that a control signal corresponding to the signal maximum value $X_{max-(s,t)}$ in the display area unit 132 has been supplied to the sub-pixel and the optical transmittance (also referred to as the aperture ratio) of the sub-pixel has been corrected to the optical-transmittance first prescribed value $Lt_1$. In some cases, however, a correction process may be carried out on the light-source luminance $Y_2$ as a process considering the effect of the light-source luminance of illumination light radiated by the planar light-source unit 152 on the light-source luminance of illumination light radiated by another planar light-source unit 152. In the following description, the light-source luminance $Y_2$ is also referred to as a light-source luminance second prescribed value in some cases.

Figure 15B:
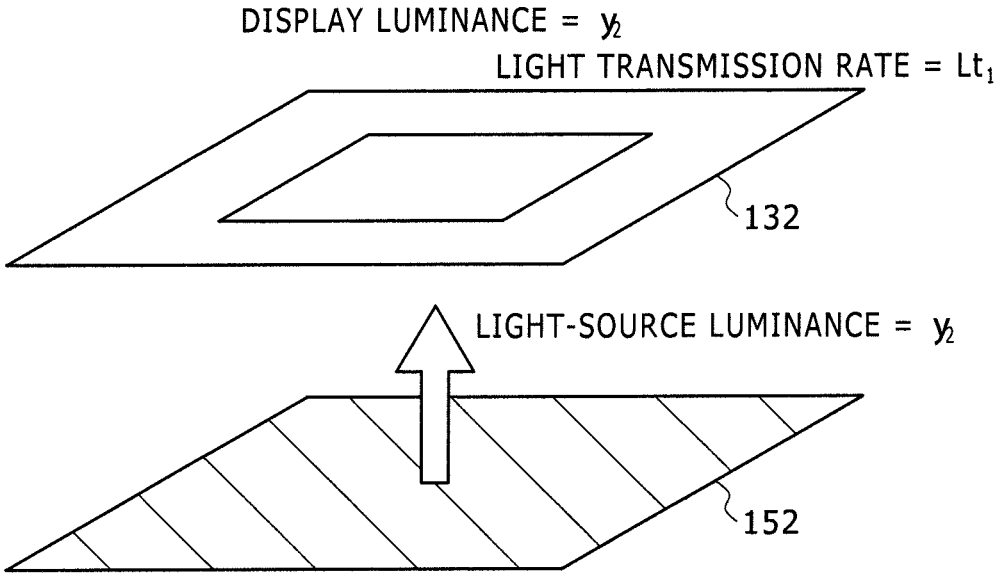

The planar light-source apparatus driving circuit 160 controls the luminance of light emitted by the light emitting diode 153 (or the light emitting device) employed in the planar light-source unit 152 associated with the virtual display area unit 132 so that the luminance (the display luminance second prescribed value $y_2$ at the optical-transmittance first prescribed value $Lt_1$) of a sub-pixel is obtained during the distributed driving operation (or the division driving operation) of the planar light-source apparatus when it is assumed that a control signal corresponding to the signal maximum value $X_{max-(s,t)}$ in the display area unit 132 has been supplied to the sub-pixel. To put it more concretely, the light-source luminance second prescribed value $Y_2$ is controlled so that the display luminance second prescribed value $y_2$ is obtained, for example, when the optical transmittance (also referred to as the aperture ratio) of the sub-pixel is set at the optical-transmittance first prescribed value $Lt_1$. For example, the light-source luminance second prescribed value $Y_2$ is decreased so that the display luminance second prescribed value $y_2$ is obtained. That is to say, for example, the light-source luminance second prescribed value $Y_2$ of the planar light-source unit 152 is controlled for every image display frame so that Eq. (A) given below is satisfied. It is to be noted that the relation $Y_2 \leq Y_1$ is satisfied. FIGS. 15A and 15B are each a conceptual diagram showing a state of control to increase and decrease the light-source luminance second prescribed value $Y_2$ of the planar light-source unit 152.

$$Y_2 \cdot Lt_1 = Y_1 \cdot Lt_2 \quad \text{(A)}$$

In order to control each of the sub-pixels, the signal processing section 20 supplies the sub-pixel output-signal values $X_{1-(p1,\ q)}$, $X_{2-(p1,\ q)}$, $X_{3-(p1,\ q)}$, $X_{1-(p2,\ q)}$, $X_{2-(p2,\ q)}$, $X_{3-(p2,\ q)}$ and $X_{4-(p,\ q)}$ to the image display panel driving circuit 40. Each of the sub-pixel output-signal values $X_{1-(p1,\ q)}$, $X_{2-(p1,\ q)}$, $X_{3-(p1,\ q)}$, $X_{1-(p2,\ q)}$, $X_{2-(p2,\ q)}$, $X_{3-(p2,\ q)}$ and $X_{4-(p,\ q)}$ is a signal for controlling the optical transmittance (also referred to as the aperture ratio) Lt of each of the sub-pixels. The image display panel driving circuit 40 generates control signals from the sub-pixel output-signal values $X_{1-(p1,\ q)}$, $X_{2-(p1,\ q)}$, $X_{3-(p1,\ q)}$, $X_{1-(p2,\ q)}$, $X_{2-(p2,\ q)}$, $X_{3-(p2,\ q)}$ and $X_{4-(p,\ q)}$ and supplies the control signals to each of the sub-pixels. On the basis of the control signals, a switching device employed in each of the sub-pixels is driven in order to apply a voltage determined in advance to first and second transparent electrodes composing a liquid-crystal cell so as to control the optical transmittance (also referred to as the aperture ratio) Lt of each of the sub-pixels. It is to be noted that the first and second transparent electrodes are shown in none of the figures. In this case, the larger the magnitude of the control signal, the higher the optical transmittance (also referred to as the aperture ratio) Lt of a sub-pixel and, thus, the higher the value of the luminance (that is, the display luminance y) of light radiated by a display area portion corresponding to the sub-pixel. That is to say, the image created as a result of transmission of light through the sub-pixels is bright. The image is normally a kind of dot aggregation.

The control of the display luminance y and the light-source luminance second prescribed value $Y_2$ is executed for every image display frame in the image display of the image display panel 130, every display area unit and every planar light-source unit. In addition, the operations carried out by the image display panel 130 and the planar light-source apparatus 150 for every sub-pixel in an image display frame are synchronized with each other. It is to be noted that, as electrical signals, the driving circuits described above receive a frame frequency also referred to as a frame rate and a frame time which is expressed in terms of seconds. The frame frequency is the number of images transmitted per second whereas the frame time is the reciprocal of the frame frequency.

In the case of the fourth embodiment, the extension process of extending a sub-pixel input signal in order to produce a sub-pixel output signal is carried out on all pixels on the basis of the extension coefficient $\alpha_0$. In the case of the fifth embodiment, on the other hand, the extension coefficient $\alpha_0$ is found for each of the (S×T) display area units 132, and the extension process of extending a sub-pixel input signal in order to produce a sub-pixel output signal is carried out on each individual one of the (S×T) display area units 132 on the basis of the extension coefficient $\alpha_0$ found for the individual virtual display area unit 132.

Then, in the (s, t)th planar light-source unit 152 associated with the (s, t)th virtual display area unit 132, the extension coefficient $\alpha_0$ found for which is $\alpha_{0-(s,\ t)}$, the luminance of illumination light radiated by the light source is $1/\alpha_{0-(s,\ t)}$.

As an alternative, the planar light-source apparatus driving circuit 160 controls the luminance of illumination light radiated by the light source included in the planar light-source unit 152 associated with the virtual display area unit 132 in order to set the luminance of light emitted by a sub-pixel at the display luminance second prescribed value $y_2$ for the optical-transmittance first prescribed value $Lt_1$ when it is assumed that a control signal corresponding to the signal maximum value $X_{max-(s,\ t)}$ in the display area unit 132 has been supplied to the sub-pixel. As described earlier, the signal maximum value $X_{max-(s,\ t)}$ is the largest value among the values $X_{1-(s,\ t)}$, $X_{2-(s,\ t)}$, $X_{3-(s,\ t)}$ and $X_{4-(s,\ t)}$ of the sub-pixel output signals generated by the signal processing section 20 and supplied to the image display panel driving circuit 40 to serve as signals for driving all sub-pixels composing every virtual display area unit 132. To put it more concretely, the light-source luminance second prescribed value $Y_2$ is controlled so that the display luminance second prescribed value $y_2$ is obtained, for example, when the optical transmittance (also referred to as the aperture ratio) of the sub-pixel is set at the optical-transmittance first prescribed value $Lt_1$. For example, the light-source luminance second prescribed value $Y_2$ is decreased so that the display luminance second prescribed value $y_2$ is obtained. That is to say, for example, the light-source luminance second prescribed value $Y_2$ of the planar light-source unit 152 is controlled for every image display frame so that Eq. (A) given before is satisfied.

By the way, if it is assumed that the luminance of illumination light radiated by the (s, t)th planar light-source unit 152 on the planar light-source apparatus 150 where (s, t)=(1, 1) is controlled, in some cases, it is necessary to consider the effects of the (S×T) other planar liquid-crystal units 152. If the (S×T) other planar liquid-crystal units 152 have effects on the (1, 1)th planar light-source unit 152, the effects have been determined in advance by making use of a light emission profile of the planar liquid-crystal units 152. Thus, differences can be found by inverse computation processes. As a result, a correction process can be carried out. Basic processing is explained as follows.

Luminance values (or the values of the light-source luminance second prescribed value $Y_2$) demanded of the (S×T) other planar liquid-crystal units 152 based on the condition expressed by Eq. (A) are represented by a matrix $[L_{P\times Q}]$. In addition, when only a specific planar light-source unit 152 is driven and other planar light-source units 152 are not, the luminance of illumination light radiated by the specific planar light-source unit 152 is found. The luminance of illumination light radiated by a driven planar light-source unit 152 with other planar light-source units 152 not driven is found in advance for each of the (S×T) other planar liquid-crystal units 152. The luminance values found in this way are expressed by a matrix $[L'_{P\times Q}]$. In addition, correction coefficients are represented by a matrix $[\alpha_{P\times Q}]$. In this case, a relation among these matrixes can be represented by Eq. (B-1) given below. The matrix $[\alpha_{P\times Q}]$ of the correction coefficients can be found in advance.

$$[L_{P\times Q}] = [L'_{P\times Q}] \cdot [\alpha_{P\times Q}] \quad \text{(B-1)}$$

Thus, the matrix $[L'_{P\times Q}]$ can be found from Eq. (B-1). That is to say, the matrix $[L'_{P\times Q}]$ can be found by carrying out an inverse matrix calculation process.

In other words, Eq. (B-1) can be rewritten into the following equation:

$$[L'_{P\times Q}] = [L_{P\times Q}] \cdot [\alpha_{P\times Q}]^{-1} \quad \text{(B-2)}$$

Then, the matrix $[L'_{P\times Q}]$ can be found in accordance with Eq. (B-2) given above. Subsequently, the light emitting diode 153 employed in the planar light-source unit 152 to serve as a light source is controlled so that luminance values expressed by the matrix $[L'_{P\times Q}]$ are obtained. To put it more concretely, the operations and the processing are carried out by making use of information stored as a data table in the storage device 62 which is employed in the planar light-source apparatus driving circuit 160 to serve as a memory. It is to be noted that, by controlling the light emitting diode 153, no element of the matrix $[L'_{P\times Q}]$ can have a negative value. It is thus needless to say that all results of the processing need to stay in a positive domain. Accordingly, the solution to Eq. (B-2) is not always a precise solution. That is to say, the solution to Eq. (B-2) is an approximate solution in some cases.

In the way described above, the matrix $[L'_{P\times Q}]$ of luminance values, which are obtained on the assumption that the planar light-source units are driven individually, is found on the basis of the matrix $[L_{P\times Q}]$ of luminance values computed by the planar light-source apparatus driving circuit 160 in accordance with Eq. (A) and on the basis of the matrix $[\alpha_{P\times Q}]$ representing correction values. Then, the luminance values represented by the matrix $[L'_{P\times Q}]$ are converted into integers in the range 0 to 255 on the basis of a conversion table which has been stored in the storage device 62. The integers are the values of a PWM (Pulse Width Modulation) sub-pixel output signal. By doing so, the processing circuit 61 employed in the planar light-source apparatus driving circuit 160 is capable of obtaining a value of the PWM (Pulse Width Modulation) sub-pixel output signal for controlling the light emission time of the light emitting diode 153 which is employed in the planar light-source unit 152. Then, on the basis of the value of the PWM (Pulse Width Modulation) sub-pixel output signal, the planar light-source apparatus driving circuit 160 determines an on time $t_{ON}$ and an off time $t_{OFF}$ for the light emitting diode 153 employed in the planar light-source unit 152. It is to be noted that the on time $t_{ON}$ and the off time $t_{OFF}$ satisfy the following equation:

$$t_{ON}+t_{OFF}=t_{CONST}$$

where notation $t_{CONST}$ in the above equation denotes a constant.

In addition, the duty cycle of a driving operation based on the PWM (Pulse Width Modulation) of the light emitting diode 153 is expressed by the following equations:

$$\text{Duty cycle}=t_{ON}/(t_{ON}+t_{OFF})=t_{ON}/t_{CONST}$$

Then, a signal corresponding to the on time $t_{ON}$ of the light emitting diode 153 employed in the planar light-source unit 152 is supplied to the LED driving circuit 63 so that the switching device 65 is put in a turned-on state for the on time $t_{ON}$ based on the magnitude of a signal received from the LED driving circuit 63 to serve as a signal corresponding to the on time $t_{ON}$. Thus, an LED driving current flows to the light emitting diode 153 from the light emitting diode driving power supply 66. As a result, the light emitting diode 153 emits light for the on time $t_{ON}$ in 1 image display frame. By doing so, the light emitted by the light emitting diode 153 illuminates the virtual display area unit 132 at an illumination level determined in advance.

It is to be noted that the planar light-source apparatus 150 adopting the distributed driving method which is also referred to as the division driving method can also be employed in the first to third embodiments.

Sixth Embodiment

A sixth embodiment is also obtained as a modified version of the fourth embodiment. The sixth embodiment implements an image display apparatus which is explained as follows. The image display apparatus according to the sixth embodiment employs an image display panel created as a 2-dimensional matrix of light emitting device units UN each having a first light emitting device corresponding to a first sub-pixel for emitting a red color, a second light emitting device corresponding to a second sub-pixel for emitting a green color, a third light emitting device corresponding to a third sub-pixel for emitting a blue color and a fourth light emitting device corresponding to a fourth sub-pixel for emitting a white color. The image display panel employed in the image display apparatus according to the sixth embodiment is for example an image display panel having a configuration and a structure which are described below. It is to be noted that the number of aforementioned light emitting device units UN can be determined on the basis of specifications demanded of the image display apparatus.

That is to say, the image display panel employed in the image display apparatus according to the sixth embodiment is an image display panel of a passive matrix type or an active matrix type. The image display panel employed in the image display apparatus according to the sixth embodiment is a color image display panel of a direct-view type. A color image display panel of a direct-view type is an image display panel which is capable of displaying a directly viewable color image by controlling the light emission and no-light emission states of each of the first, second, third and fourth light emitting devices.

As an alternative, the image display panel employed in the image display apparatus according to the sixth embodiment can also be designed as an image display panel of a passive matrix type or an active matrix type but the image display panel serves as a color image display panel of a projection type. A color image display panel of a projection type is an image display panel which is capable of displaying a color image projected on a projection screen by controlling the light emission and no-light emission states of each of the first, second, third and fourth light emitting devices.

Figure 16:
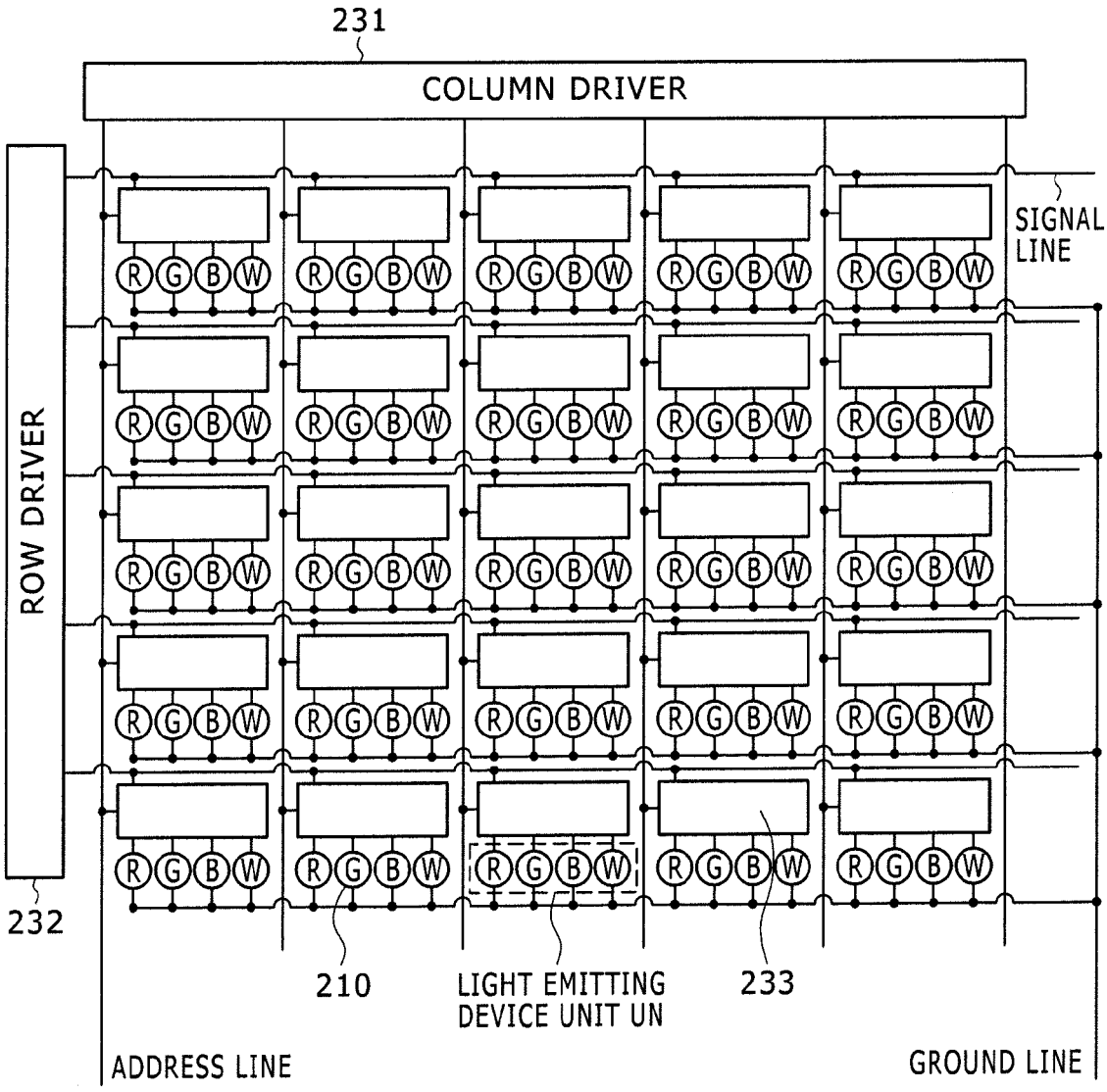
FIG. 16 is a diagram showing an equivalent circuit of an image display apparatus according to a sixth embodiment of the present invention.

FIG. 16 is a diagram showing an equivalent circuit of an image display apparatus according to the sixth embodiment. As described above, the image display apparatus according to the sixth embodiment generally employs a passive-matrix or active-matrix driven color image display panel of the direct-view type. In the diagram of FIG. 16, reference notation R denotes a first sub-pixel serving as a first light emitting device 210 for emitting light of the red color whereas reference notation G denotes a second sub-pixel serving as a second light emitting device 210 for emitting light of the green color. By the same token, reference notation B denotes a third sub-pixel serving as a third light emitting device 210 for emitting light of the blue color whereas reference notation W denotes a fourth sub-pixel serving as a fourth light emitting device 210 for emitting light of the white color.

A specific electrode of each of the sub-pixels R, G, B and W each serving as a light emitting device 210 is connected to a driver 233. The specific electrode connected to the driver 233 can be the p-side or n-side electrode of the sub-pixel. The driver 233 is connected to a column driver 231 and a row driver 232. Another electrode of each of the sub-pixels R, G, B and W each serving as a light emitting device 210 is connected to the ground. If the specific electrode connected to the driver 233 is the p-side electrode of the sub-pixel, the other electrode connected to the ground is the n-side electrode of the sub-pixel. If the specific electrode connected to the driver 233 is the n-side electrode of the sub-pixel, on the other hand, the other electrode connected to the ground is the p-side electrode of the sub-pixel.

In execution of control of the light emission and no-light emission states of every light emitting device 210, a light emitting device 210 is selected by the driver 233 for example in accordance with a signal received from the row driver 232. Prior to the execution of this control, the column driver 231 has supplied a luminance signal for driving the light emitting device 210 to the driver 233. To put it in detail, the driver 233 selects a first sub-pixel serving as a first light emitting device R for emitting light of the red color, a second sub-pixel serving as a second light emitting device G for emitting light of the green color, a third sub-pixel serving as a third light emitting device B for emitting light of the blue color or a fourth sub-pixel serving as a fourth light emitting device W for emitting light of the white color. On a time division basis, the driver 233 controls the light emission and no-light emission states of the first sub-pixel serving as a first light emitting device R for emitting light of the red color, the second sub-pixel serving as a second light emitting device G for emitting light of the green color, the third sub-pixel serving as a third light emitting device B for emitting light of the blue color and the fourth sub-pixel serving as a fourth light emitting device W for emitting light of the white color. As an alternative, the driver 233 drives the first sub-pixel serving as a first light emitting device R for emitting light of the red color, the second sub-pixel serving as a second light emitting device G for emitting light of the green color, the third sub-pixel serving as a third light emitting device B for emitting light of the blue color and the fourth sub-pixel serving as a fourth light emitting device W for emitting light of the white color to emit light at the same time. In the case of the color image display apparatus of the direct-view type, the image observer directly views the image displayed on the apparatus. In the case of the color image display apparatus of the projection type, on the other hand, the image observer views the image, which is displayed on the screen of a projector by way of a projection lens.

Figure 17:
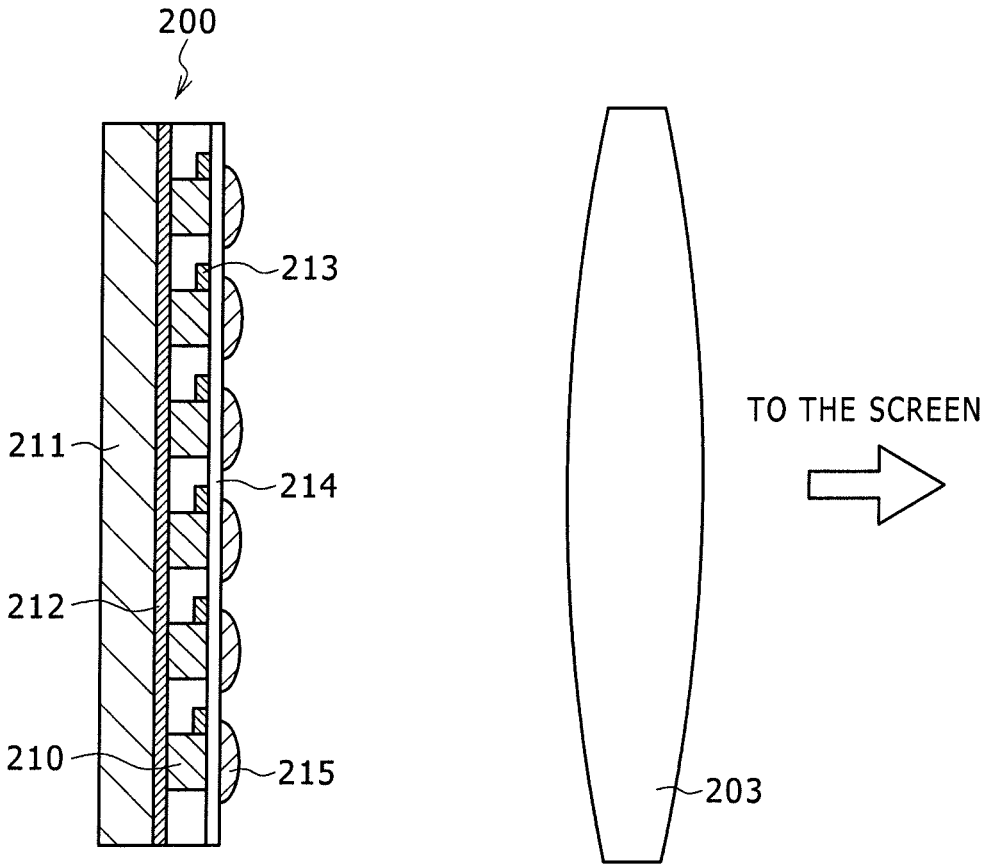
FIG. 17 is a conceptual diagram showing an image display panel employed in the image display apparatus according to the sixth embodiment.

It is to be noted that FIG. 17 is given to serve as a conceptual diagram showing an image display panel employed in the image display apparatus according to the sixth embodiment. As described above, in the case of the color image display apparatus of the direct-view type, the image observer directly views the image displayed on the apparatus. In the case of the color image display apparatus of the projection type, on the other hand, the image observer views the image, which is displayed on the screen of a projector by way of a projection lens 203. The image display panel is shown in the diagram of FIG. 17 as a light emitting device panel 200.

The light emitting device panel 200 includes a support body 211, a light emitting device 210, an X-direction line 212, a Y-direction line 213, a transparent base material 214 and a micro-lens 215. The support body 211 is a printed circuit board. The light emitting device 210 is attached to the support body 211. The X-direction line 212 is created on the support body 211, electrically connected to a specific one of the electrodes of the light emitting device 210 and electrically connected to the column driver 231 or the row driver 232. The Y-direction line 213 is electrically connected to the one of the electrodes of the light emitting device 210 and electrically connected to the row driver 232 or the column driver 231. If the specific electrode of the light emitting device 210 is the p-side electrode of the light emitting device 210, the other electrode of the light emitting device 210 is the n-side electrode of the light emitting device 210. If the specific electrode of the light emitting device 210 is the n-side electrode of the light emitting device 210, on the other hand, the other electrode of the light emitting device 210 is the p-side electrode of the light emitting device 210. If the X-direction line 212 is electrically connected to the column driver 231, the Y-direction line 213 is connected to the row driver 232. If the X-direction line 212 is electrically connected to the row driver 232, on the other hand, the Y-direction line 213 is connected to the column driver 231. The transparent base material 214 is a base material for covering the light emitting device 210. The micro-lens 215 is provided on the transparent base material 214. However, the configuration of the light emitting device panel 200 is by no means limited to this configuration.

In the case of the sixth embodiment, the extension process explained earlier in the description of the fourth embodiment can be carried out in order to generate a sub-pixel output signal for controlling the light emission state of each of the first light emitting device serving as the first sub pixel, the second light emitting device serving as the second sub pixel, the third light emitting device serving as the third sub pixel and the fourth light emitting device serving as the fourth sub pixel. Then, by driving the image display apparatus on the basis of the values of the sub-pixel output signals obtained as a result of the extension process, the luminance of light radiated by the image display apparatus as a whole can be increased by $\alpha_0$ times. If the luminance of light emitted by each of the first light emitting device serving as the first sub pixel, the second light emitting device serving as the second sub pixel, the third light emitting device serving as the third sub pixel and the fourth light emitting device serving as the fourth sub pixel is decreased by $(1/\alpha_0)$ times, the power consumption of the image display apparatus as a whole can be reduced without deteriorating the quality of the displayed image.

In some cases, the process explained earlier in the description of the first or fifth embodiment can be carried out in order to generate a sub-pixel output signal for controlling the light emission state of each of the first light emitting device serving as the first sub pixel, the second light emitting device serving as the second sub pixel, the third light emitting device serving as the third sub pixel and the fourth light emitting device serving as the fourth sub pixel. In addition, the image display apparatus explained in the description of the sixth embodiment can be employed in the first, second, third and fifth embodiments.

Seventh Embodiment

A seventh embodiment is also obtained as a modified version of the first embodiment. However, the seventh embodiment implements a configuration according to the (1-B)th mode.

In the case of the seventh embodiment, with regard to every pixel group PG, the signal processing section 20 finds:

a first sub-pixel mixed input-signal value $x_{1-(p,q)-mix}$ on the basis of the first sub-pixel input-signal value $x_{1-(p1,q)}$ received for the first pixel $Px_1$ pertaining to the pixel group PG and the first sub-pixel input-signal value $x_{1-(p2,q)}$ received for the second pixel $Px_2$ pertaining to the pixel group PG;

a second sub-pixel mixed input-signal value $x_{2-(p,q)-mix}$ on the basis of the second sub-pixel input-signal value $x_{2-(p1,q)}$ received for the first pixel $Px_1$ pertaining to the pixel group PG and the second sub-pixel input-signal value $x_{2-(p2,q)}$ received for the second pixel $Px_2$ pertaining to the pixel group PG; and a third sub-pixel mixed input-signal value $x_{3-(p,q)-mix}$ on the basis of the third sub-pixel input-signal value $x_{3-(p1,q)}$ received for the first pixel $Px_1$ pertaining to the pixel group PG and the third sub-pixel input-signal value $x_{3-(p2,q)}$ received for the second pixel $Px_2$ pertaining to the pixel group PG.

To put it more concretely, the signal processing section 20 finds the first sub-pixel mixed input-signal value $x_{1-(p,q)-mix}$, the second sub-pixel mixed input-signal value $x_{2-(p,q)-mix}$ and the third sub-pixel mixed input-signal value $x_{3-(p,q)-mix}$ in accordance with Eqs. (71-A), (71-B) and (71-C) respectively as follows:

$$x_{1-(p,q)-mix}=(x_{1-(p1,q)}+x_{1-(p2,q)}) \quad (71\text{-A})$$

$$x_{2-(p,q)-mix}=(x_{2-(p1,q)}+x_{2-(p2,q)}) \quad (71\text{-B})$$

$$x_{3-(p,q)-mix}=(x_{3-(p1,q)}+x_{3-(p2,q)}) \quad (71\text{-C})$$

Then, the signal processing section 20 finds a fourth sub-pixel output-signal value $X_{4-(p,\ q)}$ on the basis of the first sub-pixel mixed input-signal value $x_{1-(p,\ q)-mix}$, the second sub-pixel mixed input-signal value $x_{2-(p,\ q)-mix}$ and the third sub-pixel mixed input-signal value $x_{3-(p,\ q)-mix}$.

To put it more concretely, the signal processing section 20 sets the fourth sub-pixel output-signal value $X_{4-(p,\ q)}$ at $Min'_{(p,\ q)}$ in accordance with the following equation:

$$X_{4-(p,q)}=Min'_{(p,q)} \tag{72}$$

In the above equation, notation $Min'_{(p,\ q)}$ denotes a value smallest among the values of the following three signals: the first sub-pixel mixed input-signal value $x_{1-(p,\ q)-mix}$, the second sub-pixel mixed input-signal value $x_{2-(p,\ q)-mix}$ and the third sub-pixel mixed input-signal value $x_{3-(p,\ q)-mix}$.

By the way, notation $Max'_{(p,\ q)}$ used in subsequent descriptions denotes a value largest among the values of the following three signals: the first sub-pixel mixed input-signal value $x_{1-(p,\ q)-mix}$, the second sub-pixel mixed input-signal value $x_{2-(p,\ q)-mix}$ and the third sub-pixel mixed input-signal value $x_{3-(p,\ q)-mix}$.

It is to be noted that, also in the case of the seventh embodiment, the same processing as the first embodiment can be carried out. In this case, Eq. (72) given above is applied in order to find the fourth sub-pixel output-signal value $X_{4-(p,\ q)}$. If the same processing as the fourth embodiment is carried out, on the other hand, Eq. (72') given below is applied in order to find the fourth sub-pixel output-signal value $X_{4-(p,\ q)}$.

$$X_{4-(p,q)}=Min'_{(p,q)}\cdot\alpha_0/\chi \tag{72'}$$

In addition, the signal processing section 20 also finds:

a first sub-pixel output-signal value $X_{1-(p1,\ q)}$ for the first pixel $Px_1$ on the basis of the first sub-pixel mixed input-signal value $x_{1-(p,\ q)-mix}$ and the first sub-pixel input-signal value $x_{1-(p1,\ q)}$ received for the first pixel $Px_1$;

a first sub-pixel output-signal value $X_{1-(p2,\ q)}$ for the second pixel $Px_2$ on the basis of the first sub-pixel mixed input-signal value $x_{1-(p,\ q)-mix}$ and the first sub-pixel input-signal value $x_{1-(p2,\ q)}$ received for the second pixel $PX_2$;

a second sub-pixel output-signal value $X_{2-(p1,\ q)}$ for the first pixel $Px_1$ on the basis of the second sub-pixel mixed input-signal value $x_{2-(p,\ q)-mix}$ and the second sub-pixel input-signal value $x_{2-(p1,\ q)}$ received for the first pixel $Px_1$;

a second sub-pixel output-signal value $X_{2-(p2,\ q)}$ for the second pixel $Px_2$ on the basis of the second sub-pixel mixed input-signal value $x_{2-(p,\ q)-mix}$ and the second sub-pixel input-signal value $x_{2-(p2,\ q)}$ received for the second pixel $Px_2$;

a third sub-pixel output-signal value $X_{3-(p1,\ q)}$ for the first pixel $Px_1$ on the basis of the third sub-pixel mixed input-signal value $x_{3-(p,\ q)-mix}$ and the third sub-pixel input-signal value $x_{3-(p1,\ q)}$ received for the first pixel $Px_1$; and a third sub-pixel output-signal value $X_{3-(p2,\ q)}$ for the second pixel $Px_2$ on the basis of the third sub-pixel mixed input-signal value $x_{3-(p,\ q)-mix}$ and the third sub-pixel input-signal value $x_{3-(p2,\ q)}$ received for the second pixel $Px_2$.

Then, the signal processing section 20 outputs the fourth sub-pixel output-signal value $X_{4-(p,\ q)}$ computed for the (p, q)th pixel group PG, the first sub-pixel output-signal value $X_{1-(p1,\ q)}$, the second sub-pixel output-signal value $X_{2-(p1,\ q)}$ and the third sub-pixel output-signal value $X_{3-(p1,\ q)}$, which have been computed for the first pixel $Px_1$ pertaining to the (p, q)th pixel group PG as well as the first sub-pixel output-signal value $X_{1-(p2,\ q)}$, the second sub-pixel output-signal value $X_{2-(p2,\ q)}$ and the third sub-pixel output-signal value $X_{3-(p2,\ q)}$, which have been computed for the second pixel $Px_2$ pertaining to the (p, q)th pixel group PG.

Next, the following description explains how to find the fourth sub-pixel output-signal value $X_{4-(p,\ q)}$ for the (p, q)th pixel group PG as well as the first sub-pixel output-signal value $X_{1-(p1,\ q)}$, the second sub-pixel output-signal value $X_{2-(p1,\ q)}$, the third sub-pixel output-signal value $X_{3-(p1,\ q)}$, the first sub-pixel output-signal value $X_{1-(p2,\ q)}$, the second sub-pixel output-signal value $X_{2-(p2,\ q)}$ and the third sub-pixel output-signal value $X_{3-(p2,\ q)}$.

Process 700-A

First of all, the signal processing section 20 finds the fourth sub-pixel output-signal value $X_{4-(p,\ q)}$ for every pixel group $PG_{(p,\ q)}$ on the basis of the values of sub-pixel input signals received for the pixel group $PG_{(p,\ q)}$ in accordance with Eqs. (71-A) to (71-C) and (72).

Process 710-A

Then, the signal processing section 20 finds a first sub-pixel mixed output-signal value $X_{1-(p,\ q)-mix}$, a second sub-pixel mixed output-signal value $X_{2-(p,\ q)-mix}$ and a third sub-pixel mixed output-signal value $X_{3-(p,\ q)-mix}$ from the fourth sub-pixel output-signal value $X_{4-(p,\ q)}$ found for every pixel group $PG_{(p,\ q)}$ and a maximum value $Max'_{(p,\ q)}$ on the basis of Eqs. (73-A) to (73-C) respectively. Subsequently, the signal processing section 20 finds the first sub-pixel output-signal value $X_{1-(p1,\ q)}$, the second sub-pixel output-signal value $X_{2-(p1,\ q)}$, the third sub-pixel output-signal value $X_{3-(p1,\ q)}$, the first sub-pixel output-signal value $X_{1-(p2,\ q)}$, the second sub-pixel output-signal value $X_{2-(p2,\ q)}$ and the third sub-pixel output-signal value $X_{3-(p2,\ q)}$ from the first sub-pixel mixed output-signal value $X_{1-(p,\ q)-mix}$, the second sub-pixel mixed output-signal value $X_{2-(p,\ q)-mix}$ and the third sub-pixel mixed output-signal value $X_{3-(p,\ q)-mix}$ on the basis of Eqs. (74-A) to (74-F) respectively. This process is carried out for each of the (P×Q) pixel groups $PG_{(p,\ q)}$. Eqs. (73-A) to (73-C) and Eqs. (74-A) to (74-F) are listed as follows:

$$X_{1-(p,q)-mix}=\{x_{1-(p,q)-mix}\cdot(Max'_{(p,q)}+\chi\cdot X_{4-(p,q)})\}/Max'_{(p,q)}-\chi\cdot X_{4-(p,q)} \tag{73-A}$$

$$X_{2-(p,q)-mix}=\{x_{2-(p,q)-mix}\cdot(Max'_{(p,q)}+\chi\cdot X_{4-(p,q)})\}/Max'_{(p,q)}-\chi\cdot X_{4-(p,q)} \tag{73-B}$$

$$X_{3-(p,q)-mix}=\{x_{3-(p,q)-mix}\cdot(Max'_{(p,q)}+\chi\cdot X_{4-(p,q)})\}/Max'_{(p,q)}-\chi\cdot X_{4-(p,q)} \tag{73-C}$$

$$X_{1-(p1,q)}=X_{1-(p,q)-mix}\cdot\{x_{1-(p1,q)}/(x_{1-(p1,q)}+x_{1-(p2,q)})\} \tag{74-A}$$

$$X_{1-(p2,q)}=X_{1-(p,q)-mix}\cdot\{x_{1-(p2,q)}/(x_{1-(p1,q)}+x_{1-(p2,q)})\} \tag{74-B}$$

$$X_{2-(p1,q)}=X_{2-(p,q)-mix}\cdot\{x_{2-(p1,q)}/(x_{2-(p1,q)}+x_{2-(p2,q)})\} \tag{74-C}$$

$$X_{2-(p2,q)}=X_{2-(p,q)-mix}\cdot\{x_{2-(p2,q)}/(x_{2-(p1,q)}+x_{2-(p2,q)})\} \tag{74-D}$$

$$X_{3-(p1,q)}=X_{3-(p,q)-mix}\cdot\{x_{3-(p1,q)}/(x_{3-(p1,q)}+x_{3-(p2,q)})\} \tag{74-E}$$

$$X_{3-(p2,q)}=X_{3-(p,q)-mix}\cdot\{x_{3-(p2,q)}/(x_{3-(p1,q)}+x_{3-(p2,q)})\} \tag{74-F}$$

The following description explains how to find the first sub-pixel output-signal value $X_{1-(p1,\ q)}$, the second sub-pixel output-signal value $X_{2-(p1,\ q)}$ and the third sub-pixel output-signal value $X_{3-(p1,\ q)}$, the first sub-pixel output-signal value $X_{1-(p2,\ q)}$, the second sub-pixel output-signal value $X_{2-(p2,\ q)}$, the third sub-pixel output-signal value $X_{3-(p2,\ q)}$ and the fourth sub-pixel output-signal value $X_{4-(p,\ q)}$ for the (p, q)th pixel group $PG_{(p,\ q)}$ in accordance with the fourth embodiment.

Process 700-B

First of all, the signal processing section 20 finds the saturation S and the brightness/lightness value V(S) for every pixel group $PG_{(p,\ q)}$ on the basis of the values of sub-pixel input signals received for a plurality of pixels pertaining to the pixel group $PG_{(p,\ q)}$. To put it more concretely, the signal processing section 20 finds the saturation S for each pixel group $PG_{(p,\ q)}$ and the brightness/lightness V(S) as a function of saturation S on the basis of the first sub-pixel input-signal value $x_{1-(p1,\ q)}$, the second sub-pixel input-signal values $x_{2-(p1,\ q)}$ and the third sub-pixel input-signal values $x_{3-(p1,\ q)}$ which are received for the first pixel $Px_1$ pertaining to the pixel group $PG_{(p,\ q)}$ as well as on the basis of the first sub-pixel input-signal value $x_{1-(p2,\ q)}$, the second sub-pixel input-signal values $x_{2-(p2,\ q)}$ and the third sub-pixel input-signal values $x_{3-(p2,\ q)}$ which are received for the second pixel $Px_2$ pertaining to the pixel group $PG_{(p,\ q)}$ in accordance with Eqs. (71-A) to (71-C) given before and Eqs. (75-1) to (75-2) given below. The signal processing section 20 carries out this process for every pixel group $PG_{(p,\ q)}$.

$$S_{(p,q)}=(\mathrm{Max}'_{(p,q)}-\mathrm{Min}'_{(p,q)})/\mathrm{Max}'_{(p,q)} \tag{75-1}$$

$$V_{(p,q)}=\mathrm{Max}'_{(p,q)} \tag{75-2}$$

Process 710-B

Then, the signal processing section 20 finds an extension coefficient $\alpha_0$ on the basis of at least one of ratios $V_{max}(S)/V(S)$ found in process 700-B for a plurality of pixels $PG_{(p,\ q)}$.

To put it more concretely, in the case of the seventh embodiment, the minimum value $\alpha_{min}$ which is smallest among the ratios $V_{max}(S)/V(S)$ found for all the (P×Q) pixel groups is taken as the extension coefficient $\alpha_0$. That is to say, the value of the ratio $\alpha_{(p,\ q)}$ ($=V_{max}(S)/V_{(p,\ q)}(S)$) is found for each of the (P×Q) pixel groups and the smallest value $\alpha_{min}$ among the values of the ratio $\alpha_{(p,\ q)}$ is taken as the extension coefficient $\alpha_0$.

Process 720-B

Then, the signal processing section 20 finds a fourth sub-pixel output-signal value $X_{4-(p,\ q)}$ for the (p, q)th pixel group $PG_{(p,\ q)}$ on the basis of at least the sub-pixel input-signal values $x_{1-(p1,\ q)}$, $x_{1-(p2,\ q)}$, $x_{2-(p1,\ q)}$, $x_{2-(p2,\ q)}$, $x_{3-(p1,\ q)}$ and $x_{3-(p2,\ q)}$. To put it more concretely, in the case of the seventh embodiment, for each of the (P×Q) pixel groups $PG_{(p,\ q)}$, the signal processing section 20 finds a fourth sub-pixel output-signal value $X_{4-(p,\ q)}$ in accordance with Eqs. (71-A) to (71-C) and (72') which are given earlier.

Process 730-B

Then, the signal processing section 20 determines the first sub-pixel output-signal value $X_{1-(p1,\ q)}$, the second sub-pixel output-signal value $X_{2-(p1,\ q)}$, the third sub-pixel output-signal value $X_{3-(p1,\ q)}$, the first sub-pixel output-signal value $X_{1-(p2,\ q)}$, the second sub-pixel output-signal value $X_{2-(p2,\ q)}$ and the third sub-pixel output-signal value $X_{3-(p2,\ q)}$ on the basis of the ratios of an upper limit $V_{max}$ in the color space to the sub-pixel input-signal values $x_{1-(p1,\ q)}$, $x_{2-(p1,\ q)}$, $x_{3-(p1,\ q)}$, $x_{1-(p2,\ q)}$, $x_{2-(p2,\ q)}$ and $x_{3-(p2,\ q)}$ respectively.

To put it more concretely, the signal processing section 20 determines the first sub-pixel output-signal value $X_{1-(p1,\ q)}$, the second sub-pixel output-signal value $X_{2-(p1,\ q)}$, the third sub-pixel output-signal value $X_{3-(p1,\ q)}$, the first sub-pixel output-signal value $X_{1-(p2,\ q)}$, the second sub-pixel output-signal value $X_{2-(p2,\ q)}$ and the third sub-pixel output-signal value $X_{3-(p2,\ q)}$ on the basis of respectively Eqs. (74-A) to (74-F) given earlier. In this case, the first sub-pixel mixed output-signal value $X_{1-(p,\ q)-mix}$, the second sub-pixel mixed output-signal value $X_{2-(p,\ q)-mix}$ and the third sub-pixel mixed output-signal value $X_{3-(p,\ q)-mix}$ which are used in Eqs. (74-A) to (74-F) can be found in accordance with respectively Eqs. (3-A') to (3-C') given below.

$$X_{1-(p,q)-mix}=\alpha_0\cdot x_{1-(p,q)-mix}-\chi\cdot X_{4-(p,q)} \tag{3-A'}$$

$$X_{2-(p,q)-mix}=\alpha_0\cdot x_{2-(p,q)-mix}-\chi\cdot X_{4-(p,q)} \tag{3-B'}$$

$$X_{3-(p,q)-mix}=\alpha_0\cdot x_{3-(p,q)-mix}-\chi\cdot X_{4-(p,q)} \tag{3-C'}$$

In accordance with an image display apparatus assembly according to the seventh embodiment and a method for driving the image display apparatus assembly, the first sub-pixel output-signal value $X_{1-(p1,\ q)}$, the second sub-pixel output-signal value $X_{2-(p1,\ q)}$, the third sub-pixel output-signal value $X_{3-(p1,\ q)}$, the first sub-pixel output-signal value $X_{1-(p2,\ q)}$, the second sub-pixel output-signal value $X_{2-(p2,\ q)}$, the third sub-pixel output-signal value $X_{3-(p2,\ q)}$ and the fourth third sub-pixel output-signal value $X_{4-(p,\ q)}$ which are computed for the (p, q)th pixel group $PG_{(p,\ q)}$ are extended by $\alpha_0$ times in the same way as the fourth embodiment. Thus, in order to obtain the same luminance level of the displayed image as a configuration in which the first sub-pixel output-signal value $X_{1-(p1,\ q)}$, the second sub-pixel output-signal value $X_{2-(p1,\ q)}$, the third sub-pixel output-signal value $X_{3-(p1,\ q)}$, the first sub-pixel output-signal value $X_{1-(p2,\ q)}$, the second sub-pixel output-signal value $X_{2-(p2,\ q)}$, the third sub-pixel output-signal value $X_{3-(p2,\ q)}$ and the fourth sub-pixel output-signal value $X_{4-(p,\ q)}$ which are computed for the (p, q)th pixel group $PG_{(p,\ q)}$ are not extended, the luminance of illumination light radiated by the planar light-source apparatus 50 needs to be reduced by $(1/\alpha_0)$ times. Accordingly, the power consumption of the planar light-source apparatus 50 can be decreased.

As described above, a variety of processes carried out in execution of the method for driving the image display apparatus according to the seventh embodiment and the method for driving the image display apparatus assembly employing the image display apparatus can be made the same as a variety of processes carried out in execution of the method for driving the image display apparatus according to the first or fourth embodiment and their modified versions and the method for driving the image display apparatus assembly employing the image display apparatus. In addition, a variety of processes carried out in execution of the method for driving the image display apparatus according to the fifth embodiment and the method for driving the image display apparatus assembly employing the image display apparatus can be applied to the processes carried out in execution of the method for driving the image display apparatus according to the seventh embodiment and the method for driving the image display apparatus assembly employing the image display apparatus according to the seventh embodiment. On top of that, the image display panel according to the seventh embodiment, the image display apparatus employing the image display panel and the image display apparatus assembly including the image display apparatus can have the same configurations as respectively the configurations of the image display panel according to any one of the first to sixth embodiments, the image display apparatus employing the image display panel according to any one of the first to sixth embodiments and the image display apparatus assembly including the image display apparatus employing the image display panel according to any one of the first to sixth embodiments.

That is to say, the image display apparatus 10 according to the seventh embodiment also employs an image display panel 30 and a signal processing section 20. The image display apparatus assembly according to the seventh embodiment also employs the image display apparatus 10 and a planar light-source apparatus 50 for radiating illumination light to the rear face of the image display panel 30 employed in the image display apparatus 10. In addition, the image display panel 30, the signal processing section 20 and the planar light-source apparatus 50 which are employed in the seventh embodiment can have the same configurations as respectively the configurations of the image display panel 30, the signal processing section 20 and the planar light-source apparatus 50 which are employed in any one of the first to sixth embodiments. For this reason, detailed description of the configurations of the image display panel 30, the signal processing section 20 and the planar light-source apparatus 50 which are employed in the seventh embodiment is omitted in order to avoid duplications of explanations.

In the case of the seventh embodiment, the sub-pixel output signals are found on the basis of sub-pixel mixed input signals. Thus, a value computed in accordance with Eq. (75-1) as the value of $S_{(p,q)}$ is equal to or smaller than a value computed in accordance with Eq. (41-1) as the value of $S_{(p,q)-1}$ and a value computed in accordance with Eq. (41-3) as the value of $S_{(p,q)-2}$. As a result, the extension coefficient $\alpha_0$ has an even larger value which further increases the luminance. In addition, the signal processing and the signal processing circuit can be made simpler. These features exist also in a tenth embodiment to be described later.

It is to be noted that, if the difference between the first minimum value $Min_{(p,q)-1}$ of the first pixel $Px_{(p,q)-1}$ and the second minimum value $Min_{(p,q)-2}$ of the second pixel $Px_{(p,q)-2}$ is large, Eqs. (76-A), (76-B) and (76-C) given below can be used in place of respectively Eqs. (71-A), (71-B) and (71-C) which are given earlier. In Eqs. (76-A), (76-B) and (76-C), each notations $C_{711}$, $C_{712}$, $C_{721}$, $C_{722}$, $C_{731}$ and $C_{732}$ denotes a coefficient used as a weight. By carrying out processing based on Eqs. (76-A), (76-B) and (76-C) given below, the luminance can be further increased to an even higher level. This processing is also carried out by the aforementioned tenth embodiment to be described later.

$$x_{1-(p,q)-mix}=(C_{711}\cdot x_{1-(p1,q)}+C_{712}\cdot x_{1-(p2,q)}) \quad (76\text{-A})$$

$$x_{2-(p,q)-mix}=(C_{721}\cdot x_{2-(p1,q)}+C_{722}\cdot x_{2-(p2,q)}) \quad (76\text{-B})$$

$$x_{3-(p,q)-mix}=(C_{731}\cdot x_{3-(p1,q)}+C_{732}\cdot x_{3-(p2,q)}) \quad (76\text{-C})$$

Eighth Embodiment

An eighth embodiment implements a method for driving an image display apparatus according to the second mode of the present invention. To put it more concretely, the eighth embodiment implements a configuration according to the (2-A)th mode, a configuration according to the (2-A-1)th mode and the first configuration described earlier.

An image display apparatus according to the eighth also employs an image display panel and a signal processing section. The image display panel has a plurality of pixel groups PG laid out to form a 2-dimensional matrix. Each of the pixel groups PG has a first pixel $Px_1$ and a second pixel $Px_2$. The first pixel $Px_1$ includes a first sub-pixel R for displaying a first elementary color such as the red color, a second sub-pixel G for displaying a second elementary color such as the green color and a third sub-pixel B for displaying a third elementary color such as the blue color. On the other hand, the second pixel $Px_2$ includes a first sub-pixel R for displaying the first elementary color, a second sub-pixel G for displaying the second elementary color and a fourth sub-pixel W for displaying a fourth color such as the white color.

For each of the pixel groups PG, the signal processing section generates a first sub-pixel output signal, a second sub-pixel output signal and a third sub-pixel output signal for the first pixel $Px_1$ of the pixel group PG on the basis of respectively a first sub-pixel input signal, a second sub-pixel input signal and a third sub-pixel input signal which are received for the first pixel $Px_1$. In addition, the signal processing section also generates a first sub-pixel output signal and a second sub-pixel output signal for the second pixel $Px_2$ of the pixel group PG on the basis of respectively a first sub-pixel input signal and a second sub-pixel input signal which are received for the second pixel $Px_2$.

It is to be noted that, in the case of the eighth embodiment, the third sub-pixel is used as a sub-pixel for displaying the blue color. This is because the luminosity factor of the blue color is about ⅙ times that of the green color so that the number of third sub-pixels each used for displaying the blue color in a pixel group PG can be reduced to half without raising a big problem.

The image display apparatus according to the eighth embodiment and the image display apparatus assembly employing the image display apparatus can have configurations identical with the configurations of the image display apparatus according to any one of the first to sixth embodiments and the image display apparatus assembly employing the image display apparatus according to any one of the first to sixth embodiments. That is to say, the image display apparatus 10 according to the eighth embodiment also employs an image display panel 30 and a signal processing section 20. The image display apparatus assembly according to the eighth embodiment also employs the image display apparatus 10 and a planar light-source apparatus 50 for radiating illumination light to the rear face of the image display panel 30 employed in the image display apparatus 10. In addition, the signal processing section 20 and the planar light-source apparatus 50 which are employed in the eighth embodiment can have the same configurations as respectively the configurations of the signal processing section 20 and the planar light-source apparatus 50 which are employed in any one of the first to sixth embodiments. By the same token, the configurations of the ninth and the tenth embodiments to be described later are also identical with the configurations of any one of the first to sixth embodiments.

In addition, in the case of the eighth embodiment, for each of the pixel groups PG, the signal processing section 20 also generates a fourth sub-pixel output signal for the pixel group PG on the basis of a first sub-pixel input signal, a second sub-pixel input signal and a third sub-pixel input signal which are received for the first pixel $Px_1$ of the pixel group PG as well as on the basis of a first sub-pixel input signal, a second sub-pixel input signal and a third sub-pixel input signal which are received for the second pixel $Px_2$ of the pixel group PG.

On top of that, for each of the pixel groups PG, the signal processing section 20 also generates a third sub-pixel output signal for the pixel group PG on the basis of a third sub-pixel input signal received for the first pixel $Px_1$ of the pixel group PG and a third sub-pixel input signal received for the second pixel $Px_2$ of the pixel group PG.

Figure 18:
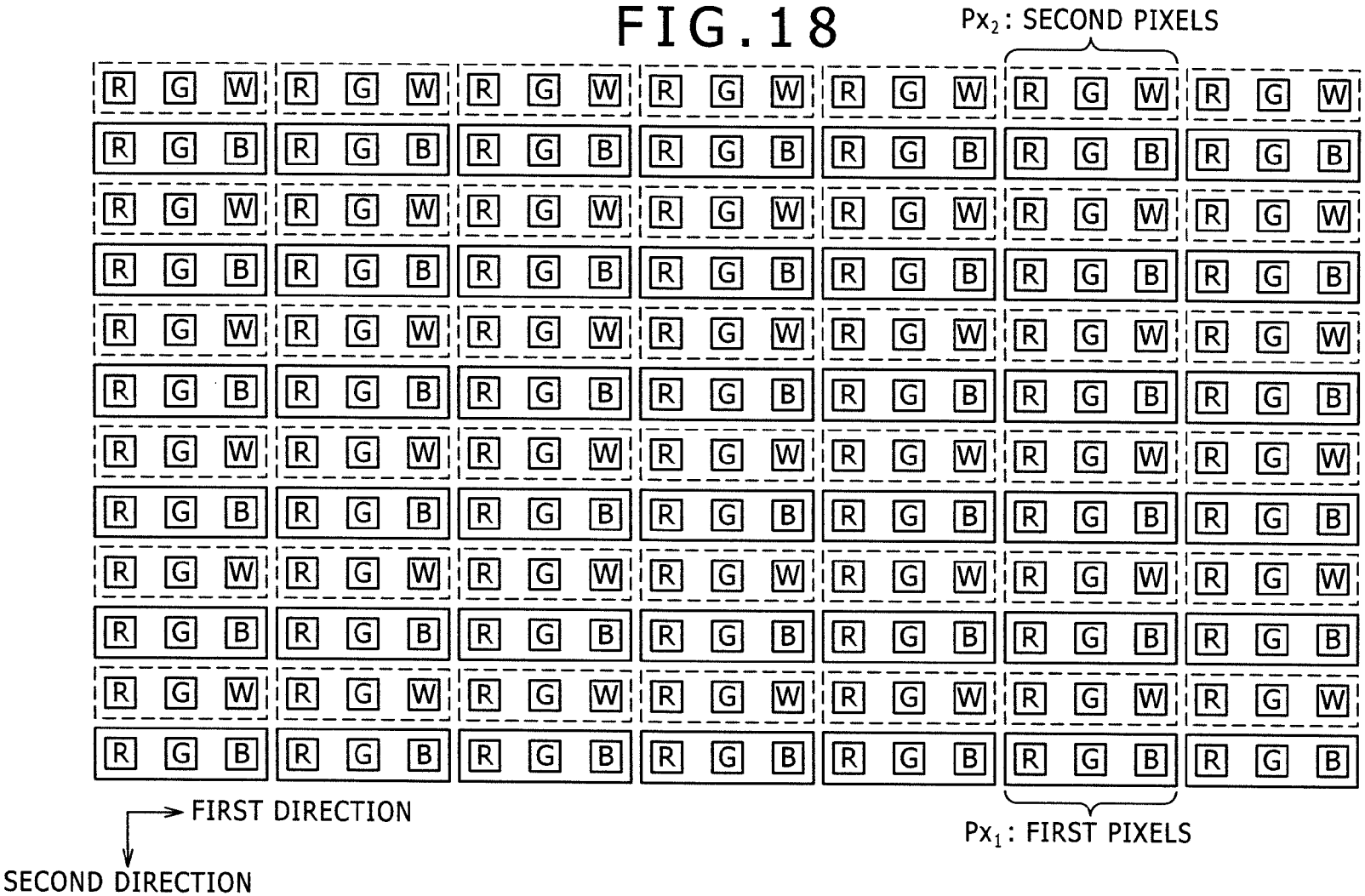
FIG. 18 is a model diagram showing locations of pixels and locations of pixel groups on an image display panel according to an eighth embodiment of the present invention.

It is to be noted that first pixels $Px_1$ and second pixels $Px_2$ are laid out as follows. P pixel groups PG are laid out in the first direction to form a row and Q such rows each including P pixel groups PG are laid out in the second direction to form a 2-dimensional matrix including (P×Q) pixel groups PG. As a result, pixel groups PG each having a first pixel $Px_1$ and a second pixel $Px_2$ are laid out to form the 2-dimensional matrix shown in a diagram of FIG. 18. In a diagram of FIG. 18, each first pixel $Px_1$ includes of sub-pixels R, G and B enclosed in a solid-line block whereas each second pixel $Px_2$ includes of sub-pixels R, G and W enclosed in a dashed-line block. In each pixel group PG, the first pixel $Px_1$ and the second pixel $Px_2$ are provided at adjacent locations separated from each other in the second direction as shown in the diagram of FIG.

18. On the other hand, any specific pixel group PG is separated away from an adjacent pixel group PG in the first direction in such a way that the first pixel $Px_1$ pertaining to the specific pixel group PG and the first pixel $Px_1$ pertaining to the adjacent pixel group PG are provided at adjacent locations adjacent to each other whereas the second pixel $Px_2$ pertaining to the specific pixel group PG and the second pixel $Px_2$ pertaining to the adjacent pixel group PG are provided at adjacent locations adjacent to each other. This configuration is referred to as a configuration according to a (2a)th mode of the present invention.

Figure 19:
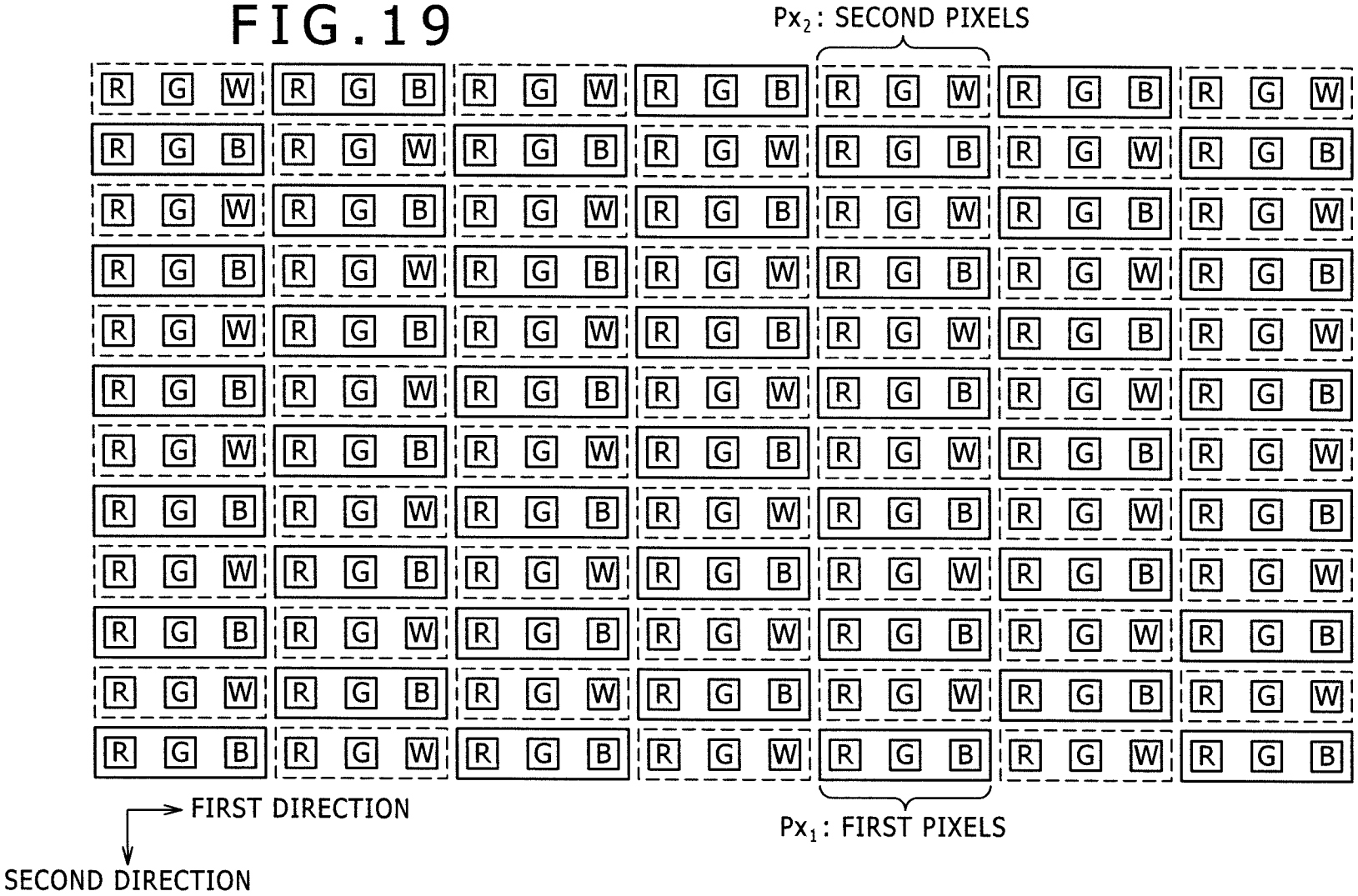
FIG. 19 is a model diagram showing other locations of pixels and other locations of pixel groups on the image display panel according to the eighth embodiment.

A configuration shown in a diagram of FIG. 19 is an alternative configuration which is referred to as a configuration according to a (2b)th mode of the present invention. Also in this configuration, P pixel groups PG are laid out in the first direction to form a row and Q such rows each including P pixel groups PG are laid out in the second direction to form a 2-dimensional matrix including (P×Q) pixel groups PG. As a result, pixel groups PG each including a first pixel $Px_1$ and a second pixel $Px_2$ are laid out to form the 2-dimensional matrix. Each first pixel $Px_1$ includes of sub-pixels R, G and B enclosed in a solid-line block whereas each second pixel $Px_2$ includes of sub-pixels R, G and W enclosed in a dashed-line block. In a pixel group PG, the first pixel $Px_1$ and the second pixel $Px_2$ are provided at adjacent locations separated from each other in the second direction. In the case of the configuration according to the (2b)th mode, however, any specific pixel group PG is separated away from an adjacent pixel group PG in the first direction in such a way that the first pixel $Px_1$ pertaining to the specific pixel group PG and the second pixel $Px_2$ pertaining to the adjacent pixel group PG are provided at adjacent locations adjacent to each other whereas the second pixel $Px_2$ pertaining to the specific pixel group PG and the first pixel $Px_1$ pertaining to the adjacent pixel group PG are provided at adjacent locations adjacent to each other.

In the case of the eighth embodiment, for the first pixel $Px_{(p,\ q)-1}$ pertaining to the (p, q)th pixel group $PG_{(p,\ q)}$ where notation p denotes an integer satisfying the relations $1 \le p \le P$ whereas notation q denotes an integer satisfying the relations $1 \le q \le Q$, the signal processing section 20 receives:

a first sub-pixel input signal provided with a value $x_{1-(p1,\ q)}$;

a second sub-pixel input signal provided with a value $x_{2-(p1,\ q)}$; and a third sub-pixel input signal provided with a value $x_{3-(p1,\ q)}$.

For the second pixel $Px_{(p,\ q)-2}$ pertaining to the (p, q)th pixel group $PG_{(p,\ q)}$, on the other hand, the signal processing section 20 receives:

a first sub-pixel input signal provided with a value $x_{1-(p2,\ q)}$;

a second sub-pixel input signal provided with a value $x_{2-(p2,\ q)}$; and a third sub-pixel input signal provided with a value $x_{3-(p2,\ q)}$.

In addition, in the case of the eighth embodiment, for the first pixel $Px_{(p,\ q)-1}$ pertaining to the (p, q)th pixel group $PG_{(p,\ q)}$, the signal processing section 20 generates:

a first sub-pixel output signal provided with a value $X_{1-(p1,\ q)}$ and used for determining the display gradation of the first sub-pixel R pertaining to the first pixel $Px_{(p,\ q)-1}$;

a second sub-pixel output signal provided with a value $X_{2-(p1,\ q)}$ and used for determining the display gradation of the second sub-pixel G pertaining to the first pixel $Px_{(p,\ q)-1}$; and a third sub-pixel output signal provided with a value $X_{3-(p1,\ q)}$ and used for determining the display gradation of the third sub-pixel B pertaining to the first pixel $Px_{(p,\ q)-1}$.

For the second pixel $Px_{(p,\ q)-2}$ pertaining to the (p, q)th pixel group $PG_{(p,\ q)}$, the signal processing section 20 generates:

a first sub-pixel output signal provided with a value $X_{1-(p2,\ q)}$ and used for determining the display gradation of the first sub-pixel R pertaining to the second pixel $Px_{(p,\ q)-2}$;

a second sub-pixel output signal provided with a value $X_{2-(p2,\ q)}$ and used for determining the display gradation of the second sub-pixel G pertaining to the second pixel $Px_{(p,\ q)-2}$; and a fourth sub-pixel output signal provided with a value $X_{4-(p,\ q)}$ and used for determining the display gradation of the fourth sub-pixel W pertaining to the second pixel $Px_{(p,\ q)-2}$.

In addition, the eighth embodiment implements the configuration according to the (2-A)th mode. In this configuration, for every pixel group PG, the signal processing section 20 finds a fourth sub-pixel output-signal value $X_{4-(p,\ q)}$ on the basis of a first signal value $SG_{(p,\ q)-1}$ found from the values of a first sub-pixel input signal, a second sub-pixel input signal and a third sub-pixel input signal which are received for the first pixel $Px_1$ pertaining to the pixel group PG as well as on the basis of a second signal value $SG_{(p,\ q)-2}$ found from the values of a first sub-pixel input signal, a second sub-pixel input signal and a third sub-pixel input signal which are received for the second pixel $Px_2$ pertaining to the pixel group PG, supplying the fourth sub-pixel output-signal value $X_{4-(p,\ q)}$ to the image display panel driving circuit 40. To put it more concretely, the eighth embodiment implements the configuration according to the (2-A-1)th mode in which the first signal value $SG_{(p,\ q)-1}$ is determined on the basis of the first minimum value $Min_{(p,\ q)-1}$ whereas the second signal value $SG_{(p,\ q)-2}$ is determined on the basis of the second minimum value $Min_{(p,\ q)-2}$. To put it even more concretely, the first signal value $SG_{(p,\ q)-1}$ is determined in accordance with Eq. (81-A) given below whereas the second signal value $SG_{(p,\ q)-2}$ is determined in accordance with Eq. (81-B) also given below. Then, the fourth sub-pixel output-signal value $X_{4-(p,\ q)}$ is found as the average of the first signal value $SG_{(p,\ q)-1}$ and the second signal value $SG_{(p,\ q)-2}$ in accordance with Eq. (1-A) which can be rewritten into Eq. (81-C) as follows.

$$SG_{(p,q)-1} = Min_{(p-q)-1} = x_{3-(p1,q)} \quad (81\text{-A})$$

$$SG_{(p,q)-2} = Min_{(p-q)-2} = x_{2-(p2,q)} \quad (81\text{-B})$$

$$X_{4-(p,q)} = \frac{(SG_{(p,q)-1} + SG_{(p,q)-2})}{2} \quad (1\text{-A})$$

$$= \frac{(x_{3-(p1,q)} + x_{2-(p2,q)})}{2} \quad (81\text{-C})$$

In addition, the eighth embodiment also implements the first configuration described previously. To put it more concretely, in the case of the eighth embodiment, the signal processing section 20 finds:

a first sub-pixel output-signal value $X_{1-(p1,\ q)}$ on the basis of at least the first sub-pixel input-signal value $x_{1-(p1,\ q)}$, the first maximum value $Max_{(p,\ q)-1}$, the first minimum value $Min_{(p,\ q)-1}$ and the first signal value $SG_{(p,\ q)-1}$;

a second sub-pixel output-signal value $X_{2-(p1,\ q)}$ on the basis of at least the second sub-pixel input-signal value $x_{2-(p1,\ q)}$, the first maximum value $Max_{(p,\ q)-1}$, the first minimum value $Min_{(p,\ q)-1}$ and the first signal value $SG_{(p,\ q)-1}$;

a first sub-pixel output-signal value $X_{1-(p2,\ q)}$ on the basis of at least the first sub-pixel input-signal value $x_{1-(p2,\ q)}$, the second maximum value $Max_{(p,\ q)-2}$, the second minimum value $Min_{(p,\ q)-2}$ and the second signal value $SG_{(p,\ q)-2}$; and a second sub-pixel output-signal value $X_{2-(p2,\ q)}$ on the basis of at least the second sub-pixel input-signal value $x_{2-(p2,\ q)}$, the second maximum value $Max_{(p,\ q)-2}$, the second minimum value $Min_{(p,\ q)-2}$ and the second signal value $SG_{(p,\ q)-2}$.

To put it more concretely, in the case of the eighth embodiment, the signal processing section 20 finds:

a first sub-pixel output-signal value $X_{1-(p1,\ q)}$ on the basis of $[x_{1-(p1,\ q)}, Max_{(p,\ q)-1}, Min_{(p,\ q)-1}, SG_{(p,\ q)-1}, \chi]$;

a second sub-pixel output-signal value $X_{2-(p1,\ q)}$ on the basis of $[x_{2-(p1,\ q)}, Max_{(p,\ q)-1}, Min_{(p,\ q)-1}, SG_{(p,\ q)-1}, \chi]$;

a first sub-pixel output-signal value $X_{1-(p2,\ q)}$ on the basis of $[x_{1-(p2,\ q)}, Max_{(p,\ q)-2}, Min_{(p,\ q)-2}, SG_{(p,\ q)-2}, \chi]$; and a second sub-pixel output-signal value $X_{2-(p2,\ q)}$ on the basis of $[x_{2-(p2,\ q)}, Max_{(p,\ q)-2}, Min_{(p,\ q)-2}, SG_{(p,\ q)-2}, \chi]$.

In addition, with regard to the luminance based on the values of the sub-pixel input signals and the values of the sub-pixel output signals, in the same way as the first embodiment, in order to meet the requirement of not changing the chromaticity, it is necessary to satisfy the following equations:

$$x_{1-(p1,q)}/Max_{(p,q)-1}=(X_{1-(p1,q)}+\chi\cdot SG_{(p,q)-1})/(Max_{(p,q)-1}+\chi\cdot SG_{(p,q)-1}) \quad (82\text{-A})$$

$$x_{2-(p1,q)}/Max_{(p,q)-1}=(X_{2-(p1,q)}+\chi\cdot SG_{(p,q)-1})/(Max_{(p,q)-1}+\chi\cdot SG_{(p,q)-1}) \quad (82\text{-B})$$

$$x_{1-(p2,q)}/Max_{(p,q)-2}=(X_{1-(p2,q)}+\chi\cdot SG_{(p,q)-2})/(Max_{(p,q)-2}+\chi\cdot SG_{(p,q)-2}) \quad (82\text{-C})$$

$$x_{2-(p2,q)}/Max_{(p,q)-2}=(X_{2-(p2,q)}+\chi\cdot SG_{(p,q)-2})/(Max_{(p,q)-2}+\chi\cdot SG_{(p,q)-2}) \quad (82\text{-D})$$

Thus, from Eqs. (82-A) to (82-D), the values of the sub-pixel output signals are found in accordance with equations given as follows.

$$X_{1-(p1,q)}=\{x_{1-(p1,q)}\cdot(Max_{(p,q)-1}+\chi\cdot SG_{(p,q)-1})\}/Max_{(p,q)-1}-\chi\cdot SG_{(p,q)-1} \quad (83\text{-A})$$

$$X_{2-(p1,q)}=\{x_{2-(p1,q)}\cdot(Max_{(p,q)-1}+\chi\cdot SG_{(p,q)-1})\}/Max_{(p,q)-1}-\chi\cdot SG_{(p,q)-1} \quad (83\text{-B})$$

$$X_{1-(p2,q)}=\{x_{1-(p2,q)}\cdot(Max_{(p,q)-2}+\chi\cdot SG_{(p,q)-2})\}/Max_{(p,q)-2}-\chi\cdot SG_{(p,q)-2} \quad (83\text{-C})$$

$$X_{2-(p2,q)}=\{x_{2-(p2,q)}\cdot(Max_{(p,q)-2}+\chi\cdot SG_{(p,q)-2})\}/Max_{(p,q)-2}-\chi\cdot SG_{(p,q)-2} \quad (83\text{-D})$$

In addition, the third sub-pixel output-signal value $X_{3-(p1,\ q)}$ can be found as a quotient found in accordance with Eq. (84) given as follows.

$$X_{3-(p1,q)}=\{x'_{3-(p,q)}\cdot(Max_{(p,q)-1}+\chi\cdot SG_{(p,q)-1})\}/Max_{(p,q)-1}-\chi\cdot SG_{(p,q)-1} \quad (84)$$

In the above equation, notation $x'_{3-(p,\ q)}$ denotes an average value expressed by an equation given below as the average of the third sub-pixel input-signal values $x_{3-(p1,\ q)}$ and $x_{3-(p2,\ q)}$:

$$x'_{3-(p,q)}=(x_{3-(p1,q)}+x_{3-(p2,q)})/2$$

Next, the following description explains extension processing to find the sub-pixel output-signal values $X_{1-(p1,\ q)}$, $X_{2-(p1,\ q)}$, $X_{3-(p1,\ q)}$, $X_{1-(p2,\ q)}$, $X_{2-(p2,\ q)}$ and $X_{4-(p,\ q)}$ for the (p, q)th pixel group $PG_{(p,\ q)}$. It is to be noted that processes to be described below are carried out to sustain ratios among the luminance of the first elementary color displayed by the first and fourth sub-pixels, the luminance of the second elementary color displayed by the second and fourth sub-pixels and the luminance of the third elementary color displayed by the third and fourth sub-pixels in every entire pixel group PG which includes the first pixel $Px_1$ and the second pixel $Px_2$. In addition, the processes are carried out to keep (or sustain) also the color hues. On top of that, the processes are carried out also to sustain (or hold) gradation-luminance characteristics, that is, gamma and γ characteristics.

Process 800

First of all, in the same way as process 100 of the first embodiment, the signal processing section 20 finds the first signal value $SG_{(p,\ q)-1}$ and the second signal value $SG_{(p,\ q)-2}$ for every pixel group $PG_{(p,\ q)}$ on the basis of the values of sub-pixel input signals received for the pixel group $PG_{(p,\ q)}$ in accordance with respectively Eqs. (81-A) and (81-B). The signal processing section 20 carries out this process for all the (P×Q) pixel groups $PG_{(p,\ q)}$. Then, the signal processing section 20 finds the fourth sub-pixel output-signal value $X_{4-(p,\ q)}$ in accordance with Eq. (81-C).

Process 810

Subsequently, the signal processing section 20 finds the sub-pixel output-signal values $X_{1-(p1,\ q)}$, $X_{2-(p1,\ q)}$, $X_{1-(p2,\ q)}$ and $X_{2-(p2,\ q)}$ in accordance with Eqs. (83-A) to (83-D) respectively on the basis of the first signal value $SG_{(p,\ q)-1}$ and the second signal value $SG_{(p,\ q)-2}$ which have been found for every pixel group $PG_{(p,\ q)}$. The signal processing section 20 carries out this operation for all the (P×Q) pixel groups $PG_{(p,\ q)}$. Then, the signal processing section 20 finds the third sub-pixel output-signal value $X_{3-(p1,\ q)}$ on the basis of Eq. (84). Subsequently, the signal processing section 20 supplies the sub-pixel output-signal values found in this way to the sub-pixels by way of the image display panel driving circuit 40.

It is to be noted that the ratios among sub-pixel output-signal values for the first pixel $Px_1$ pertaining to a pixel group PG are defined as follows:

$$X_{1-(p1,q)}:X_{2-(p,q)}:X_{3-(p1,q)}.$$

By the same token, the ratio of the first sub-pixel output-signal value to the second sub-pixel output-signal value for the second pixel $Px_2$ pertaining to a pixel group PG is defined as follows:

$$X_{1-(p2,q)}:X_{2-(p2,q)}.$$

In the same way, the ratios among sub-pixel input-signal values for the first pixel $Px_1$ pertaining to a pixel group PG are defined as follows:

$$x_{1-(p1,q)}:x_{2-(p1,q)}:x_{3-(p1,q)}.$$

Likewise, the ratio of the first sub-pixel input-signal value to the second sub-pixel input-signal value for the second pixel $Px_2$ pertaining to a pixel group PG is defined as follows:

$$x_{1-(p2,q)}:x_{2-(p2,q)}.$$

The ratios among sub-pixel output-signal values for the first pixel $Px_1$ are a little bit different from the ratios among sub-pixel input-signal values for the first pixel $Px_1$ whereas the ratio of the first sub-pixel output-signal value to the second sub-pixel output-signal value for the second pixel $Px_2$ is a little bit different from the ratio of the first sub-pixel input-signal value to the second sub-pixel input-signal value for the second pixel $Px_2$. Thus, if every pixel is observed independently, the color hue for a sub-pixel input signal varies a little bit from pixel to pixel. If an entire pixel group PG is observed, however, the color hue does not vary from pixel group to pixel group. This phenomenon occurs similarly in processes explained in the following description.

A control coefficient $\beta_0$ for controlling the luminance of illumination light radiated by the planar light-source apparatus 50 is found in accordance with Eq. (18).

In accordance with the image display apparatus assembly according to the eighth embodiment and the method for driving the image display apparatus assembly, each of the sub-pixel output-signal values $X_{1-(p1,\ q)}$, $X_{2-(p1,\ q)}$, $X_{3-(p1,\ q)}$, $X_{1-(p2,\ q)}$ and $X_{2-(p2,\ q)}$ for the (p, q)th pixel group PG is extended by $\beta_0$ times. Therefore, in order to set the luminance of a displayed image at the same level as the luminance of an image displayed without extending each of the sub-pixel output-signal values, the luminance of illumination light radiated by the planar light-source apparatus 50 needs to be reduced by $(1/\beta_0)$ times. As a result, the power consumption of the planar light-source apparatus 50 can be decreased.

In accordance with the method for driving the image display apparatus according to the eighth embodiment and the method for driving the image display apparatus assembly employing the image display apparatus, for every pixel group PG, the signal processing section 20 finds the value $X_{4-(p,\ q)}$ of the fourth sub-pixel output signal on the basis of the first signal value $SG_{(p,\ q)-1}$ found from the first, second and third sub-pixel input signals received for the first pixel $Px_1$ pertaining to the pixel group PG and on the basis of the second signal value $SG_{(p,\ q)-2}$ found from the first, second and third sub-pixel input signals received for the second pixel $Px_2$ pertaining to the pixel group PG, supplying the fourth sub-pixel output signal to the image display panel driving circuit 40. That is to say, the signal processing section 20 finds the value $X_{4-(p,\ q)}$ of the fourth sub-pixel output signal on the basis of sub-pixel input signals received for the first pixel $Px_1$ and the second pixel $Px_2$ which are adjacent to each other. Thus, the sub-pixel output signal for the fourth sub-pixel can be optimized. In addition, since one third sub-pixel and one fourth sub-pixel are provided for each pixel group PG having at least a first pixel $Px_1$ and a second pixel $Px_2$, the area of the aperture of every sub-pixel can be further prevented from decreasing. As a result, the luminance can be raised with a high degree of reliability and the quality of the displayed image can be improved.

By the way, if the difference between the first minimum value $Min_{(p,\ q)-1}$ of the first pixel $Px_{(p,\ q)-1}$ and the second minimum value $Min_{(p,\ q)-2}$ of the second pixel $Px_{(p,\ q)-2}$ is large, the use of Eq. (1-A) or (81-C) may result in a case in which the luminance of light emitted by the fourth sub-pixel does not increase to a desired level. In order to avoid such a case, it is desirable to find the fourth sub-pixel output-signal value $X_{4-(p,\ q)}$ in accordance with Eq. (1-B) given below in place of Eqs. (1-A) and (81-C).

$$X_{4-(p,q)}=C_1\cdot SG_{(p,q)-1}+C_2\cdot SG_{(p,q)-2} \tag{1-B}$$

In the above equation, each of notations $C_1$ and $C_2$ denotes a constant used as a weight. The fourth sub-pixel output-signal value $X_{4-(p,\ q)}$ satisfies the relation $X_{4-(p,\ q)}\leq(2^n-1)$. If the value of the expression $(C_1\cdot SG_{(p,\ q)-1}+C_2\cdot SG_{(p,\ q)-2}$ is greater than $(2^n-1)$ (that is, for $(C_1\cdot SG_{(p,\ q)-1}+C_2\cdot SG_{(p,\ q)-2}>(2^n-1)$), the fourth sub-pixel output-signal value $X_{4-(p,\ q)}$ is set at $(2^n-1)$ (that is, $X_{4-(p,\ q)}=(2^n-1)$). It is to be noted that the constants $C_1$ and $C_2$ each used as a weight may be changed in accordance with the first signal value $SG_{(p,\ q)-1}$ and the second signal value $SG_{(p,\ q)-2}$. As an alternative, the fourth sub-pixel output-signal value $X_{4-(p,\ q)}$ is found as the root of the average of the sum of the squared first signal value $SG_{(p,\ q)-1}$ and the squared second signal value $SG_{(p,\ q)-2}$ as follows:

$$X_{4-(p,q)}=[(SG_{(p,q)-1}^2+SG_{(p,q)-2}^2)/2]^{1/2} \tag{1-C}$$

As another alternative, the fourth sub-pixel output-signal value $X_{4-(p,\ q)}$ is found as the root of the product of the first signal value $SG_{(p,\ q)-1}$ and the second signal value $SG_{(p,\ q)-2}$ as follows:

$$X_{4-(p,q)}=(SG_{(p,q)-1}\cdot SG_{(p,q)-2})^{1/2} \tag{1-D}$$

For example, the image display apparatus and/or the image display apparatus assembly employing the image display apparatus are prototyped and, typically, an image observer evaluates the image displayed by the image display apparatus and/or the image display apparatus assembly. Finally, the image observer properly determines an equation to be used to express the fourth sub-pixel output-signal value $X_{4-(p,\ q)}$.

In addition, if desired, the sub-pixel output-signal values $X_{1-(p1,\ q)}$, $X_{2-(p1,\ q)}$, $X_{1-(p2,\ q)}$ and $X_{2-(p2,\ q)}$ can be found as the values of the following expressions respectively:

$$[x_{1-(p1,q)},x_{1-(p2,q)},\mathrm{Max}_{(p,q)-1},\mathrm{Min}_{(p,q)-1},SG_{(p,q)-1},\chi];$$

$$[x_{2-(p1,q)},x_{2-(p2,q)},\mathrm{Max}_{(p,q)-1},\mathrm{Min}_{(p,q)-1},SG_{(p,q)-1},\chi];$$

$$[x_{1-(p2,q)},x_{1-(p1,q)},\mathrm{Max}_{(p,q)-2},\mathrm{Min}_{(p,q)-2},SG_{(p,q)-2},\chi];$$

and $$[x_{2-(p2,q)},x_{2-(p1,q)},\mathrm{Max}_{(p,q)-2},\mathrm{Min}_{(p,q)-2},SG_{(p,q)-2},\chi].$$

To put it more concretely, the sub-pixel output-signal values $X_{1-(p1,\ q)}$, $X_{2-(p1,\ q)}$, $X_{1-(p2,\ q)}$ and $X_{2-(p2,\ q)}$ are found in accordance with respectively Eqs. (85-A) to (85-D) given below in place of Eqs. (83-A) to (83-D) respectively. It is to be noted that, in Eqs. (85-A) to (85-D), each of notations $C_{111}$, $C_{112}$, $C_{121}$, $C_{122}$, $C_{211}$, $C_{212}$, $C_{221}$ and $C_{222}$ denotes a constant.

$$X_{1-(p1,q)}=\{(C_{111}\cdot x_{1-(p1,q)}+C_{112}\cdot x_{1-(p2,q)})\cdot(\mathrm{Max}_{(p,q)-1}+\chi\cdot SG_{(p,q)-1})\}/\mathrm{Max}_{(p,q)-1}-\chi\cdot SG_{(p,q)-1} \tag{85-A}$$

$$X_{2-(p1,q)}=\{(C_{121}\cdot x_{2-(p1,q)}+C_{122}\cdot x_{2-(p2,q)})\cdot(\mathrm{Max}_{(p,q)-1}+\chi\cdot SG_{(p,q)-1})\}/\mathrm{Max}_{(p,q)-1}-\chi\cdot SG_{(p,q)-1} \tag{85-B}$$

$$X_{1-(p2,q)}=\{(C_{211}\cdot x_{1-(p1,q)}+C_{212}\cdot x_{1-(p2,q)})\cdot(\mathrm{Max}_{(p,q)-2}+\chi\cdot SG_{(p,q)-2})\}/\mathrm{Max}_{(p,q)-2}-\chi\cdot SG_{(p,q)-2} \tag{85-C}$$

$$X_{2-(p2,q)}=\{(C_{221}\cdot x_{2-(p1,q)}+C_{222}\cdot x_{2-(p2,q)})\cdot(\mathrm{Max}_{(p,q)-2}+\chi\cdot SG_{(p,q)-2})\}/\mathrm{Max}_{(p,q)-2}-\chi\cdot SG_{(p,q)-2} \tag{85-D}$$

Ninth Embodiment

A ninth embodiment is a modified version of the eighth embodiment. The ninth embodiment implements a configuration according to the (2-A-2) mode and the second configuration described earlier.

The signal processing section 20 employed in the image display apparatus 10 according to the ninth embodiment carries out the following processes of:

(B-1): finding the saturation S and the brightness/lightness value V(S) for each of a plurality of pixels on the basis of the signal values of sub-pixel input signals received for the pixels;

(B-2): finding an extension coefficient $\alpha_0$ on the basis of at least one of ratios $V_{max}(S)/V(S)$ found for the pixels;

(B-3-1): finding the first signal value $SG_{(p,\ q)-1}$ on the basis of at least the sub-pixel input-signal values $x_{1-(p1,\ q)}$, $x_{2-(p1,\ q)}$ and $x_{3-(p1,\ q)}$;

(B-3-2): finding the second signal value $SG_{(p,\ q)-2}$ on the basis of at least the sub-pixel input-signal values $x_{1-(p2,\ q)}$, $x_{2-(p2,\ q)}$ and $x_{3-(p2,\ q)}$;

(B-4-1): finding the first sub-pixel output-signal value $X_{1-(p1,q)}$ on the basis of at least the first sub-pixel input-signal value $x_{1-(p1,q)}$, the extension coefficient $\alpha_0$ and the first signal value $SG_{(p,q)-1}$;

(B-4-2): finding the second sub-pixel output-signal value $X_{2-(p1,q)}$ on the basis of at least the second sub-pixel input-signal value $x_{2-(p1,q)}$, the extension coefficient $\alpha_0$ and the first signal value $SG_{(p,q)-1}$;

(B-4-3): finding the first sub-pixel output-signal value $X_{1-(p2,q)}$ on the basis of at least the first sub-pixel input-signal value $x_{1-(p2,q)}$, the extension coefficient $\alpha_0$ and the second signal value $SG_{(p,q)-2}$; and (B-4-4): finding the second sub-pixel output-signal value $X_{2-(p2,q)}$ on the basis of at least the second sub-pixel input-signal value $x_{2-(p2,q)}$, the extension coefficient $\alpha_0$ and the second signal value $SG_{(p,q)-2}$.

As described above, the ninth embodiment implements a configuration according to the (2-A-2) mode. That is to say, the ninth embodiment determines the saturation $S_{(p,q)-1}$ of the HSV color space in accordance with Eq. (41-1), the brightness/lightness value $V_{(p,q)-1}$ in accordance with Eq. (41-2) as well as the first signal value $SG_{(p,q)-1}$ on the basis of the saturation $S_{(p,q)-1}$, the brightness/lightness value $V_{(p,q)-1}$ and the constant $\chi$. In addition, the ninth embodiment determines the saturation $S_{(p,q)-2}$ of the HSV color space in accordance with Eq. (41-3), the brightness/lightness value $V_{(p,q)-2}$ in accordance with Eq. (41-4) as well as the first signal value $SG_{(p,q)-2}$ on the basis of the saturation $S_{(p,q)-2}$, the brightness/lightness value $V_{(p,q)-2}$ and the constant $\chi$. As described before, the constant $\chi$ is a constant dependent on the image display apparatus.

In addition, the ninth embodiment also implements the second configuration explained earlier. In the case of the second configuration, a maximum brightness/lightness value $V_{max}(S)$ expressed as a function of variable saturation S to serve as the maximum of a brightness/lightness value V in an HSV color space enlarged by adding the fourth color is stored in the signal processing section 20.

In addition, the signal processing section 20 carries out the following processes of:

(a): finding the saturation S and the brightness/lightness value V(S) for each of a plurality of pixels on the basis of the signal values of sub-pixel input signals received for the pixels;

(b): finding an extension coefficient $\alpha_0$ on the basis of at least one of ratios $V_{max}(S)/V(S)$ found for the pixels;

(c1): finding the first signal value $SG_{(p,q)-1}$ on the basis of at least the sub-pixel input-signal values $x_{1-(p1,q)}$, $x_{2-(p1,q)}$ and $x_{3-(p1,q)}$;

(c2): finding the second signal value $SG_{(p,q)-2}$ on the basis of at least the sub-pixel input-signal values $x_{1-(p2,q)}$, $x_{2-(p2,q)}$ and $x_{3-(p2,q)}$;

(d1): finding the first sub-pixel output-signal value $X_{1-(p1,q)}$ on the basis of at least the first sub-pixel input-signal value $x_{1-(p1,q)}$, the extension coefficient $\alpha_0$ and the first signal value $SG_{(p,q)-1}$;

(d2): finding the second sub-pixel output-signal value $X_{2-(p1,q)}$ on the basis of at least the second sub-pixel input-signal value $x_{2-(p1,q)}$, the extension coefficient $\alpha_0$ and the first signal value $SG_{(p,q)-1}$;

(d3): finding the first sub-pixel output-signal value $X_{1-(p2,q)}$ on the basis of at least the first sub-pixel input-signal value $x_{1-(p2,q)}$, the extension coefficient $\alpha_0$ and the second signal value $SG_{(p,q)-2}$; and (d4): finding the second sub-pixel output-signal value $X_{2-(p2,q)}$ on the basis of at least the second sub-pixel input-signal value $x_{2-(p2,q)}$, the extension coefficient $\alpha_0$ and the second signal value $SG_{(p,q)-2}$.

As described above, the signal processing section 20 finds the first signal value $SG_{(p,q)-1}$ on the basis of at least the sub-pixel input-signal values $x_{1-(p1,q)}$, $x_{2-(p1,q)}$ and $x_{3-(p1,q)}$ and finds the second signal value $SG_{(p,q)-2}$ on the basis of at least the sub-pixel input-signal values $x_{1-(p2,q)}$, $x_{2-(p2,q)}$ and $x_{3-(p2,q)}$. In the case of the ninth embodiment, however, to put it more concretely, the signal processing section 20 finds the first signal value $SG_{(p,q)-1}$ on the basis of the first minimum value $Min_{(p,q)-1}$ as well as the extension coefficient $\alpha_0$ and finds the second signal value $SG_{(p,q)-2}$ on the basis of the second minimum value $Min_{(p,q)-2}$ as well as the extension coefficient $\alpha_0$. To even put it even more concretely, the signal processing section 20 finds the first signal value $SG_{(p,q)-1}$ and the second signal value $SG_{(p,q)-2}$ in accordance with respectively Eqs. (42-A) and (42-B) given earlier. It is to be noted that Eqs. (42-A) and (42-B) are derived by setting each of the constants $c_{21}$ and $c_{22}$ used in equations given previously at 1, that is, $c_{21}=1$ and $c_{22}=1$.

In addition, as described above, the signal processing section 20 finds the first sub-pixel output-signal value $X_{1-(p1,q)}$ on the basis of at least the first sub-pixel input-signal value $x_{1-(p1,q)}$, the extension coefficient $\alpha_0$ and the first signal value $SG_{(p,q)-1}$. To put it more concretely, the signal processing section 20 finds the first sub-pixel output-signal value $X_{1-(p1,q)}$ on the basis of:

$$[x_{1-(p1,q)}, \alpha_0, SG_{(p,q)-1}, \chi].$$

By the same token, the signal processing section 20 finds the second sub-pixel output-signal value $X_{2-(p1,q)}$ on the basis of at least the second sub-pixel input-signal value $x_{2-(p1,q)}$, the extension coefficient $\alpha_0$ and the first signal value $SG_{(p,q)-1}$. To put it more concretely, the signal processing section 20 finds the second sub-pixel output-signal value $X_{2-(p1,q)}$ on the basis of:

$$[x_{2-(p1,q)}, \alpha_0, SG_{(p,q)-1}, \chi].$$

In the same way, the signal processing section 20 finds the first sub-pixel output-signal value $X_{1-(p2,q)}$ on the basis of at least the first sub-pixel input-signal value $x_{1-(p2,q)}$, the extension coefficient $\alpha_0$ and the second signal value $SG_{(p,q)-2}$. To put it more concretely, the signal processing section 20 finds the first sub-pixel output-signal value $X_{1-(p2,q)}$ on the basis of:

$$[x_{1-(p2,q)}, \alpha_0, SG_{(p,q)-2}, \chi].$$

Similarly, the signal processing section 20 finds the second sub-pixel output-signal value $X_{2-(p2,q)}$ on the basis of at least the second sub-pixel input-signal value $x_{2-(p2,q)}$, the extension coefficient $\alpha_0$ and the second signal value $SG_{(p,q)-2}$. To put it more concretely, the signal processing section 20 finds the second sub-pixel output-signal value $X_{2-(p2,q)}$ on the basis of:

$$[x_{2-(p2,q)}, \alpha_0, SG_{(p,q)-2}, \chi].$$

The signal processing section 20 is capable of finding the sub-pixel output-signal values $X_{1-(p1,q)}$, $X_{2-(p1,q)}$, $X_{1-(p2,q)}$, and $X_{2-(p2,q)}$ on the basis of the extension coefficient $\alpha_0$ and the constant $\chi$. To put it more concretely, the signal processing section is capable of finding the sub-pixel output-signal values $X_{1-(p1,q)}$, $X_{2-(p1,q)}$, $X_{1-(p2,q)}$ and $X_{2-(p2,q)}$ in accordance with the following equations respectively.

$$X_{1-(p1,q)}=\alpha_0 \cdot x_{1-(p1,q)}-\chi \cdot SG_{(p,q)-1} \quad (3\text{-A})$$

$$X_{2-(p1,q)}=\alpha_0 \cdot x_{2-(p1,q)}-\chi \cdot SG_{(p,q)-1} \quad (3\text{-B})$$

$$X_{1-(p2,q)}=\alpha_0 \cdot x_{1-(p2,q)}-\chi \cdot SG_{(p,q)-2} \quad (3\text{-D})$$

$$X_{2-(p2,q)}=\alpha_0 \cdot x_{2-(p2,q)}-\chi \cdot SG_{(p,q)-2} \quad (3\text{-E})$$

On the other hand, the signal processing section 20 finds the third sub-pixel output-signal value $X_{3-(p1,\ q)}$ on the basis of the sub-pixel input-signal values $x_{3-(p1,\ q)}$ and $x_{3-(p2,\ q)}$, the extension coefficient $\alpha_0$ as well as the first signal value $SG_{(p,\ q)-1}$. To put it more concretely, the signal processing section 20 finds the third sub-pixel output-signal value $X_{3-(p1,\ q)}$ on the basis of $[x_{3-(p1,\ q)}, x_{3-(p2,\ q)}, \alpha_0, SG_{(p,\ q)-1}, \chi]$. To put it even more concretely, the signal processing section 20 finds the third sub-pixel output-signal value $X_{3-(p1,\ q)}$ in accordance with Eq. (91) given below.

In addition, the signal processing section 20 finds the fourth sub-pixel output-signal value $X_{4-(p,\ q)}$ as an average value which is computed from a sum of the first signal value $SG_{(p,\ q)-1}$ and the second signal value $SG_{(p,\ q)-2}$ in accordance with Eq. (2-A) which is rewritten into Eq. (92) as shown below.

$$X_{3-(p1,q)} = \alpha_0 \cdot \left\{ \frac{(x_{3-(p1,q)} + x_{3-(p2,q)})}{2} \right\} - \chi \cdot SG_{(p,q)-1} \quad (91)$$

$$X_{2-(p,q)} = \frac{(SG_{(p,q)-1} + SG_{(p,q)-2})}{2} \quad (2\text{-A})$$

$$= \frac{\left\{ \frac{[\mathrm{Min}_{(p,q)-1}] \cdot \alpha_0}{\chi} + \frac{[\mathrm{Min}_{(p,q)-2}] \cdot \alpha_0}{\chi} \right\}}{2} \quad (92)$$

The extension coefficient $\alpha_0$ used in the above equation is determined for every image display frame. In addition, the luminance of illumination light radiated by the planar light-source apparatus 50 is reduced in accordance with the extension coefficient $\alpha_0$.

In the case of the ninth embodiment, a maximum brightness/lightness value $V_{max}(S)$ expressed as a function of variable saturation S to serve as the maximum of a brightness/lightness value V in an HSV color space enlarged by adding the white color serving as the fourth color is stored in the signal processing section 20. That is to say, by adding the fourth color which is the white color, the dynamic range of the brightness/lightness value V in the HSV color space is widened.

The following description explains extension processing to find the sub-pixel output-signal values $X_{1-(p1,\ q)}$, $X_{2-(p1,\ q)}$, $X_{3-(p1,\ q)}$, $X_{1-(p2,\ q)}$ and $X_{2-(p2,\ q)}$ of the sub-pixel output signals for the (p, q)th pixel group $PG_{(p,\ q)}$. It is to be noted that processes to be described below are carried out in the same way as the first embodiment to sustain ratios among the luminance of the first elementary color displayed by the first and fourth sub-pixels, the luminance of the second elementary color displayed by the second and fourth sub-pixels and the luminance of the third elementary color displayed by the third and fourth sub-pixels in every entire pixel group PG which includes of the first pixel $Px_1$ and the second pixel $Px_2$. In addition, the processes are carried out to keep (or sustain) also the color hues. On top of that, the processes are carried out also to sustain (or hold) gradation-luminance characteristics, that is, gamma and γ characteristics.

Process 900

First of all, in the same way as process 400 carried out by the fourth embodiment, the signal processing section 20 finds the saturation S and the brightness/lightness value V(S) for every pixel group $PG_{(p,\ q)}$ on the basis of the values of sub-pixel input signals received for sub-pixels pertaining to a plurality of pixels. To put it more concretely, the saturation $S_{(p,\ q)-1}$ and the brightness/lightness value $V_{(p,\ q)-1}$ are found for the first pixel $Px_{(p,\ q)-1}$ pertaining to the (p, q)th pixel group $PG_{(p,\ q)}$ on the basis of the first-pixel first sub-pixel input-signal value $x_{1-(p1,\ q)}$, the second-pixel second sub-pixel input-signal value $x_{2-(p1,\ q)}$ and the third-pixel third sub-pixel input-signal value $x_{3-(p1,\ q)}$, which are received for the first pixel $Px_{(p,\ q)-1}$, in accordance with Eqs. (41-1) and (41-2) respectively as described above. By the same token, the saturation $S_{(p,\ q)-2}$ and the brightness/lightness value $V_{(p,\ q)-2}$ are found for the second pixel $Px_{(p,\ q)-2}$ pertaining to the (p, q)th pixel group $PG_{(p,\ q)}$ on the basis of the first-pixel first sub-pixel input-signal value $x_{1-(p2,\ q)}$, the second-pixel second sub-pixel input-signal value $x_{2-(p2,\ q)}$ and the third-pixel third sub-pixel input-signal value $x_{3-(p2,\ q)}$, which are received for the second pixel $Px_{(p,\ q)-2}$, in accordance with Eqs. (41-3) and (41-4) respectively as described above. This process is carried out for all the pixel groups $PG_{(p,\ q)}$. Thus, the signal processing section 20 finds (P×Q) sets each including $(S_{(p,\ q)-1}, S_{(p,\ q)-2}, V_{(p,\ q)-1}, V_{(p,\ q)-2})$.

Process 910

Then, in the same way as process 410 carried out by the fourth embodiment, the signal processing section 20 finds the extension coefficient $\alpha_0$ on the basis of at least one of ratios $V_{max}(S)/V(S)$ found for a plurality of pixel groups $PG_{(p,\ q)}$.

To put it more concretely, in the case of the ninth embodiment, the signal processing section 20 takes the value $\alpha_{min}$ smallest among the ratios $V_{max}(S)/V(S)$, which have been found for all the $(P_0 \times Q)$ pixels, as the extension coefficient $\alpha_0$. That is to say, the signal processing section 20 finds $\alpha_{(p,\ q)}$ $(=V_{max}(S)/V_{(p,\ q)}(S))$ for each of the $(P_0 \times Q)$ pixels and takes the value $\alpha_{min}$ smallest among the values of $\alpha_{(p,\ q)}$ as the extension coefficient $\alpha_0$.

Process 920

Then, in the same way as process 420 carried out by the fourth embodiment, the signal processing section 20 finds the fourth sub-pixel output-signal value $X_{4-(p,\ q)}$ for the (p, q)th pixel group $PG_{(p,\ q)}$ on the basis of at least the sub-pixel input-signal values $x_{1-(p1,\ q)}$, $x_{2-(p1,\ q)}$, $x_{3-(p1,\ q)}$, $x_{1-(p2,\ q)}$, $x_{2-(p2,\ q)}$ and $x_{3-(p2,\ q)}$. To put it more concretely, in the case of the ninth embodiment, the signal processing section 20 determines the fourth sub-pixel output-signal value $X_{4-(p,\ q)}$ on the basis of the first minimum value $Min_{(p,\ q)-1}$, the second minimum value $Min_{(p,\ q)-2}$, the extension coefficient $\alpha_0$ and the constant $\chi$. To put it even more concretely, in the case of the ninth embodiment, the signal processing section 20 determines the fourth sub-pixel output-signal value $X_{4-(p,\ q)}$ in accordance with Eq. (2-A) which is rewritten into Eq. (92) as described earlier.

It is to be noted that the signal processing section 20 finds the fourth sub-pixel output-signal value $X_{4-(p,\ q)}$ for each of the (P×Q) pixel groups $PG_{(p,\ q)}$.

Process 930

Then, the signal processing section 20 determines the sub-pixel output-signal values $X_{1-(p1,\ q)}$, $X_{2-(p1,\ q)}$, $X_{3-(p1,\ q)}$, $X_{1-(p2,\ q)}$ and $X_{2-(p2,\ q)}$ on the basis of the ratios of an upper limit $V_{max}$ in the color space to the sub-pixel input-signal values $x_{1-(p1,\ q)}$, $x_{2-(p1,\ q)}$, $x_{3-(p1,\ q)}$, $x_{1-(p2,\ q)}$, $x_{2-(p2,\ q)}$ and $x_{3-(p2,\ q)}$ respectively. That is to say, for the (p, q)th pixel group $PG_{(p,\ q)}$, the signal processing section 20 finds:

the first sub-pixel output-signal value $X_{1-(p1,\ q)}$ on the basis of the first sub-pixel input-signal value $x_{1-(p1,\ q)}$, the extension coefficient $\alpha_0$ and the first signal value $SG_{(p,\ q)-1}$;

the second sub-pixel output-signal value $X_{2-(p1,\ q)}$ on the basis of the second sub-pixel input-signal value $x_{2-(p1,\ q)}$, the extension coefficient $\alpha_0$ and the first signal value $SG_{(p,\ q)-1}$;

the third sub-pixel output-signal value $X_{3-(p1,\ q)}$ on the basis of the third sub-pixel input-signal value $x_{3-(p1,\ q)}$, the third sub-pixel input-signal value $x_{3-(p2,\ q)}$, the extension coefficient $\alpha_0$ and the first signal value $SG_{(p,\ q)-1}$;

the first sub-pixel output-signal value $X_{1-(p2,\ q)}$ on the basis of the first sub-pixel input-signal value $x_{1-(p2,\ q)}$, the extension coefficient $\alpha_0$ and the second signal value $SG_{(p,\ q)-2}$; and the second sub-pixel output-signal value $X_{2-(p2,\ q)}$ on the basis of the second sub-pixel input-signal value $x_{2-(p2,\ q)}$, the extension coefficient $\alpha_0$ and the second signal value $SG_{(p,\ q)-2}$.

It is to be noted that processes 920 and 930 can be carried out at the same time. As an alternative, process 920 is carried out after the execution of process 930 has been completed.

To put it more concretely, the signal processing section 20 finds the sub-pixel output-signal values $X_{1-(p1,\ q)}$, $X_{2-(p1,\ q)}$, $X_{1-(p2,\ q)}$, $X_{2-(p2,\ q)}$ and $X_{3-(p1,\ q)}$ for the (p, q)th pixel group $PG_{(p,\ q)}$ on the basis of respectively Eqs. (3-A), (3-B), (3-D), (3-E) and (91) respectively as follows:

$$X_{1-(p1,q)}=\alpha_0 \cdot x_{1-(p1,q)}-\chi \cdot SG_{(p,q)-1} \tag{3-A}$$

$$X_{2-(p1,q)}=\alpha_0 \cdot x_{2-(p1,q)}-\chi \cdot SG_{(p,q)-1} \tag{3-B}$$

$$X_{1-(p2,q)}=\alpha_0 \cdot x_{1-(p2,q)}-\chi \cdot SG_{(p,q)-2} \tag{3-D}$$

$$X_{2-(p2,q)}=\alpha_0 \cdot x_{2-(p2,q)}-\chi \cdot SG_{(p,q)-2} \tag{3-E}$$

$$X_{3-(p1,q)}=\alpha_0 \cdot \{(x_{3-(p1,q)}+x_{3-(p2,q)})/2\}-\chi \cdot SG_{(p,q)-1} \tag{91}$$

As obvious from Eq. (92), the first minimum value $Min_{(p,\ q)-1}$ and the second minimum value $Min_{(p,\ q)-2}$ are extended by multiplying the first minimum value $Min_{(p,\ q)-1}$ and the second minimum value $Min_{(p,\ q)-2}$ by the extension coefficient $\alpha_0$. Thus, not only is the luminance of light emitted by the white-color display sub-pixel serving as the fourth sub-pixel increased, but the luminance of light emitted by each of the red-color display sub-pixel serving as the first sub-pixel, the green-color display sub-pixel serving as the second sub-pixel and the blue-color display sub-pixel serving as the third sub-pixel is also raised as well as indicated by respectively Eqs. (3-A) to (3-E) and (91) which are given above. Therefore, it is possible to avoid the problem of the generation of the color dullness with a high degree of reliability. That is to say, in comparison with a case in which the first minimum value $Min_{(p,\ q)-1}$ and the second minimum value $Min_{(p,\ q)-2}$ are not extended by the extension coefficient $\alpha_0$, by extending the first minimum value $Min_{(p,\ q)-1}$ and the second minimum value $Min_{(p,\ q)-2}$ through the use of the extension coefficient $\alpha_0$, the luminance of the whole image is multiplied by the extension coefficient $\alpha_0$. Thus, an image such as a static image can be displayed at a high luminance. That is to say, the driving method is optimum for such applications.

In accordance with the image display apparatus assembly according to the ninth embodiment and the method for driving the image display apparatus assembly, each of the sub-pixel output-signal values $X_{1-(p1,\ q)}$, $X_{2-(p1,\ q)}$, $X_{3-(p1,\ q)}$, $X_{1-(p2,\ q)}$, $X_{2-(p2,\ q)}$ and $X_{4-(p,\ q)}$ found for the (p, q) th pixel group PG is extended by $\alpha_0$ times. Therefore, in order to set the luminance of a displayed image at the same level as the luminance of an image displayed without extending each of the sub-pixel output-signal values, the luminance of illumination light radiated by the planar light-source apparatus 50 needs to be reduced by $(1/\alpha 0)$ times. As a result, the power consumption of the planar light-source apparatus 50 can be decreased.

In the same way as the fourth embodiment, also in the case of the ninth embodiment, the fourth sub-pixel output-signal value $X_{4-(p,\ q)}$ is found in accordance with Eq. (2-B) as follows:

$$X_{4-(p,q)}=C_1 \cdot SG_{(p,q)-1}+C_2 \cdot SG_{(p,q)-2} \tag{2-B}$$

In the above equation, each of notations $C_1$ and $C_2$ denotes a constant. For $X_{4-(p,\ q)} \leq (2^n-1)$ and $(C_1 \cdot SG_{(p\ q)-1}+C_2 \cdot SG_{(p,\ q)-2})>(2^n-1)$, the fourth sub-pixel output-signal value $X_{4-(p,\ q)}$ is set at $(2^n-1)$, that is, $X_{4-(p,\ q)}=(2^n-1)$. As an alternative, in the same way as the fourth embodiment, the fourth sub-pixel output-signal value $X_{4-(p,\ q)}$ is found as the root of the average of the sum of the squared first signal value $SG_{(p,\ q)-1}$ and the squared second signal value $SG_{(p,\ q)-2}$ as follows:

$$X_{4-(p,q)}=[(SG_{(p,q)-1}{}^2+SG_{(p,q)-2}{}^2)/2]^{1/2} \tag{2-C}$$

As another alternative, in the same way as the fourth embodiment, the fourth sub-pixel output-signal value $X_{4-(p,\ q)}$ is found as the root of the product of the first signal value $SG_{(p,\ q)-1}$ and the second signal value $SG_{(p,\ q)-2}$ as follows:

$$X_{4-(p,q)}=(SG_{(p,q)-1} \cdot SG_{(p,q)-2})^{1/2} \tag{2-D}$$

In addition, also in the case of the ninth embodiment, the sub-pixel output-signal values $X_{1-(p1,\ q)}$, $X_{2-(p1,\ q)}$, $X_{1-(p2,\ q)}$ and $X_{2-(p2,\ q)}$ can be found as the values of the following expressions respectively in basically the same way as the fourth embodiment:

$$[x_{1-(p1,q)}, x_{1-(p2,q)}, \alpha_0, SG_{(p,q)-1}, \chi];$$

$$[x_{2-(p1,q)}, x_{2-(p2,q)}, \alpha_0, SG_{(p,q)-1}, \chi];$$

$$[x_{1-(p1,q)}, x_{1-(p2,q)}, \alpha_0, SG_{(p,q)-2}, \chi]; \text{and}$$

$$[x_{2-(p1,q)}, x_{2-(p2,q)}, \alpha_0, SG_{(p,q)-2}, \chi].$$

Tenth Embodiment

A tenth embodiment is a modified version of the eighth or ninth embodiment. The tenth embodiment implements a configuration according to the (2-B)th mode.

In the case of the tenth embodiment, the signal processing section 20 finds:

a first sub-pixel mixed input-signal value $x_{1-(p,\ q)-mix}$ on the basis of a first sub-pixel input-signal value $x_{1-(p1,\ q)}$ received for the first sub-pixel pertaining to the first pixel $Px_1$ included in each specific one of the pixel groups PG and on the basis of a first sub-pixel input-signal value $x_{1-(p2,\ q)}$ received for the first sub-pixel pertaining to the second pixel $Px_2$ included in the specific pixel group PG;

a second sub-pixel mixed input-signal value $x_{2-(p,\ q)-mix}$ on the basis of a second sub-pixel input-signal value $x_{2-(p1,\ q)}$ received for the second sub-pixel pertaining to the first pixel $Px_1$ included in the specific pixel group PG and on the basis of a second sub-pixel input-signal value $x_{2-(p2,\ q)}$ received for the second sub-pixel pertaining to the second pixel $Px_2$ included in the specific pixel group PG; and a third sub-pixel mixed input-signal value $x_{3-(p,\ q)-mix}$ on the basis of a third sub-pixel input-signal value $x_{3-(p1,\ q)}$ received for the third sub-pixel pertaining to the first pixel $Px_1$ included in the specific pixel group PG and on the basis of a third sub-pixel input-signal value $x_{3-(p2,\ q)}$ received for the third sub-pixel pertaining to the second pixel $Px_2$ included in the specific pixel group PG.

To put it more concretely, the signal processing section 20 finds the first sub-pixel mixed input-signal value $x_{1-(p,\ q)-mix}$, the second sub-pixel mixed input-signal value $x_{2-(p,\ q)-mix}$ and the third sub-pixel mixed input-signal value $x_{3-(p,\ q)-mix}$ in accordance with respectively Eqs. (71-A), (71-B) and (71-C) given previously. Then, the signal processing section 20 finds a fourth sub-pixel output-signal $X_{4-(p,\ q)}$ on the basis of the first sub-pixel mixed input-signal value $x_{1-(p,\ q)-mix}$, the second sub-pixel mixed input-signal value $x_{2-(p,\ q)-mix}$ and the third sub-pixel mixed input-signal value $x_{3-(p,\ q)-mix}$. To put it more concretely, the signal processing section 20 finds the first minimum value $Min'_{(p,\ q)}$ and uses the first minimum value $Min'_{(p,\ q)}$ as the fourth sub-pixel output-signal $X_{4-(p,\ q)}$ in accordance with Eq. (72) given earlier. It is to be noted that, in the case of the tenth embodiment, Eq. (72) given earlier is used in order to find the fourth sub-pixel output-signal $X_{4-(p,\ q)}$ if the same processing as the first embodiment is carried out, but an equation equivalent to Eq. (72') given earlier is used in order to find the fourth sub-pixel output-signal $X_{4-(p,\ q)}$ if the same processing as the fourth embodiment is carried out.

Then, the signal processing section 20 finds:

a first sub-pixel output-signal value $X_{1-(p1,\ q)}$ for the first pixel $Px_1$ on the basis of the first sub-pixel mixed input-signal value $x_{1-(p,\ q)-mix}$ and the first sub-pixel input-signal value $x_{1-(p1,\ q)}$ received for the first pixel $Px_1$;

a first sub-pixel output-signal value $X_{1-(p2,\ q)}$ for the second pixel $Px_2$ on the basis of the first sub-pixel mixed input-signal value $x_{1-(p,\ q)-mix}$ and the first sub-pixel input-signal value $x_{1-(p2,\ q)}$ received for the second pixel $Px_2$;

a second sub-pixel output-signal value $X_{2-(p1,\ q)}$ for the first pixel $Px_1$ on the basis of the second sub-pixel mixed input-signal value $x_{2-(p,\ q)-mix}$ and the second sub-pixel input-signal value $x_{2-(p1,\ q)}$ received for the first pixel $Px_1$; and a second sub-pixel output-signal value $X_{2-(p2,\ q)}$ for the second pixel $Px_2$ on the basis of the second sub-pixel mixed input-signal value $x_{2-(p,\ q)-mix}$ and the second sub-pixel input-signal value $x_{2-(p2,\ q)}$ received for the second pixel $Px_2$.

In addition, the signal processing section 20 finds a third sub-pixel output-signal value $X_{3-(p1,\ q)}$ for the first pixel $Px_1$ on the basis of the third sub-pixel mixed input-signal value $x_{3-(p,\ q)-mix}$.

Then, the signal processing section 20 outputs the fourth sub-pixel output-signal value $X_{4-(p,\ q)}$ to the image display panel driving circuit 40. The signal processing section 20 also outputs the first sub-pixel output-signal value $X_{1-(p1,\ q)}$, the second sub-pixel output-signal value $X_{2-(p1,\ q)}$ and the third sub-pixel output-signal value $X_{3-(p1,\ q)}$ for the first pixel $Px_1$ as well as the first sub-pixel output-signal value $X_{1-(p2,\ q)}$ and the second sub-pixel output-signal value $X_{2-(p2,\ q)}$ for the second pixel $Px_2$ to the image display panel driving circuit 40.

The following description explains how to find the fourth sub-pixel output-signal value $X_{4-(p,\ q)}$, the first sub-pixel output-signal value $X_{1-(p1,\ q)}$, the second sub-pixel output-signal value $X_{2-(p1,\ q)}$, the third sub-pixel output-signal value $X_{3-(p1,\ q)}$ the first sub-pixel output-signal value $X_{1-(p2,\ q)}$ and the second sub-pixel output-signal value $X_{2-(p2,\ q)}$ which are values for the (p, q)th pixel group $PG_{(p,\ q)}$, in accordance with the eighth embodiment.

Process 1000-A

First of all, for every pixel group $PG_{(p,\ q)}$, the signal processing section 20 finds the fourth sub-pixel output-signal value $X_{4-(p,\ q)}$ on the basis of the values of the sub-pixel input signals received for the pixel group $PG_{(p,\ q)}$ in accordance with Eq. (72) given previously.

Process 1010-A

Then, the signal processing section 20 finds the sub-pixel output-signal values $X_{1-(p,\ q)-mix}$, $X_{2-(p,\ q)-mix}$, $X_{3-(p,\ q)-mix}$, $X_{1-(1,\ q)}$, $X_{1-(p2,\ q)}$, $X_{2-(p1,\ q)}$ and $X_{2-(p2,\ q)}$ from the fourth sub-pixel output-signal value $X_{4-(p,\ q)}$ and the maximum value $Max_{(p,\ q)}$, which have been found for a pixel group $PG_{(p,\ q)}$, in accordance with Eqs. (73-A) to (73-C) and (74-A) to (74-D) respectively. This process is carried out for each of the (P×Q) pixel groups $PG_{(p,\ q)}$. Then, the signal processing section 20 finds the third sub-pixel output-signal value $X_{3-(p1,\ q)}$ in accordance with Eq. (101-1) given as follows.

$$X_{3-(p,q)}=X_{3-(p,q)-mix}/2 \tag{101-1}$$

The following description explains how to find the first sub-pixel output-signal value $X_{1-(p1,\ q)}$, the second sub-pixel output-signal value $X_{2-(p1,\ q)}$ and the third sub-pixel output-signal value $X_{3-(p1,\ q)}$, the first sub-pixel output-signal value $X_{1-(p2,\ q)}$, the second sub-pixel output-signal value $X_{2-(p2,\ q)}$ and the fourth sub-pixel output-signal value $X_{4-(p,\ q)}$ for the (p, q)th pixel group $PG_{(p,\ q)}$ in accordance with the ninth embodiment.

Process 1000-B

First of all, the signal processing section 20 finds the saturation S for each pixel group $PG_{(p,\ q)}$ and the brightness/lightness V(S) as a function of saturation S on the basis of the values of sub-pixel input signals received for a plurality of pixels pertaining to the pixel group $PG_{(p,\ q)}$. To put it more concretely, the signal processing section 20 finds the saturation $S_{(p,\ q)}$ and the brightness/lightness $V_{(p,\ q)}$ for each pixel group $PG_{(p,\ q)}$ on the basis of the first sub-pixel input-signal value $x_{1-(p1,\ q)}$, the second sub-pixel input-signal values $x_{2-(p1,\ q)}$ and the third sub-pixel input-signal values $x_{3-(p1,\ q)}$ which are received for the first pixel $Px_1$ pertaining to the pixel group $PG_{(p,\ q)}$ as well as on the basis of the first sub-pixel input-signal value $x_{1-(p2,\ q)}$, the second sub-pixel input-signal values $x_{2-(p2,\ q)}$ and the third sub-pixel input-signal values $x_{3-(p2,\ q)}$ which are received for the second pixel $Px_2$ pertaining to the pixel group $PG_{(p,\ q)}$ in accordance with Eqs. (71-A) to (71-C) as well as (75-1) and (75-2) given earlier. The signal processing section 20 carries out this process for every pixel group $PG_{(p,\ q)}$.

Process 1010-B

Then, the signal processing section 20 finds an extension coefficient $\alpha_0$ on the basis of at least one of ratios $V_{max}(S)/V(S)$ found by carrying out process 1000-B for the pixel groups $PG_{(p,\ q)}$.

To put it more concretely, in the case of the tenth embodiment, the signal processing section 20 takes the value $\alpha_{min}$ smallest among the ratios $V_{max}(S)/V(S)$, which have been found for all the (P×Q) pixel groups PG, as the extension coefficient $\alpha_0$. That is to say, the signal processing section 20 finds $\alpha_{(p,\ q)}$ ($=V_{max}(S)/V_{(p,\ q)}(S)$) for each of the (P×Q) pixel groups PG and takes the value $\alpha_{min}$ smallest among the values of $\alpha_{(p,\ q)}$ as the extension coefficient $\alpha_0$.

Process 1020-B

Then, the signal processing section 20 finds the fourth sub-pixel output-signal value $X_{4-(p,\ q)}$ for the (p, q)th pixel group $PG_{(p,\ q)}$ on the basis of at least the sub-pixel input-signal values $x_{1-(p1,\ q)}$, $x_{2-(p,\ q)}$, $x_{3-(p1,\ q)}$, $x_{1-(p2,\ q)}$, $x_{2-(p2,\ q)}$ and $x_{3-(p2,\ q)}$. To put it more concretely, in the case of the tenth embodiment, for each of the (P×Q) pixel groups $PG_{(p,\ q)}$, the signal processing section 20 determines the fourth sub-pixel output-signal value $X_{4-(p,\ q)}$ in accordance with Eqs. (71-A) to (71-C) and Eq. (72').

Process 1030-B

Then, the signal processing section 20 determines the sub-pixel output-signal values $X_{1-(p1,\ q)}$, $X_{2-(p1,\ q)}$, $X_{1-(p2,\ q)}$ and $X_{2-(p2,\ q)}$ on the basis of the ratios of an upper limit $V_{max}$ in the color space to the sub-pixel input-signal values $x_{1-(p1,\ q)}$, $x_{2-(p1,\ q)}$, $x_{1-(p2,\ q)}$ and $x_{2-(p2,\ q)}$ respectively.

To put it more concretely, the signal processing section 20 determines the sub-pixel output-signal values $X_{1(p1,\ q)}$, $X_{2-(p1,\ q)}$, $X_{1-(p2,\ q)}$, $X_{2-(p2,\ q)}$ and $X_{3-(p1,\ q)}$ for the (p, q)th pixel group $PG_{(p,\ q)}$ in accordance with Eqs. (3-A') to (3-C'), (74-A) to (74-D) and (101-1) which have been given earlier.

As described above, in accordance with the image display apparatus assembly according to the tenth embodiment and the method for driving the image display apparatus assembly, in the same way as the fourth embodiment, each of the sub-pixel output-signal values $X_{1-(p1,\ q)}$, $X_{2-(p1,\ q)}$, $X_{3-(p1,\ q)}$, $X_{1-(p2,\ q)}$, $X_{2-(p2,\ q)}$ and $X_{4-(p,\ q)}$ for the (p, q)th pixel group PG is extended by $\alpha_0$ times. Therefore, in order to set the luminance of a displayed image at the same level as the luminance of an image displayed without extending each of the sub-pixel output-signal values, the luminance of illumination light radiated by the planar light-source apparatus 50 needs to be reduced by $(1/\alpha_0)$ times. As a result, the power consumption of the planar light-source apparatus 50 can be decreased.

As explained above, a variety of processes carried out in the execution of the method for driving the image display apparatus according to the tenth embodiment and the method for driving the image display apparatus assembly employing the image display apparatus can be made substantially the same as a variety of processes carried out in the execution of the method for driving the image display apparatus according to the first or fourth embodiment and their modified versions and the method for driving the image display apparatus assembly employing the image display apparatus. In addition, a variety of processes carried out in the execution of the method for driving the image display apparatus according to the fifth embodiment and the method for driving the image display apparatus assembly employing the image display apparatus can be applied to the processes carried out in the execution of the method for driving the image display apparatus according to the tenth embodiment and the method for driving the image display apparatus assembly employing the image display apparatus according to the tenth embodiment. On top of that, the image display panel according to the tenth embodiment, the image display apparatus employing the image display panel and the image display apparatus assembly including the image display apparatus can have the same configurations as respectively the configurations of the image display panel according to any one of the first to sixth embodiments, the image display apparatus employing the image display panel according to any one of the first to sixth embodiments and the image display apparatus assembly including the image display apparatus employing the image display panel according to any one of the first to sixth embodiments.

That is to say, the image display apparatus 10 according to the tenth embodiment also employs an image display panel 30 and a signal processing section 20. The image display apparatus assembly according to the tenth embodiment also employs the image display apparatus 10 and a planar light-source apparatus 50 for radiating illumination light to the rear face of the image display panel 30 employed in the image display apparatus 10. In addition, the image display panel 30, the signal processing section 20 and the planar light-source apparatus 50 which are employed in the tenth embodiment can have the same configurations as respectively the configurations of the image display panel 30, the signal processing section 20 and the planar light-source apparatus 50 which are employed in any one of the first to sixth embodiments. For this reason, detailed description of the configurations of the image display panel 30, the signal processing section 20 and the planar light-source apparatus 50 which are employed in the tenth embodiment is omitted in order to avoid duplications of explanations.

The present invention has been exemplified by describing preferred embodiments. However, implementations of the present invention are by no means limited to the preferred embodiments. The configurations/structures of the color liquid-crystal display apparatus assemblies according to the embodiments, the color liquid-crystal display apparatus employed in the color liquid-crystal display apparatus assemblies, the planar light-source apparatus employed in the color liquid-crystal display apparatus assemblies, the planar light-source units employed in the planar light-source apparatus and the driving circuits are typical. In addition, members employed in the embodiments and materials for making the members are also typical as well. That is to say, the configurations, the structures, the members and the materials can be properly changed if necessary.

In the case of the fourth to sixth embodiments and the eighth to tenth embodiments, the number of pixels (or sets each composed of a first sub-pixel, a second sub-pixel and a third sub-pixel) for which the saturation S and the brightness/lightness values V are found is $(P_0 \times Q)$. That is to say, for each of all the $(P_0 \times Q)$ pixels (or sets each composed of a first sub-pixel, a second sub-pixel and a third sub-pixel), the saturation S and the brightness/lightness values V are found. However, the number of pixels (or sets each composed of a first sub-pixel, a second sub-pixel and a third sub-pixel) for which the saturation S and the brightness/lightness values V are found is by no means limited to $(P_0 \times Q)$. For example, the saturation S and the brightness/lightness values V are found for every four or eight pixels (or sets each composed of a first sub-pixel, a second sub-pixel and a third sub-pixel).

In the case of the fourth to sixth embodiments and the eighth to tenth embodiments, the extension coefficient $\alpha_0$ is found on the basis of at least the first sub-pixel input signal, the second sub-pixel input signal and the third sub-pixel input signal. As an alternative, however, the extension coefficient $\alpha_0$ can also be found on the basis of one of the first sub-pixel input signal, the second sub-pixel input signal and the third sub-pixel input signal (or one of the first sub-pixel input signal, the second sub-pixel input signal and the third sub-pixel input signal which are received for a set composed of a first sub-pixel, a second sub-pixel and a third sub-pixel or, more generally, one of the first input signal, the second input signal and the third input signal).

In the case of the alternative, to put it more concretely, for example, the value of an input signal used for finding the extension coefficient $\alpha_0$ is the second sub-pixel input-signal value $x_{2-(p,\ q)}$ for the green color. Then, on the basis of the extension coefficient $\alpha_0$, in the same way as the embodiments, the fourth sub-pixel output-signal value $X_{4-(p,\ q)}$ as well as the first sub-pixel output-signal value $X_{1-(p,\ q)}$, the second sub-pixel output-signal value $X_{2-(p,\ q)}$ and the third sub-pixel output-signal value $X_{3-(p,\ q)}$ are found. It is to be noted that, in this case, the saturation $S_{(p,\ q)-1}$ expressed by Eq. (41-1), the brightness/lightness value $V_{(p,\ q)-1}$ expressed by Eq. (41-2), the saturation $S_{(p,\ q)-2}$ expressed by Eq. (41-3) and the brightness/lightness value $V_{(p,\ q)-2}$ expressed by Eq. (41-4) are not used. Instead, the value of 1 is used as a substitute for the saturation $S_{(p,\ q)-1}$ expressed by Eq. (41-1) and the saturation $S_{(p,\ q)-2}$ expressed by Eq. (41-3). That is to say, each of the first minimum value $Min_{(p,\ q)-1}$ used in Eq. (41-1) and the second minimum value $Min_{(p,\ q)-2}$ used in Eq. (41-3) is set at 0.

As another alternative, the extension coefficient $\alpha_0$ can also be found on the basis of two different types of input signals selected from the first sub-pixel input signal, the second sub-pixel input signal and the third sub-pixel input signal (or two input signals selected from the first sub-pixel input signal, the second sub-pixel input signal and the third sub-pixel input signal which are received for a set composed of a first sub-pixel, a second sub-pixel and a third sub-pixel or, more generally, two input signals selected from the first input signal, the second input signal and the third input signal).

In the case of the other alternative, to put it more concretely, for example, the values of two different types of input signals used for finding the extension coefficient $\alpha_0$ are the first sub-pixel input-signal values $x_{1-(p1,q)}$ and $x_{1-(p2,q)}$ for the red color as well as the second sub-pixel input-signal values $x_{2(p1,q)}$ and $x_{2-(p2,q)}$ for the green color. Then, on the basis of the extension coefficient $\alpha_0$, in the same way as the embodiments, the fourth sub-pixel output-signal value $X_{4-(p,q)}$ as well as the first sub-pixel output-signal value $X_{1-(p,q)}$, the second sub-pixel output-signal value $X_{2-(p,q)}$ and the third sub-pixel output-signal value $X_{3-(p,q)}$ are found. It is to be noted that, in this case, the saturation $S_{(p,q)-1}$ expressed by Eq. (41-1), the brightness/lightness value $V_{(p,q)-1}$ expressed by Eq. (41-2), the saturation $S_{(p,q)-2}$ expressed by Eq. (41-3) and the brightness/lightness value $V_{(p,q)-2}$ expressed by Eq. (41-4) are not used. Instead, values expressed by equations given below are used as substitutes for the saturation $S_{(p,q)-1}$, the brightness/lightness value $V_{(p,q)-1}$, the saturation $S_{(p,q)-2}$ and the brightness/lightness value $V_{(p,q)-2}$:

For $x_{1-(p1,q)} \geq x_{2-(p1,q)}$, $$S_{(p\,q)-1}=(x_{1-(p,q)}-x_{2-(p1,q)})/x_{1-(p1,q)}$$

$$V_{(p,q)-1}=x_{1-(p1,q)}$$

For $x_{1-(p1,q)} < x_{2-(p1,q)}$, $$S_{(p,q)-1}=(x_{2-(p1,q)}-x_{1-(p1,q)})/x_{2-(p1,q)}$$

$$V_{(p,q)-1}=x_{2-(p1,q)}$$

By the same token,

For $x_{1-(p2,q)} \geq x_{2-(p2,q)}$, $$S_{(p,q)-2}=(x_{1-(p2,q)}-x_{2-(p2,q)})/x_{1-(p2,q)}$$

$$V_{(p,q)-2}=x_{1-(p2,q)}$$

For $x_{1-(p2,q)} < x_{2-(p2,q)}$, $$S_{(p,q)-2}=(x_{2-(p2,q)}-x_{1-(p2,q)})/x_{2-(p2,q)}$$

$$V_{(p,q)-2}=x_{2-(p2,q)}$$

When a color image display apparatus displays a monochrome image for example, the extension processes described above are sufficient processes for displaying the image.

As a further alternative, in a range where the image observer is not capable of perceiving changes in image quality, an extension process can also be carried out. To put it more concretely, in the case of the yellow color with a high luminosity factor, a gradation collapse phenomenon becomes striking with ease. Thus, in an input signal having a particular hue such as the phase of the yellow color, it is desirable to carry out an extension process so that the output signal obtained as a result of the extension is assured not to exceed $V_{max}$.

As a still further alternative, if the ratio of the value of an input signal having a particular hue such as the phase of the yellow color to the value of the entire input signal is low, the extension coefficient $\alpha_0$ can also be set at a value greater than the minimum value.

Figure 20:
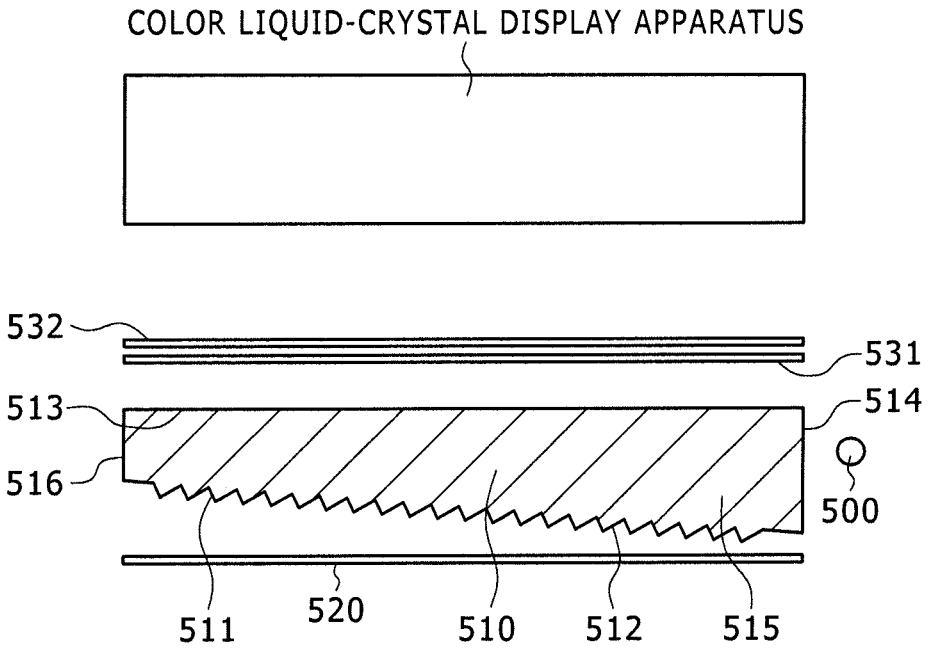
FIG. 20 is a conceptual diagram of a planar light-source apparatus of an edge-light type (or a side-light type).

A planar light-source apparatus of the edge-light type (or the side-light type) can also be employed. FIG. 20 is a conceptual diagram showing a planar light-source apparatus of an edge-light type (or a side-light type). As shown in the conceptual diagram of FIG. 20, a light guiding plate 510 made of typically polycarbonate resin employs a first face 511, a second face 513, a first side face 514, a second side face 515, a third side face 516 and a fourth side face. The first face 511 serves as the bottom face. The second face 513 serving as the top face which faces the first face 511. The third side face 516 faces the first side face 514 whereas the fourth side face faces the second side face 515.

A typical example of a more concrete whole shape of the light guiding plate is a top-cut square conic shape resembling a wedge. In this case, the two mutually facing side faces of the top-cut square conic shape correspond to the first and second faces 511 and 513 respectively whereas the bottom face of the top-cut square conic shape corresponds to the first side face 514. In addition, it is desirable to provide the surface of the bottom face serving as the first face 511 with an unevenness portion 512 composed of protrusions and/or dents.

The cross-sectional shape of the contiguous protrusions (or contiguous dents) in the unevenness portion 512 for a case in which the light guiding plate 510 is cut over a virtual plane perpendicular to the first face 511 in the direction of illumination light having the first color incident to the light guiding plate 510 is typically the shape of a triangle. That is to say, the shape of the unevenness portion 512 provided on the lower surface of the first face 511 is the shape of a prism.

On the other hand, the second face 513 of the light guiding plate 510 can be a smooth face. That is to say, the second face 513 of the light guiding plate 510 can be a mirror face or the second face 513 of the light guiding plate 510 can be provided with blast engraving having a light diffusion effect so as to create a surface with an infinitesimal unevenness surface.

In the planar light-source apparatus provided with the light guiding plate 510, it is desirable to provide a light reflection member 520 facing the first face 511 of the light guiding plate 510. In addition, an image display panel such as a color liquid-crystal display panel is placed to face the second face 513 of the light guiding plate 510. On top of that, a light diffusion sheet 531 and a prism sheet 532 are placed between this image display panel and the second face 513 of the light guiding plate 510.

Light having the first elementary color is radiated by a light source 500 to the light guiding plate 510 by way of the first side face 514, which is typically a face corresponding to the bottom of the top-cut square conic shape, collides with the unevenness portion 512 of the first face 511 and is dispersed. The dispersed light leaves the first face 511 and is reflected by a light reflection member 520. The light reflected by the light reflection member 520 again arrives at the first face 511 and is radiated from the second face 513. The light radiated from the second face 513 passes through the light diffusion sheet 531 and the prism sheet 532, illuminating the rear face of the image display panel employed in the first embodiment.

As a light source, a fluorescent lamp (or a semiconductor laser) for radiating light of the blue color as the first-color light can also be used in place of the light emitting diode. In this case, the wavelength $\lambda_1$ of the first-color light radiated by the fluorescent lamp or the semiconductor laser as light corresponding to light of the blue color serving as the first color is typically 450 nm. In addition, a green-color light emitting particle corresponding to a second-color light emitting particle excited by the fluorescent lamp or the semiconductor laser can typically be a green-color light emitting fluorescent particle made of $SrGa_2S_4$:Eu whereas a red-color light emitting particle corresponding to a third-color light emitting particle excited by the fluorescent lamp or the semiconductor laser can typically be a red-color light emitting fluorescent particle made of CaS:Eu.

As an alternative, if a semiconductor laser is used, the wavelength $\lambda_1$ of the first-color light radiated by the semiconductor laser as light corresponding to light of the blue color serving as the first color is typically 457 nm. In this case, a green-color light emitting particle corresponding to a second-color light emitting particle excited by the semiconductor laser can typically be a green-color light emitting fluorescent particle made of $SrGa_2S_4$:Eu whereas a red-color light emitting particle corresponding to a third-color light emitting particle excited by the semiconductor laser can typically be a red-color light emitting fluorescent particle made of CaS:Eu.

As another alternative, as the light source of the planar light-source apparatus, a CCFL (Cold Cathode Fluorescent Lamp), an HCFL (Heated Cathode Fluorescent Lamp) or an EEFL (External Electrode Fluorescent Lamp) can also be used.

The present application contains subject matter related to that disclosed in Japanese Priority Patent Applications JP 2008-170796 filed in the Japan Patent Office on Jun. 30, 2008, and JP 2009-103854 filed in the Japan Patent Office on Apr. 22, 2009, the entire contents of which are hereby incorporated by reference.

It should be understood by those skilled in the art that various modifications, combinations, sub-combinations and alternations may occur depending on design requirements and other factors insofar as they are within the scope of the appended claims or the equivalent thereof.

What is claimed is:

1. A method for driving an image display apparatus comprising:

(A): an image display panel including pixels each having a first sub-pixel for displaying a first color, a second sub-pixel for displaying a second color and a third sub-pixel for displaying a third color, and a fourth sub-pixel for displaying a fourth color is placed in each of a plurality of pixel groups; and (B): a signal processing section configured to generate a first sub-pixel output signal, a second sub-pixel output signal and a third sub-pixel output signal for respectively said first, second and third sub-pixels, whereby said signal processing section provides a fourth sub-pixel output signal on the basis of a first sub-pixel input signal, a second sub-pixel input signal and a third sub-pixel input signal wherein, with a notation p denoting a positive integer satisfying a relation $1 \le p \le P$, a notation q denoting a positive integer satisfying a relation $1 \le p \le Q$, a notation $p_1$ denoting a positive integer satisfying a relation $1 \le p \le P$, a notation $p_2$ denoting a positive integer satisfying a relation $1 \le p \le P$, notation P denoting a positive integer representing the number of said pixel groups laid out in said first direction and notation Q denoting a positive integer representing the number of said pixel groups laid out in said second direction:

with regard to said first pixel pertaining to a (p, q)th pixel group, said signal processing section receives a first sub-pixel input signal provided with a first sub-pixel input-signal value $x_{1-(p1,\,q)}$, a second sub-pixel input signal provided with a second sub-pixel input-signal value $x_{2-(p1,\,q)}$, and a third sub-pixel input signal provided with a third sub-pixel input-signal value $x_{3-(p1,\,q)}$;

with regard to said second pixel pertaining to said (p, q)th pixel group, said signal processing section receives a first sub-pixel input signal provided with a first sub-pixel input-signal value $x_{1-(p2,\,q)}$, a second sub-pixel input signal provided with a second sub-pixel input-signal value $x_{2-(p2,\,q)}$, and a third sub-pixel input signal provided with a third sub-pixel input-signal value $x_{3-(p2,\,q)}$;

with regard to said first pixel pertaining to said (p, q)th pixel group, said signal processing section generates a first sub-pixel output signal provided with a first sub-pixel output-signal value $X_{1-(p1,\,q)}$ and used for determining the display gradation of said first sub-pixel pertaining to said first pixel, a second sub-pixel output signal provided with a second sub-pixel output-signal value $X_{2-(p1,\,q)}$ and used for determining the display gradation of said second sub-pixel pertaining to said first pixel, and a third sub-pixel output signal provided with a third sub-pixel output-signal value $X_{3-(p1,\,q)}$ and used for determining the display gradation of said third sub-pixel pertaining to said first pixel;

with regard to said second pixel pertaining to said (p, q)th pixel group, said signal processing section generates a first sub-pixel output signal provided with a first sub-pixel output-signal value $X_{1-(p2,\,q)}$ and used for determining the display gradation of said first sub-pixel pertaining to said second pixel, a second sub-pixel output signal provided with a second sub-pixel output-signal value $X_{2-(p2,\,q)}$ and used for determining the display gradation of said second sub-pixel pertaining to said second pixel, and a third sub-pixel output signal provided with a third sub-pixel output-signal value $X_{3-(p2,\,q)}$ and used for determining the display gradation of said third sub-pixel pertaining to said second pixel; and with regard to a fourth sub-pixel pertaining to said (p, q)th pixel group, said signal processing section generates a fourth sub-pixel output signal provided with a fourth sub-pixel output-signal value $X_{4-(p,\,q)}$ and used for determining the display gradation of said fourth sub-pixel, and further said signal processing section finds said fourth sub-pixel output signal on the basis of a first signal value $SG_{(p,\,q)-1}$ found from said first sub-pixel input signal, said second sub-pixel input signal and said third sub-pixel input signal which are received for respectively said first, second and third sub-pixels pertaining to said first pixel included in every specific one of said pixel groups and on the basis of a second signal value $SG_{(p,\,q)-2}$ found from said first sub-pixel input signal, said second sub-pixel input signal and said third sub-pixel input signal which are received for respectively said first, second and third sub-pixels pertaining to said second pixel included in said specific pixel group, outputting said fourth sub-pixel output signal; and wherein said first signal value $SG_{(p,\,q)-1}$ is determined on the basis of a first minimum value $Min_{(p,\,q)-1}$ whereas a second signal value $SG_{(p,\,q)-2}$ is determined on the basis of a second minimum value $Min_{(p,\,q)-2}$ where said first minimum value $Min_{(p,\,q)-1}$ is the smallest value among said three sub-pixel input-signal values $x_{1-(p1,\,q)}$, $x_{2-(p1,\,q)}$ and $x_{3-(p1,\,q)}$ whereas said second minimum value $Min_{(p,\,q)-2}$ the smallest value among said three sub-pixel input-signal values $x_{1-(p2,\,q)}$, $x_{2-(p2,\,q)}$ and $x_{3-(p2,\,q)}$ said first sub-pixel output-signal value $X_{1-(p1,\,q)}$ is found on the basis of at least said first sub-pixel input-signal value $x_{1-(p1,\ q)}$, said first maximum value $Max_{(p,\ q)-1}$, said first minimum value $Min_{(p,\ q)-1}$ and said first signal value $SG_{(p,\ q)-1}$;

said second sub-pixel output-signal value $X_{2-(p1,\ q)}$ is found on the basis of at least said second sub-pixel input-signal value $x_{2-(p1,\ q)}$, said first maximum value $Max_{(p,\ q)-1}$, said first minimum value $Min_{(p,\ q)-1}$ and said first signal value $SG_{(p,\ q)-1}$;

said third sub-pixel output-signal value $X_{3-(p1,\ q)}$ is found on the basis of at least said third sub-pixel input-signal value $X_{3-(p1,\ q)}$, said first maximum value $Max_{(p,\ q)-1}$, said first minimum value $Min_{(p,\ q)-1}$ and said first signal value $SG_{(p,\ q)-1}$;

said first sub-pixel output-signal value $X_{1-(p2,\ q)}$ is found on the basis of at least said first sub-pixel input-signal value $x_{1-(p2,\ q)}$, said second maximum value $Max_{(p,\ q)-2}$, said second minimum value $Min_{(p,\ q)-2}$ and said second signal value $SG_{(p,\ q)-2}$;

said second sub-pixel output-signal value $X_{2-(p2,\ q)}$ is found on the basis of at least said second sub-pixel input-signal value $x_{2-(p2,\ q)}$, said second maximum value $Max_{(p,\ q)-2}$, said second minimum value $Min_{(p,\ q)-2}$ and said second signal value $SG_{(p,\ q)-2}$; and said third sub-pixel output-signal value $X_{3-(p2,\ q)}$ is found on the basis of at least said third sub-pixel input-signal value $x_{3-(p2,\ q)}$, said second maximum value $Max_{(p,\ q)-2}$, said second minimum value $Min_{(p,\ q)-2}$ and said second signal value $SG_{(p,\ q)-2}$, where said first maximum value $Max_{(p,\ q)-1}$ is the largest value among said three sub-pixel input-signal values $x_{1-(p1,\ q)}$, $x_{2-(p1,\ q)}$ and $x_{3-(p1,\ q)}$ whereas said second maximum value $Max_{(p,\ q)-2}$ is the largest value among said three sub-pixel input-signal values $x_{1-(p2,\ q)}$, $x_{2-(p2,\ q)}$ and $x_{3-(p2,\ q)}$.

2. The method used for driving the image display apparatus in accordance with claim 1 whereby said fourth sub-pixel output-signal value $X_{4-(p,\ q)}$ is found as an average value which is computed from a sum of said first signal value $SG_{(p,\ q)-1}$ and said second signal value $SG_{(p,\ q)-2}$ in accordance with the following equation:

$$X_{4-(p,q)}=(SG_{(p,q)-1}+SG_{(p,q)-2})/2,\text{or}$$

as an alternative, said fourth sub-pixel output-signal value $X_{4-(p,\ q)}$ is found in accordance with the following equation:

$$X_{4-(p,q)}=C_1\cdot SG_{(p,q)-1}+C_2\cdot SG_{(p,q)-2},\text{but}$$

said fourth sub-pixel output-signal value $X_{4-(p,\ q)}$ satisfies a relation $X_{4-(p,\ q)}\leq(2^n-1)$ or, that is to say, for $(C_1\cdot SG_{(p,\ q)-1}+C_2\cdot SG_{(p,\ q)-2})^2>(2^n-1)$, said fourth sub-pixel output-signal value $X_{4-(p,\ q)}$ is set at $(2^n-1)$ where each of notations $C_1$ and $C_2$ used in said equation given above denotes a constant, or as another alternative, said fourth sub-pixel output-signal value $X_{4-(p,\ q)}$ is found in accordance with the following equation:

$$X_{4-(p,q)}=[(SG_{(p,q)-1}{}^2+SG_{(p,q)-2}{}^2)/2]^{1/2}.$$

3. The method used for driving the image display apparatus in accordance with claim 1 wherein said signal processing section finds:

a first sub-pixel mixed input signal on the basis of said first sub-pixel input signal received for said first pixel pertaining to each of said pixel groups and said first sub-pixel input signal received for said second pixel pertaining to said pixel group;

a second sub-pixel mixed input signal on the basis of said second sub-pixel input signal received for said first pixel pertaining to said pixel group and said second sub-pixel input signal received for said second pixel pertaining to said pixel group;

a third sub-pixel mixed input signal on the basis of said third sub-pixel input signal received for said first pixel pertaining to said pixel group and said third sub-pixel input signal received for said second pixel pertaining to said pixel group;

a fourth sub-pixel output signal on the basis of said first sub-pixel mixed input signal, said second sub-pixel mixed input signal and said third sub-pixel mixed input signal;

a first sub-pixel output signal for said first pixel on the basis of said first sub-pixel mixed input signal and said first sub-pixel input signal received for said first pixel;

a first sub-pixel output signal for said second pixel on the basis of said first sub-pixel mixed input signal and said first sub-pixel input signal received for said second pixel;

a second sub-pixel output signal for said first pixel on the basis of said second sub-pixel mixed input signal and said second sub-pixel input-signal received for said first pixel;

a second sub-pixel output signal for said second pixel on the basis of said second sub-pixel mixed input signal and said second sub-pixel input signal received for said second pixel;

a third sub-pixel output signal for said first pixel on the basis of said third sub-pixel mixed input signal and said third sub-pixel input signal received for said first pixel; and a third sub-pixel output signal for said second pixel on the basis of said third sub-pixel mixed input signal and said third sub-pixel input signal received for said second pixel, outputting said fourth sub-pixel output signal, said first to third sub-pixel output signals for said first pixel and said first to third sub-pixel output signals for said second pixel.

4. An image display panel comprising:

pixels each including a first sub-pixel for displaying a first color, a second sub-pixel for displaying a second color and a third sub-pixel for displaying a third color;

a fourth sub-pixel for displaying a fourth color is adjacent said first and second pixels in each of a plurality of pixel groups, and wherein the fourth sub-pixel output signal is determined based upon sub-pixel input signals supplied to the first and second pixels; and wherein a first signal value $SG_{(p,\ q)-1}$ is determined on the basis of a first minimum value $Min_{(p,\ q)-1}$ whereas a second signal value $SG_{(p,\ q)-2}$ is determined on the basis of a second minimum value $Min_{(p,\ q)-2}$ where a first minimum value $Min_{(p,\ q)-1}$ is the smallest value among said three sub-pixel input-signal values $x_{1-(p1,\ q)}$, $x_{2-(p1,\ q)}$ and $x_{3-(p1,\ q)}$ whereas said second minimum value $Min_{(p,\ q)-2}$ is the smallest value among said three sub-pixel input-signal values $x_{1-(p2,\ q)}$, $x_{2-(p2,\ q)}$ and $x_{3-(p2,\ q)}$ said first sub-pixel output-signal value $X_{1-(p1,\ q)}$ is found on the basis of at least a first sub-pixel input-signal value $x_{1-(p1,\ q)}$, a first maximum value $Max_{(p,\ q)-1}$, a first minimum value $Min_{(p,\ q)-1}$ and a first signal value $SG_{(p,\ q)-1}$;

said second sub-pixel output-signal value $X_{2-(p1,\ q)}$ is found on the basis of at least said second sub-pixel input-signal value $x_{2-(p1,\ q)}$, said first maximum value $Max_{(p,\ q)-1}$, said first minimum value $Min_{(p,\ q)-1}$ and said first signal value $SG_{(p,\ q)-1}$;

said third sub-pixel output-signal value $X_{3-(p1,\ q)}$ is found on the basis of at least said third sub-pixel input-signal value $x_{3-(p1,\ q)}$, said first maximum value $Max_{(p,\ q)-1}$, said first minimum value $Min_{(p,\ q)-1}$ and said first signal value $SG_{(p,\ q)-1}$;

said first sub-pixel output-signal value $X_{1-(p2,\ q)}$ is found on the basis of at least said first sub-pixel input-signal value $x_{1-(p2,\ q)}$, said second maximum value $Max_{(p,\ q)-2}$, said second minimum value $Min_{(p,\ q)-2}$ and said second signal value $SG_{(p,\ q)-2}$;

said second sub-pixel output-signal value $X_{2-(p2,\ q)}$ is found on the basis of at least said second sub-pixel input-signal value $x_{2-(p2,\ q)}$, said second maximum value $Max_{(p,\ q)-2}$, said second minimum value $Min_{(p,\ q)-2}$ and said second signal value $SG_{(p,\ q)-2}$; and said third sub-pixel output-signal value $X_{3-(p2,\ q)}$ is found on the basis of at least said third sub-pixel input-signal value $x_{3-(p2,\ q)}$, said second maximum value $Max_{(p,\ q)-2}$, said second minimum value $Min_{(p,\ q)-2}$ and said second signal value $SG_{(p,\ q)-2}$, where said first maximum value $Max_{(p,\ q)-1}$ is the largest value among said three sub-pixel input-signal values $x_{1-(p1,\ q)}$, $x_{2-(p1,\ q)}$ and $x_{3-(p1,\ q)}$ whereas said second maximum value $Max_{(p,\ q)-2}$ is the largest value among said three sub-pixel input-signal values $x_{1-(p2,\ q)}$, $x_{2-(p2,\ q)}$ and $x_{3-(p2,\ q)}$.

5. The image display panel according to claim 4 wherein:

said first pixel on the q'th column of said matrix is placed at a location adjacent to the location of said first pixel on the (q'+1)th column of said matrix whereas said fourth sub-pixel on said q'th column is placed at a location not adjacent to the location of said fourth sub-pixel on said (q'+1)th column where notation q' denotes a positive integer satisfying relations $1 \leq q' \leq (Q-1)$ where notation Q denotes a positive integer representing the number of pixel groups arranged in said second direction.

6. The image display panel according to claim 4 wherein:

the row direction of said 2-dimensional matrix is taken as said first direction whereas the column direction of said matrix is taken as said second direction;

said first pixel on the q'th column of said matrix is placed at a location adjacent to the location of said second pixel on the (q'+1)th column of said matrix whereas said fourth sub-pixel on said q'th column is placed at a location not adjacent to the location of said fourth sub-pixel on said (q'+1)th column where notation q' denotes a positive integer satisfying relations $1 \leq q' \leq (Q-1)$ where notation Q denotes a positive integer representing the number of pixel groups arranged in said second direction.

7. The image display panel according to claim 4 wherein:

the row direction of said 2-dimensional matrix is taken as said first direction whereas the column direction of said matrix is taken as said second direction;

said first pixel on the q'th column of said matrix is placed at a location adjacent to the location of said first pixel on the (q'+1)th column of said matrix whereas said fourth sub-pixel on said q'th column is placed at a location adjacent to the location of said fourth sub-pixel on said (q'+1)th column where notation q' denotes a positive integer satisfying relations $1 \leq q' \leq (Q-1)$ where notation Q denotes a positive integer representing the number of pixel groups arranged in said second direction.

8. A method for driving an image display apparatus assembly comprising:

an image display apparatus employing (A): an image display panel including pixels each having a first sub-pixel for displaying a first color, a second sub-pixel for displaying a second color and a third sub-pixel for displaying a third color, at least each specific pixel and an adjacent pixel adjacent to said specific pixel are used as a first pixel and a second pixel respectively to create one of a plurality of pixel groups, and a fourth sub-pixel for displaying a fourth color is placed between said first and second pixels in each of said pixel groups, and (B): a signal processing section configured to generate a first sub-pixel output signal, a second sub-pixel output signal and a third sub-pixel output signal for said first pixel included in each specific one of said pixel groups a first sub-pixel output signal, a second sub-pixel output signal and a third sub-pixel output signal for said second pixel; and a planar light-source apparatus to radiate illumination light to the rear face of said image display apparatus, and wherein the fourth sub-pixel output signal is determined based upon sub-pixel input signals supplied to the first and second pixels; and wherein said first signal value $SG_{(p,\ q)-1}$ is determined on the basis of a first minimum value $Min_{(p,\ q)-1}$ whereas a second signal value $SG_{(p,\ q)-2}$ is determined on the basis of a second minimum value $Min_{(p,\ q)-2}$ where said first minimum value $Min_{(p,\ q)-1}$ is the smallest value among said three sub-pixel input-signal values $x_{1-(p1,\ q)}$, $x_{2-(p1,\ q)}$ and $x_{3-(p1,\ q)}$ whereas said second minimum value $Min_{(p,\ q)-2}$ is the smallest value among said three sub-pixel input-signal values $x_{1-(p2,\ q)}$, $x_{2-(p2,\ q)}$ and $x_{3-(p2,\ q)}$ said first sub-pixel output-signal value $X_{1-(p1,\ q)}$ is found on the basis of at least said first sub-pixel input-signal value $x_{1-(p1,\ q)}$, said first maximum value $Max_{(p,\ q)-1}$, said first minimum value $Min_{(p,\ q)-1}$ and said first signal value $SG_{(p,\ q)-1}$;

said second sub-pixel output-signal value $X_{2-(p1,\ q)}$ is found on the basis of at least said second sub-pixel input-signal value $x_{2-(p1,\ q)}$, said first maximum value $Max_{(p,\ q)-1}$, said first minimum value $Min_{(p,\ q)-1}$ and said first signal value $SG_{(p,\ q)-1}$;

said third sub-pixel output-signal value $X_{3-(p1,\ q)}$ is found on the basis of at least said third sub-pixel input-signal value $x_{3-(p1,\ q)}$, said first maximum value $Max_{(p,\ q)-1}$, said first minimum value $Min_{(p,\ q)-1}$ and said first signal value $SG_{(p,\ q)-1}$;

said first sub-pixel output-signal value $X_{1-(p2,\ q)}$ is found on the basis of at least said first sub-pixel input-signal value $x_{1-(p2,\ q)}$, said second maximum value $Max_{(p,\ q)-2}$, said second minimum value $Min_{(p,\ q)-2}$ and said second signal value $SG_{(p,\ q)-2}$;

said second sub-pixel output-signal value $X_{2-(p2,\ q)}$ is found on the basis of at least said second sub-pixel input-signal value $x_{2-(p2,\ q)}$, said second maximum value $Max_{(p,\ q)-2}$, said second minimum value $Min_{(p,\ q)-2}$ and said second signal value $SG_{(p,\ q)-2}$; and said third sub-pixel output-signal value $X_{3-(p2,\ q)}$ is found on the basis of at least said third sub-pixel input-signal value $x_{3-(p2,\ q)}$, said second maximum value $Max_{(p,\ q)-2}$, said second minimum value $Min_{(p,\ q)-2}$ and said second signal value $SG_{(p,\ q)-2}$, where said first maximum value $Max_{(p,\ q)-1}$ is the largest value among said three sub-pixel input-signal values $x_{1-(p1,\ q)}$, $x_{2-(p1,\ q)}$ and $x_{3-(p1,\ q)}$ whereas said second maximum value $Max_{(p, q)-2}$ is the largest value among said three sub-pixel input-signal values $x_{1-(p2, q)}$, $x_{2-(p2, q)}$ and $x_{3-(p2, q)}$.

9. An image display apparatus assembly comprising:

an image display apparatus employing (A): an image display panel including pixels each having a first sub-pixel for displaying a first color, a second sub-pixel for displaying a second color and a third sub-pixel for displaying a third color are laid out in a first direction and a second direction to form a 2-dimensional matrix, at least each specific pixel and an adjacent pixel adjacent to said specific pixel are used as a first pixel and a second pixel respectively to create one of a plurality of pixel groups, and a fourth sub-pixel for displaying a fourth color is placed adjacent said first and second pixels in each of said pixel groups, and a planar light-source apparatus to radiate illumination light to the rear face of said image display apparatus, and wherein the fourth sub-pixel output signal is determined based upon sub-pixel input signals supplied to the first and second pixels; and wherein said first signal value $SG_{(p, q)-1}$ is determined on the basis of a first minimum value $Min_{(p, q)-1}$ whereas a second signal value $SG_{(p, q)-2}$ is determined on the basis of a second minimum value $Min_{(p, q)-2}$ where said first minimum value $Min_{(p, q)-1}$ is the smallest value among said three sub-pixel input-signal values $x_{1-(p1, q)}$, $x_{2-(p1, q)}$ and $x_{3-(p1, q)}$ whereas said second minimum value $Min_{(p, q)-2}$ is the smallest value among said three sub-pixel input-signal values $x_{1-(p2, q)}$, $x_{2-(p2, q)}$ and $x_{3-(p2, q)}$ said first sub-pixel output-signal value $X_{1-(p1, q)}$ is found on the basis of at least said first sub-pixel input-signal value $x_{1-(p1, q)}$, said first maximum value $Max_{(p, q)-1}$, said first minimum value $Min_{(p, q)-1}$ and said first signal value $SG_{(p, q)-1}$;

said second sub-pixel output-signal value $X_{2-(p1, q)}$ is found on the basis of at least said second sub-pixel input-signal value $x_{2-(p1, q)}$, said first maximum value $Max_{(p, q)-1}$, said first minimum value $Min_{(p, q)-1}$ and said first signal value $SG_{(p, q)-1}$;

said third sub-pixel output-signal value $X_{3-(p1, q)}$ is found on the basis of at least said third sub-pixel input-signal value $x_{3-(p1, q)}$, said first maximum value $Max_{(p, q)-1}$, said first minimum value $Min_{(p, q)-1}$ and said first signal value $SG_{(p, q)-1}$;

said first sub-pixel output-signal value $X_{1-(p2, q)}$ is found on the basis of at least said first sub-pixel input-signal value $x_{1-(p2, q)}$, said second maximum value $Max_{(p, q)-2}$, said second minimum value $Min_{(p, q)-2}$ and said second signal value $SG_{(p, q)-2}$;

said second sub-pixel output-signal value $X_{2-(p2, q)}$ is found on the basis of at least said second sub-pixel input-signal value $x_{2-(p2, q)}$, said second maximum value $Max_{(p, q)-2}$, said second minimum value $Min_{(p, q)-2}$ and said second signal value $SG_{(p, q)-2}$; and said third sub-pixel output-signal value $X_{3-(p2, q)}$ is found on the basis of at least said third sub-pixel input-signal value $x_{3-(p2, q)}$, said second maximum value $Max_{(p, q)-2}$, said second minimum value $Min_{(p, q)-2}$ and said second signal value $SG_{(p, q)-2}$, where said first maximum value $Max_{(p, q)-1}$ is the largest value among said three sub-pixel input-signal values $x_{1-(p1, q)}$, $x_{2-(p1, q)}$ and $x_{3-(p1, q)}$ whereas said second maximum value $Max_{(p, q)-2}$ is the largest value among said three sub-pixel input-signal values $x_{1-(p2, q)}$, $x_{2-(p2, q)}$ and $x_{3-(p2, q)}$.

* * * * *